US009314804B1

(12) United States Patent
Harrower et al.

(10) Patent No.: US 9,314,804 B1
(45) Date of Patent: Apr. 19, 2016

(54) SPRAY SHIELD AND SPRAY SYSTEM INCLUDING THE SAME

(71) Applicants: Ashley Sean Harrower, Marysville, WA (US); Byron Grant Harrower, Marysville, WA (US); Deidre Ann Harrower, Marysville, WA (US)

(72) Inventors: Ashley Sean Harrower, Marysville, WA (US); Byron Grant Harrower, Marysville, WA (US); Deidre Ann Harrower, Marysville, WA (US)

( * ) Notice: Subject to any disclaimer, the term of this patent is extended or adjusted under 35 U.S.C. 154(b) by 308 days.

(21) Appl. No.: 13/869,936

(22) Filed: Apr. 24, 2013

Related U.S. Application Data

(60) Provisional application No. 61/638,053, filed on Apr. 25, 2012, provisional application No. 61/653,929, filed on May 31, 2012.

(51) Int. Cl.
*B05B 1/28* (2006.01)

(52) U.S. Cl.
CPC ..... *B05B 1/28* (2013.01)

(58) Field of Classification Search
CPC .. B05B 1/3033; B05B 15/067; B05B 15/066; F23D 1/00; A62C 31/24
USPC ..... 222/320, 382, 372, 383.1, 321.1, 383.3, 222/567, 526, 527, 531, 528, 333, 452, 451, 222/536; 239/582.1, 587.4, 587.3, 587.1, 239/587.2, 587.5, 587.6, 288.5
See application file for complete search history.

(56) References Cited

U.S. PATENT DOCUMENTS

| | | | | |
|---|---|---|---|---|
| 1,937,172 | A | 11/1933 | Starner et al. | |
| 2,928,610 | A | 3/1960 | Fenimore | |
| 3,012,555 | A | 12/1961 | Meshberg | |
| 3,116,856 | A | 1/1964 | Prussin et al. | |
| 3,260,465 | A | 7/1966 | Grumbein | |
| 3,314,426 | A | 4/1967 | Carroll | |
| 3,402,862 | A | 9/1968 | Meshberg | |
| 3,850,373 | A | 11/1974 | Grolitsch | |
| D244,995 | S | 7/1977 | Sullivan | |
| 4,199,896 | A | 4/1980 | Lehman | |
| D287,996 | S | 1/1987 | Carder, Sr. | |
| 4,865,257 | A | 9/1989 | Bailey | |
| 4,922,859 | A * | 5/1990 | Durell | A01K 13/00 119/603 |
| 4,986,473 | A | 1/1991 | Semple et al. | |
| 5,099,830 | A | 3/1992 | Kishimoto | |
| 5,280,856 | A * | 1/1994 | Haggerty | B05B 1/005 239/288 |
| 5,344,076 | A | 9/1994 | Mercurio | |
| 5,360,165 | A | 11/1994 | Singhal | |
| D353,537 | S | 12/1994 | Starrett | |
| D356,361 | S | 3/1995 | Feldt | |
| 5,419,077 | A | 5/1995 | Tombarelli | |

(Continued)

*Primary Examiner* — Arthur O Hall
*Assistant Examiner* — Christopher R Dandridge
(74) *Attorney, Agent, or Firm* — The Law Office of Patrick F. O'Reilly, III, LLC

(57) ABSTRACT

A spray shield device and a spray system including the same are disclosed herein. The spray shield device includes: (i) a deflector mounting member configured to engage a tubular member of a spray bottle or aerosol can, the deflector mounting member including a male portion; and (ii) a spray deflector member including a concave deflector portion and a collar portion, the collar portion comprising a female socket for matingly engaging with the male portion of the deflector mounting member, the concave deflector portion configured to generally face a target to which a spray is being applied. The spray system generally comprises: (i) a nozzle member, the nozzle member configured to be fluidly coupled to a fluid discharge passageway of a spray bottle or aerosol can; and (ii) a spray deflector member operatively coupled to the nozzle member.

11 Claims, 61 Drawing Sheets

(56) References Cited

U.S. PATENT DOCUMENTS

| | | | | |
|---|---|---|---|---|
| 5,609,272 | A | 3/1997 | Brass et al. | |
| D386,684 | S | 11/1997 | Marogil | |
| D398,704 | S | 9/1998 | Randle | |
| 6,145,756 | A | 11/2000 | Kohls | |
| 6,443,368 | B1 | 9/2002 | Kohls | |
| 6,679,438 | B1 | 1/2004 | Didlo | |
| 6,732,958 | B2 * | 5/2004 | Norville et al. | 239/582.1 |
| 7,063,275 | B2 | 6/2006 | Byron | |
| D527,257 | S | 8/2006 | Yu | |
| 7,431,222 | B2 | 10/2008 | Monterrosa | |
| D610,453 | S | 2/2010 | Cichy et al. | |
| 7,913,932 | B2 | 3/2011 | Wu | |
| D666,093 | S | 8/2012 | Wang | |
| 8,430,023 | B2 | 4/2013 | Hynes | |
| 2007/0119877 | A1 * | 5/2007 | Weltzin | B05B 15/0443 222/451 |
| 2007/0131792 | A1 | 6/2007 | Gardner et al. | |
| 2008/0296406 | A1 | 12/2008 | Gauthier, III | |
| 2010/0327079 | A1 | 12/2010 | Wu | |
| 2013/0068857 | A1 | 3/2013 | Hite | |

* cited by examiner

DETAIL D

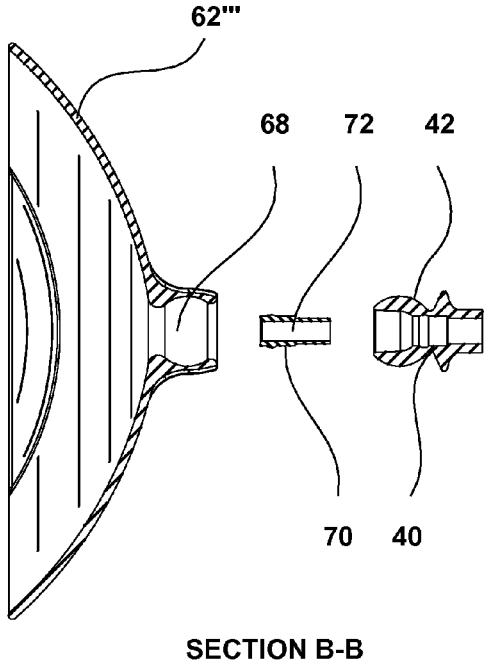
FIG 29
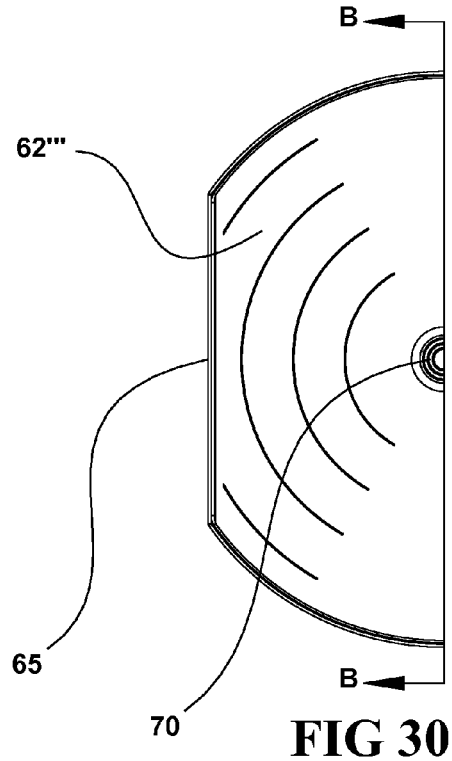
FIG 30
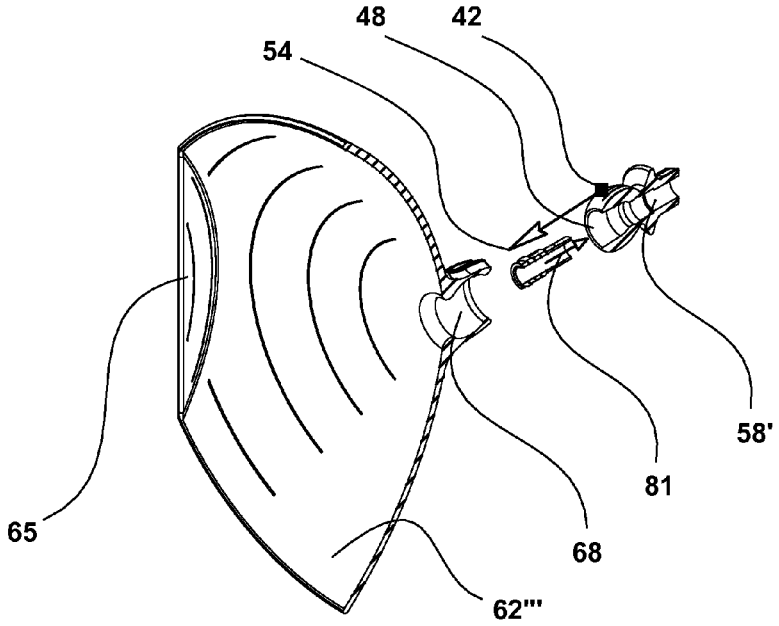
FIG 31 Isometric View of SECTION B-B

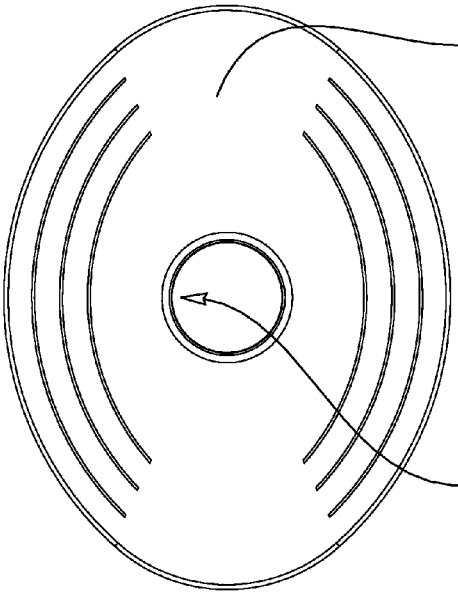
FIG 55
FIG 59
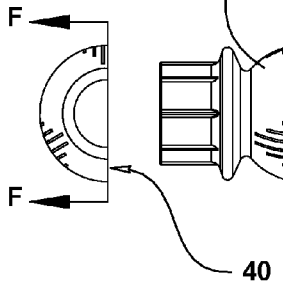
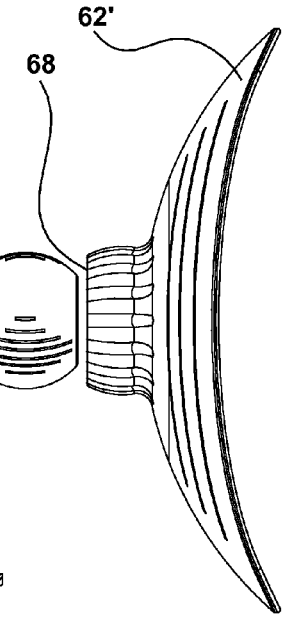
FIG 56
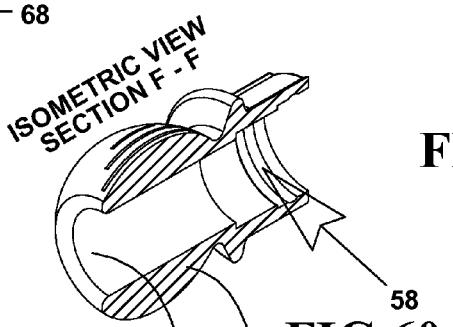
FIG 60
FIG 57
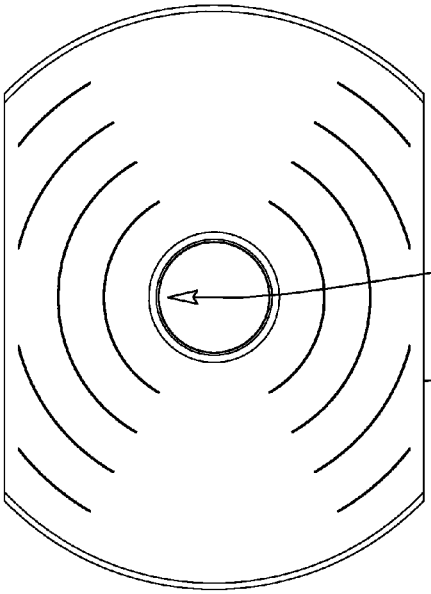
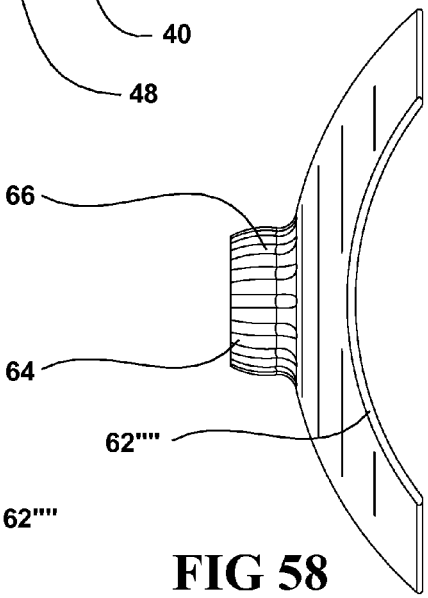
FIG 58

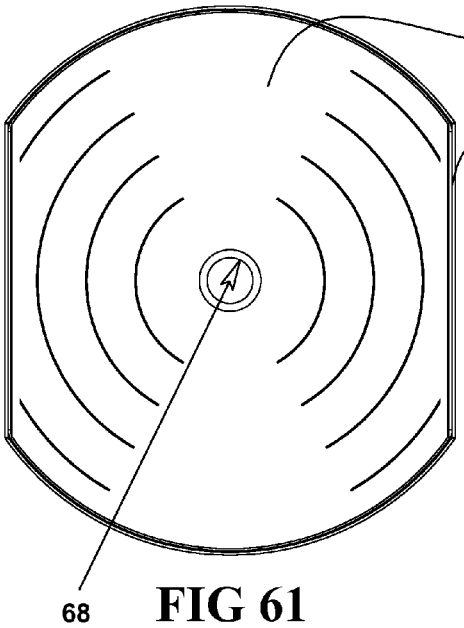
FIG 61
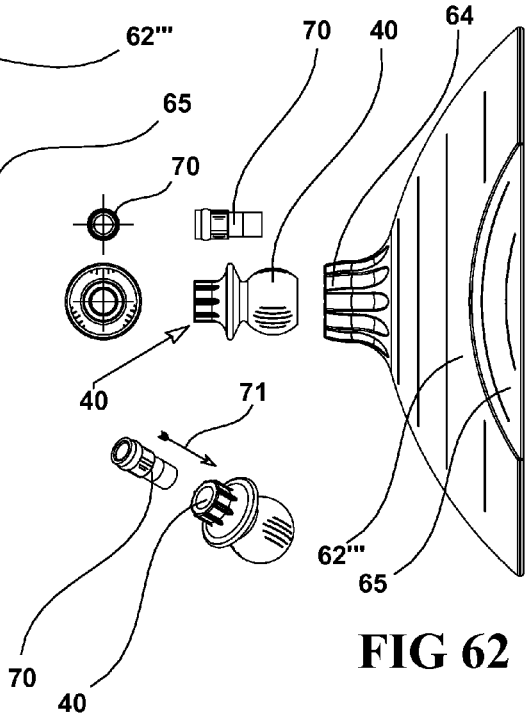
FIG 62
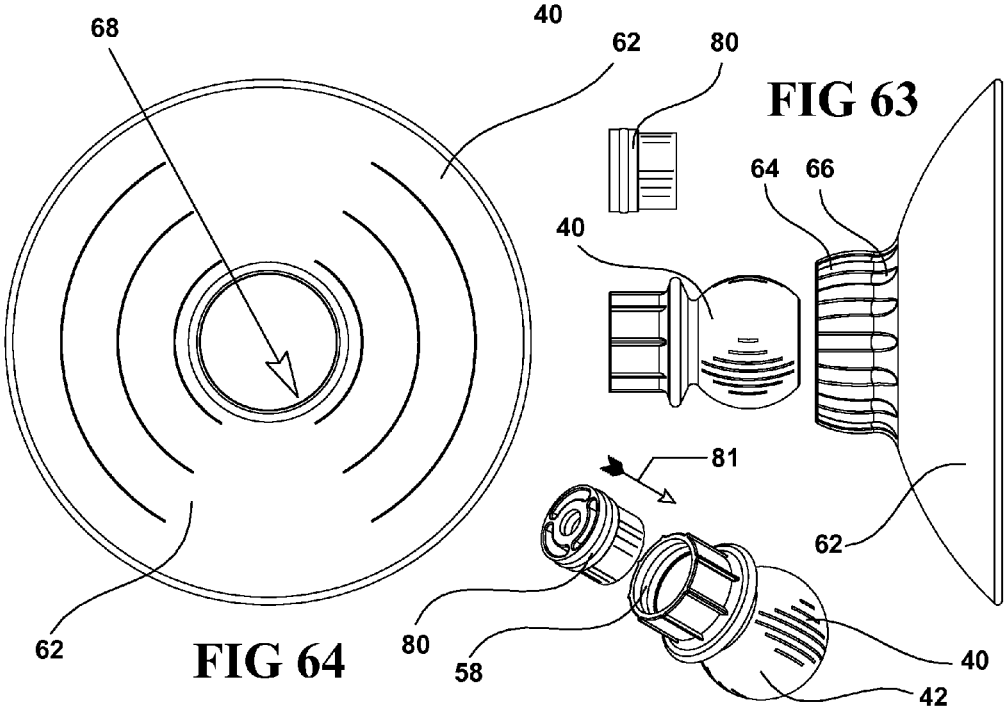
FIG 63
FIG 64

SECTION H-H

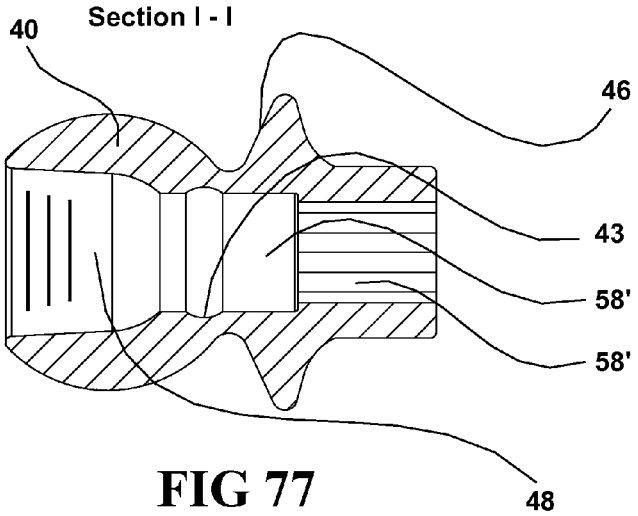
FIG 77
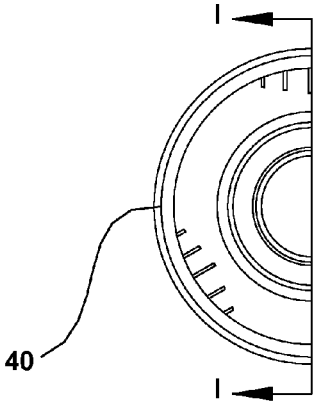
FIG 78
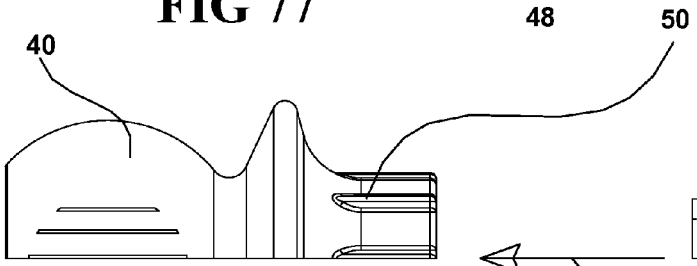
FIG 79
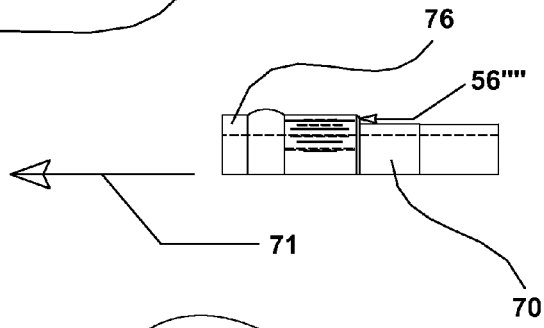
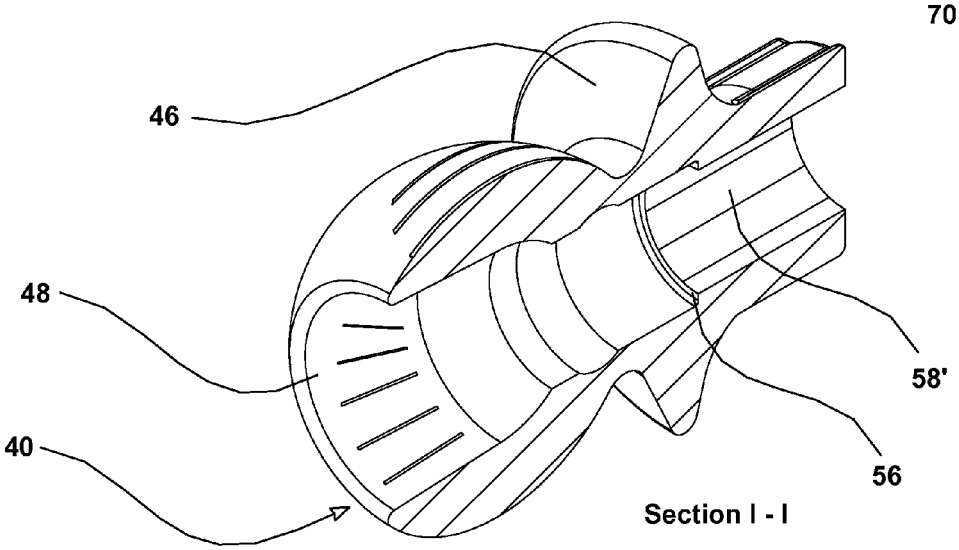
FIG 80

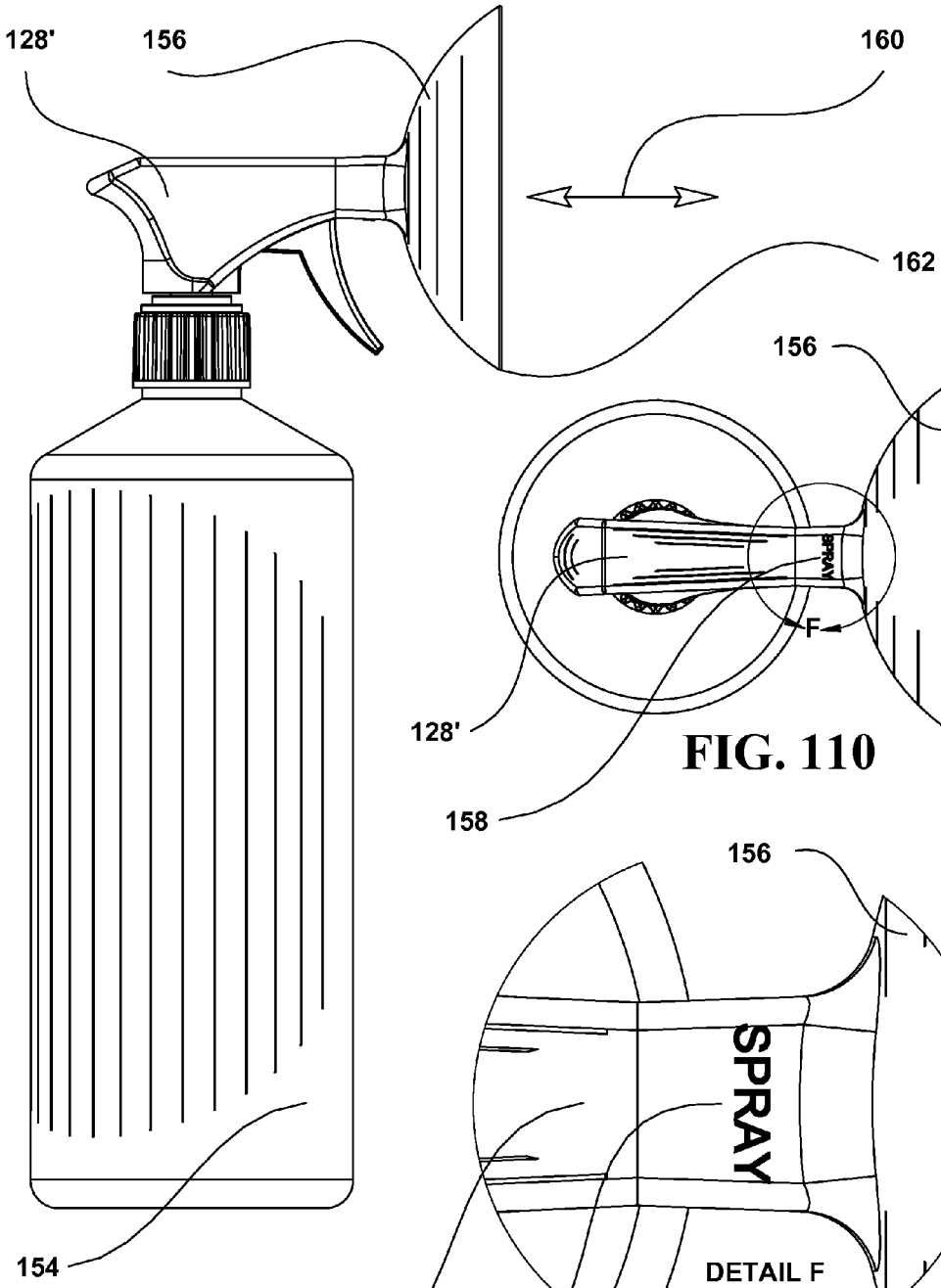
FIG. 109
FIG. 110
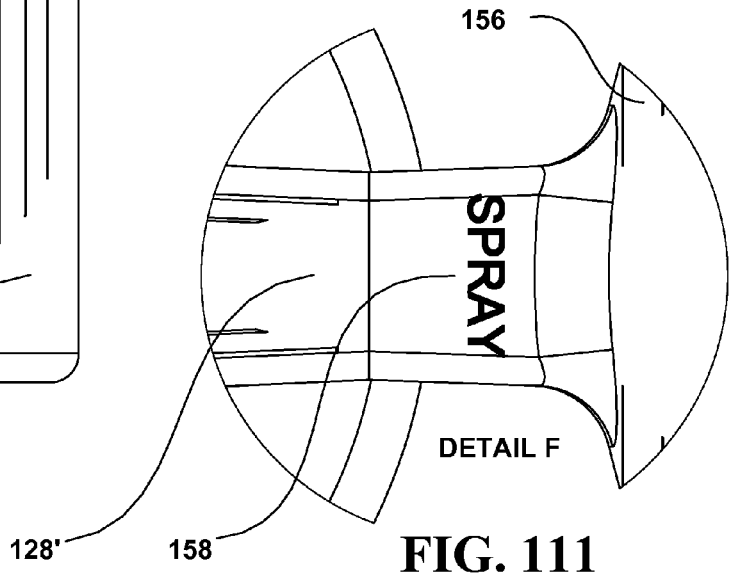
FIG. 111

FIG. 128
DETAIL I
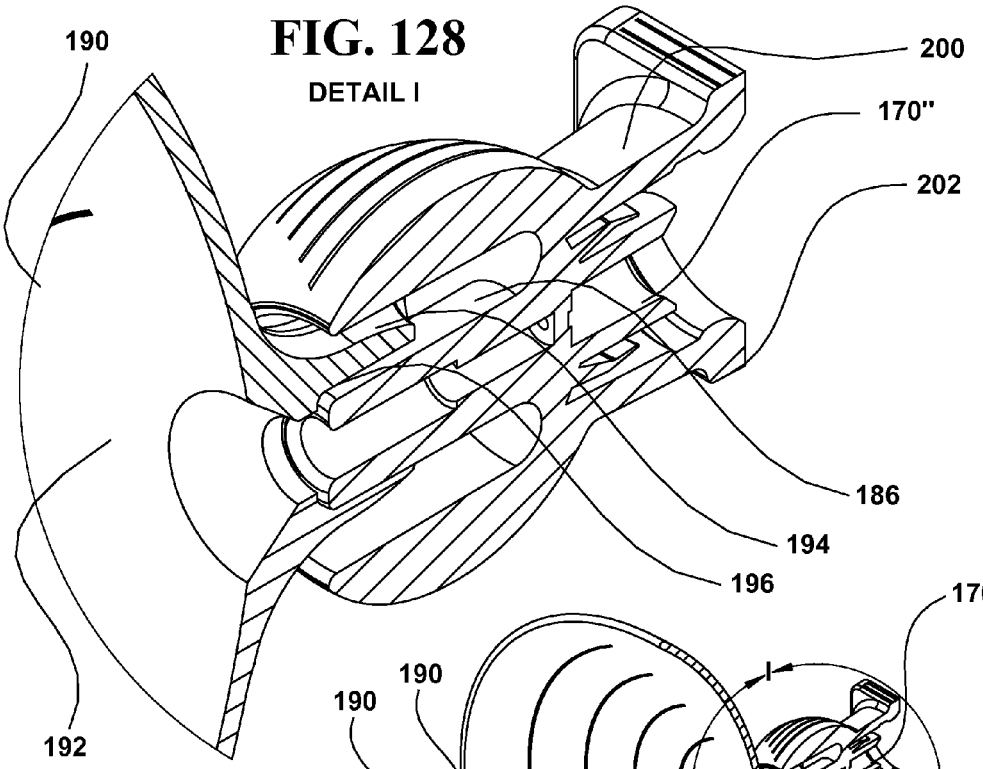
FIG. 129
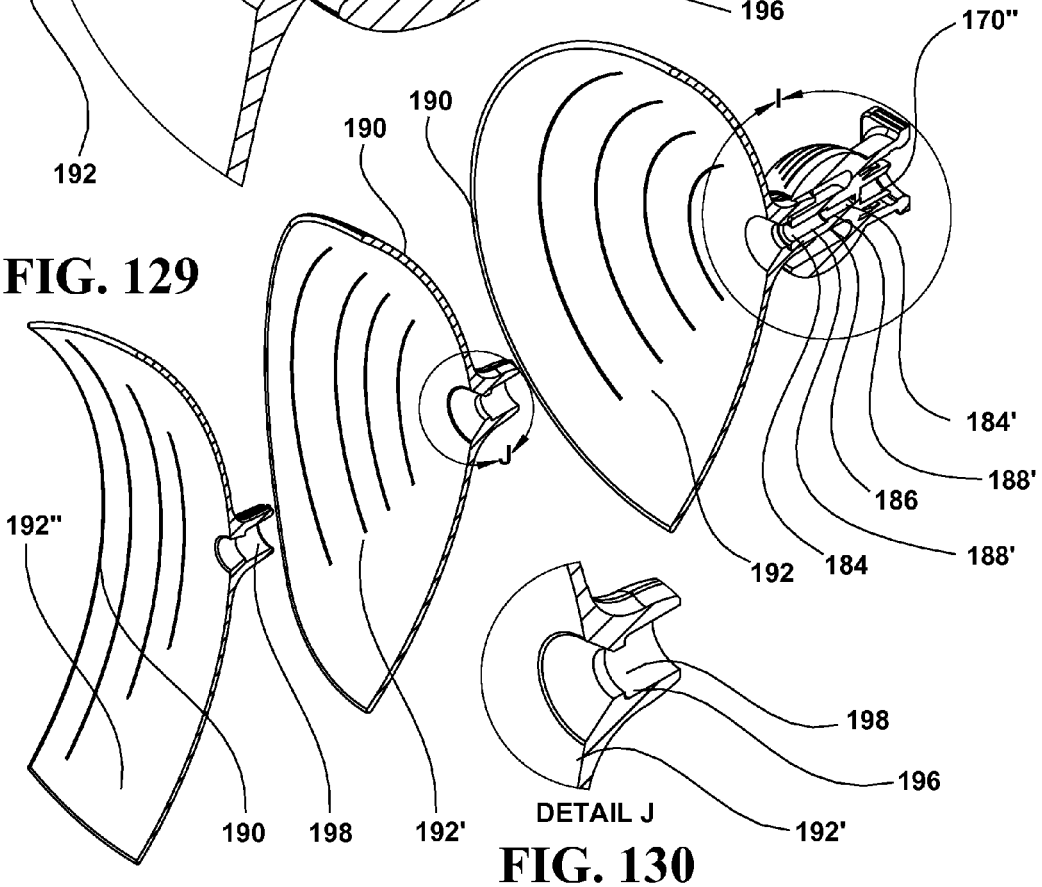
FIG. 130

FIG. 132
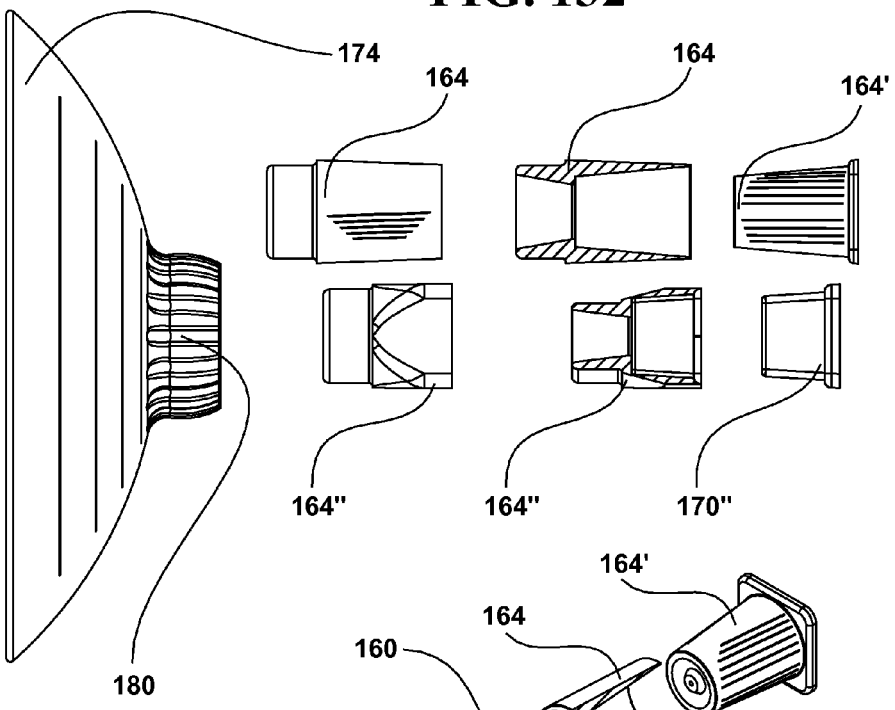
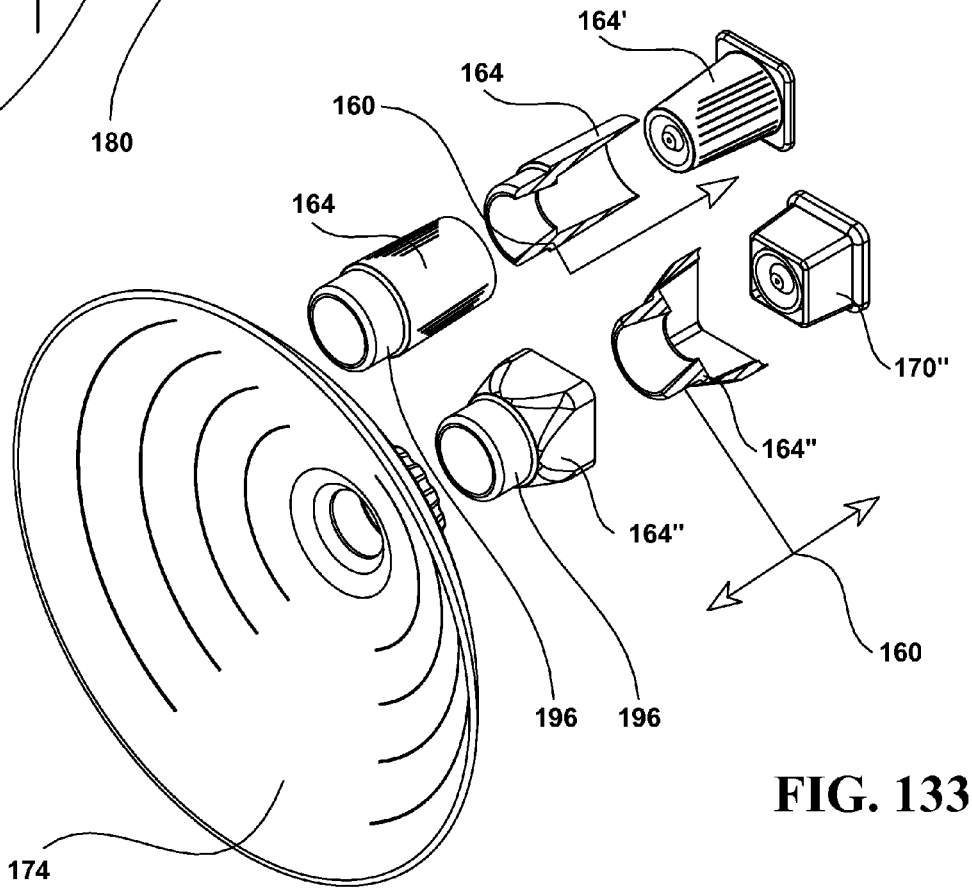
FIG. 133

FIG. 140
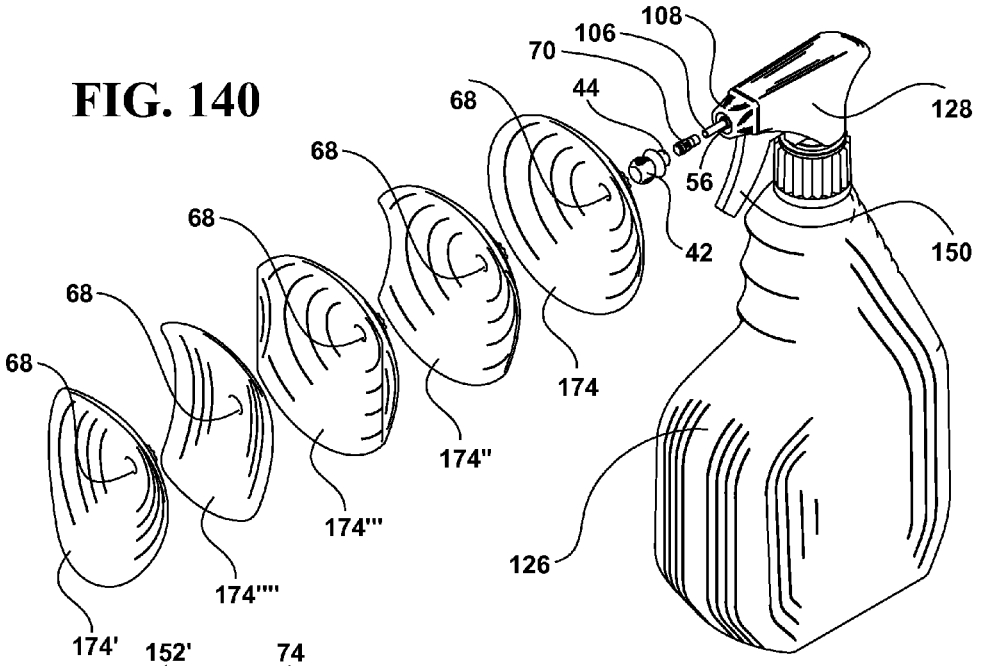
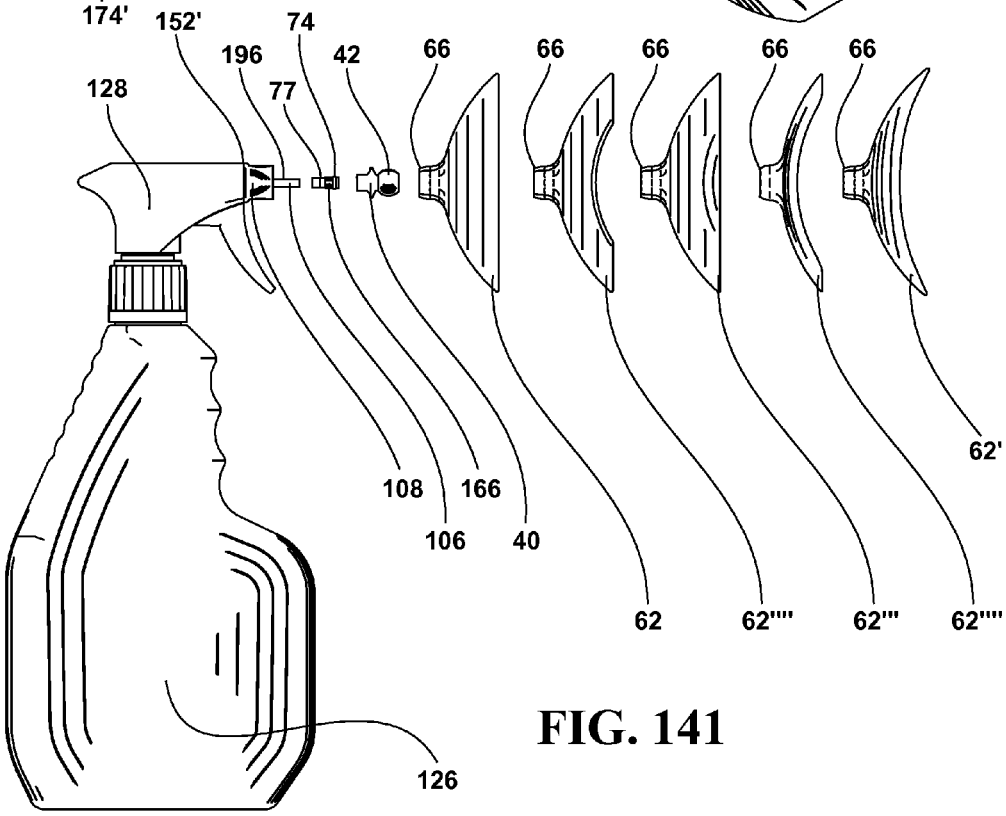
FIG. 141

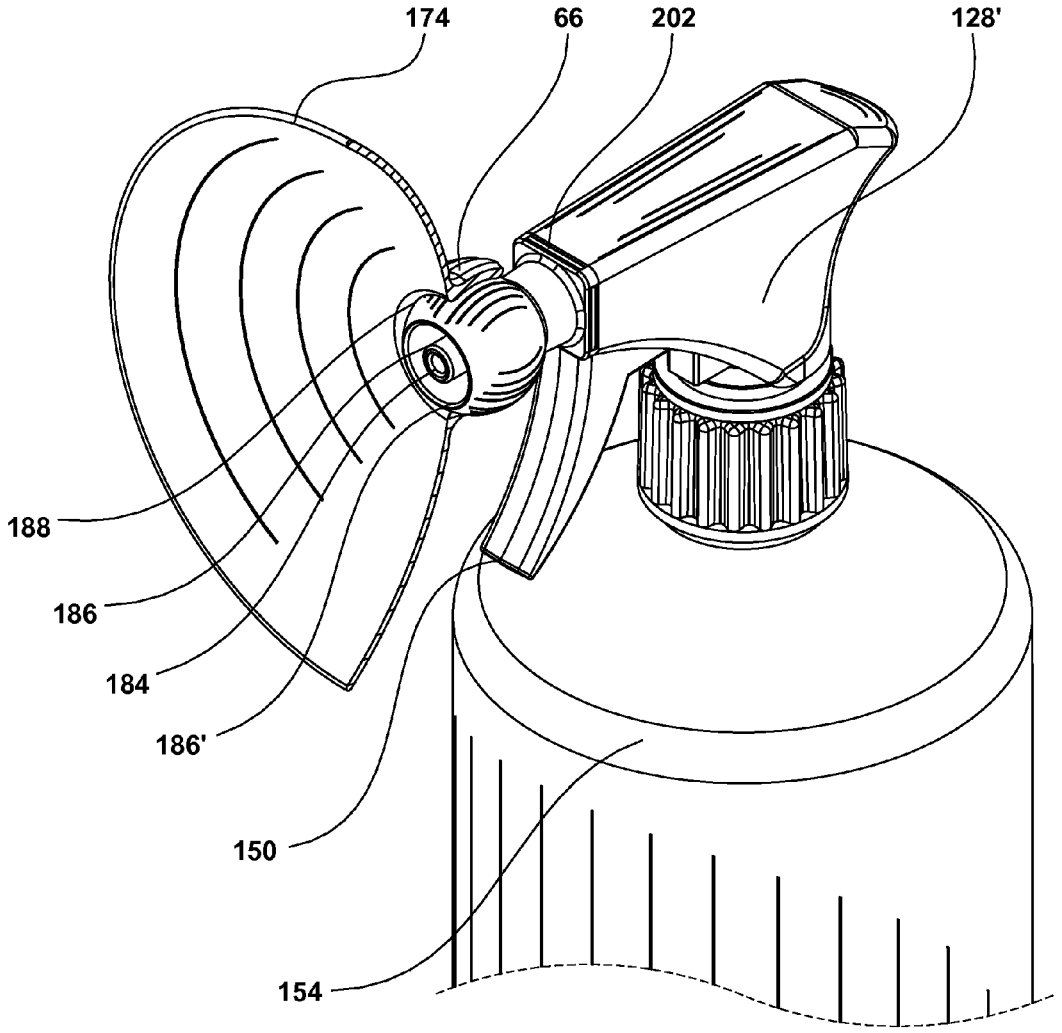
FIG. 147
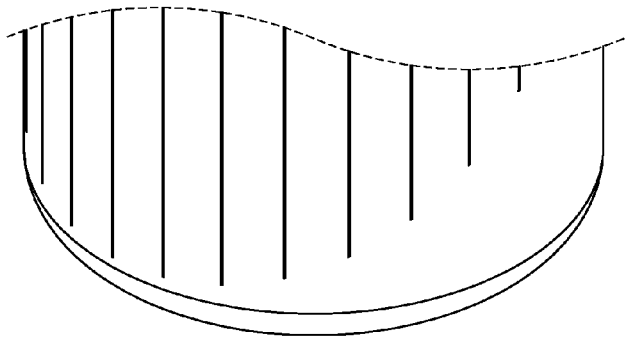

FIG. 157
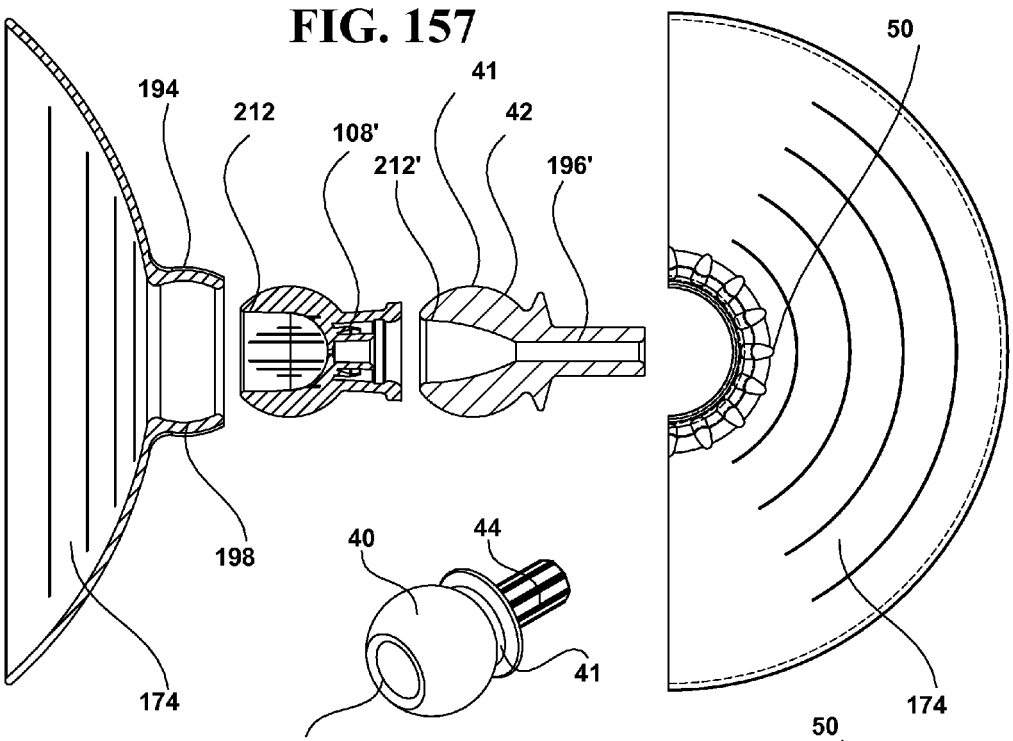
FIG. 158
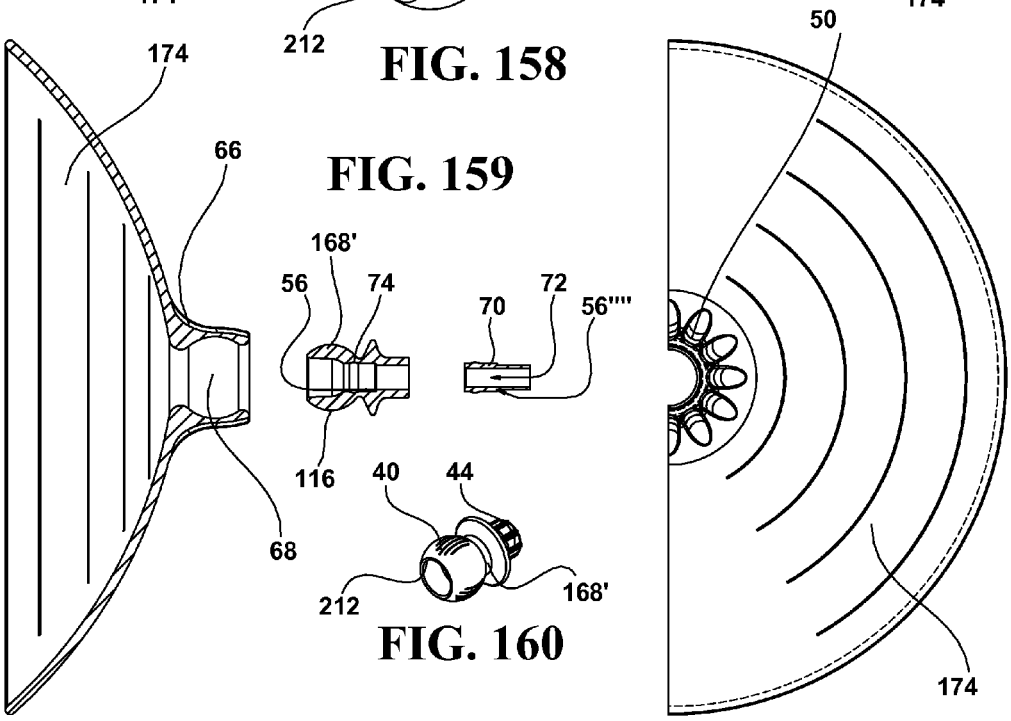
FIG. 159
FIG. 160

SPRAY SHIELD AND SPRAY SYSTEM INCLUDING THE SAME

CROSS-REFERENCE TO RELATED APPLICATIONS

This patent application claims priority to, and incorporates by reference in its entirety, U.S. Provisional Patent Application No. 61/638,053, entitled "Shield for Deflecting Away Spray that is Reflected from a Target", filed on Apr. 25, 2012. This patent application additionally claims priority to U.S. Provisional Patent Application No. 61/653,929, entitled "Systems for Delivering Fluid to a Location, and Related Methods", filed on May 31, 2012.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

INCORPORATION BY REFERENCE OF MATERIAL SUBMITTED ON A COMPACT DISK

Not Applicable.

BACKGROUND OF THE INVENTION

1. Field of the Invention

The invention generally relates to a spray shield device and a spray system including the same. More particularly, the invention relates to a spray shield device that is configured to deflect spray that is reflected from a target, and a spray system including a nozzle member and the spray shield device.

2. Background Description

Many times a fluid such as WD-40® or Liquid Wrench® sprayed from an aerosol can, or Windex® sprayed from a squirt bottle, will be reflected or blown back towards the can or bottle. When this happens the fluid can contact the hand, forearm and/or face and eyes of the person spraying the fluid. If the fluid is a petroleum based product, or other harmful fluid, the fluid can irritate the person's skin and might damage his or her eyes. If the fluid is less harmful to one's skin and eyes, then the fluid might only irritate the person's eyes diverting the person's attention away from spraying the fluid toward the desired target. If this happens, then the fluid might be sprayed toward a target that the fluid could damage, such as a plastic component, or the fluid could be wasted on an undesired target.

Many surfaces to which a fluid stream is being directed are simply not conducive to preventing a blowback. Often times, these surfaces are uneven and even oblique, causing the fluid or liquid to spray against the surfaces, and immediately be re-directed from the surfaces towards a person's eyes and face. Blowback also occurs when the sprayed chemical or liquid reflects off angled and even flat surfaces.

Therefore, what is needed is a spray shield device that is capable of deflecting spray that is reflected from a target so as to prevent accidental bodily harm to a user thereof. Moreover, a spray shield device is needed that is capable of being easily adjusted by a user thereof so that spray surfaces having various orientations can be easily accommodated. Furthermore, there is a need for a spray system, which includes a nozzle member and the spray shield device, that can be easily retrofitted on existing spray bottle and aerosol cans.

BRIEF SUMMARY OF THE INVENTION

Accordingly, the present invention is directed to a spray shield device and a spray system including the same that substantially obviates one or more problems resulting from the limitations and deficiencies in the related art.

In accordance with one aspect of the present invention, there is provided a spray shield device configured to deflect spray that is reflected from a target, the spray shield device comprising: a deflector mounting member configured to engage a tubular member of a spray bottle or aerosol can, the deflector mounting member including a male portion; and a spray deflector member including a concave deflector portion and a collar portion, the collar portion comprising a female socket for matingly engaging with the male portion of the deflector mounting member, the concave deflector portion configured to generally face a target to which a spray is being applied.

In a further embodiment of this aspect of the present invention, the male portion of the deflector mounting member has a generally spherical or ball shape, and wherein the female socket of the spray deflector member has a concave curvature that substantially corresponds to an outer curvature of the male portion of the deflector mounting member such that the male portion is configured to engage with the female socket and form a ball-and-socket joint therewith.

In yet a further embodiment, the ball-and-socket joint comprises a friction fit engagement between the male portion and the female socket such that a selected position of the spray deflector member relative to the deflector mounting member is capable of being maintained.

In still a further embodiment, the collar portion of the spray deflector member further comprises a ribbed finger grip portion for facilitating an adjustment of an angular position of the spray deflector member relative to the deflector mounting member.

In yet a further embodiment, the deflector mounting member further includes a ribbed finger grip portion for facilitating the grasping thereof by a user.

In still a further embodiment, the deflector mounting member further comprises at least one insert adapter member for engaging the tubular member of the spray bottle or aerosol can, the at least one insert adapter member including one or more annular projections for engaging with one or more respective grooves in a bore of the deflector mounting member.

In yet a further embodiment, the at least one insert adapter member comprises a plurality of insert adapter members that are capable of being interchangeably and removably engaged with the one or more respective grooves in the bore of the deflector mounting member, the plurality of insert adapter members configured to accommodate tubular members of spray bottles or aerosol cans having varying diameters.

In accordance with another aspect of the present invention, there is provided a spray shield deflection device configured to deflect spray that is reflected from a target, the spray shield deflector device comprising: a concave deflector portion configured to generally face a target to which a spray is being applied; and a collar portion coupled to the concave deflector portion, the collar portion including an aperture disposed therethrough for receiving one of: (i) an insert adapter member and (ii) a tubular member of a spray bottle or aerosol can.

In a further embodiment of this aspect of the present invention, the at least one insert adapter member for engaging the tubular member of the spray bottle or aerosol can, the at least one insert adapter member configured to be received within the aperture of the collar portion, the at least one insert adapter member including one or more annular projections for engaging with one or more respective grooves in the aperture of the collar portion.

In yet a further embodiment, the at least one insert adapter member comprises a plurality of insert adapter members that are capable of being interchangeably and removably engaged with the one or more respective grooves in the aperture of the collar portion, the plurality of insert adapter members configured to accommodate tubular members of spray bottles or aerosol cans having varying diameters.

In still a further embodiment, a portion of the aperture of the collar portion has a geometric configuration that corresponds to an external shape of a nozzle on a spray bottle or aerosol can, the portion of the aperture of the collar portion is configured to engage with the nozzle on the spray bottle or aerosol can.

In accordance with yet another aspect of the present invention, there is provided a spray system comprising: a nozzle member, the nozzle member configured to be fluidly coupled to a fluid discharge passageway of a spray bottle or aerosol can; and a spray deflector member operatively coupled to the nozzle member, the spray deflector member including a concave deflector portion and a collar portion, the concave deflector portion configured to generally face a target to which a spray is being applied.

In a further embodiment of this aspect of the present invention, the nozzle member comprises at least one finger pad for accommodating a finger of a user.

In yet a further embodiment, the at least one finger pad comprises a plurality of finger pads, two of the plurality of finger pads being disposed on opposite sides of the nozzle member and being downwardly sloped in a general direction of a spray discharge stream so as to ergonomically accommodate fingers of a user.

In still a further embodiment, an outlet of the nozzle member comprises a plurality of frustoconical sections with varying outer diameters configured to accommodate tubular members having varying inner diameters.

In yet a further embodiment, an outlet bore of the nozzle member comprises a plurality of sections with varying inner diameters configured to accommodate tubular members having varying outer diameters In still a further embodiment, the nozzle member is sized to correspond to at least some of the dimensions of an existing nozzle on a spray bottle or aerosol can so that the nozzle member is capable of replacing the existing nozzle, the nozzle member including a deflector mounting portion with a male portion; and wherein the collar portion of the spray deflector member comprises a female socket for matingly engaging with the male portion of the deflector mounting portion of the nozzle member.

In yet a further embodiment, the spray system further comprises a tubular member disposed between the nozzle member and the spray deflector member, the tubular member coupled to an outlet of the nozzle member, and the tubular member coupled to the collar portion of the spray deflector member.

In still a further embodiment, the tubular member is coupled to the collar portion of the spray deflector member by means of a deflector mounting member, the deflector mounting member including a male portion for matingly engaging with a female socket provided in the collar portion of the spray deflector member.

In yet a further embodiment, the nozzle member comprises a nozzle portion, a shaft portion, and a deflector mounting portion, the nozzle portion of the nozzle member configured to be fluidly coupled to the fluid discharge passageway of the spray bottle or aerosol can, the shaft portion of the nozzle member having a fluid passageway disposed therethrough, the shaft portion connecting the nozzle portion to the deflector mounting portion, and the deflector mounting portion including a male portion for matingly engaging with a female socket provided in the collar portion of the spray deflector member.

It is to be understood that the foregoing general description and the following detailed description of the present invention are merely exemplary and explanatory in nature. As such, the foregoing general description and the following detailed description of the invention should not be construed to limit the scope of the appended claims in any sense.

BRIEF DESCRIPTION OF THE SEVERAL VIEWS OF THE DRAWINGS

The invention will now be described, by way of example, with reference to the accompanying drawings, in which:

FIG. 29 is an exploded right side sectional view of the rectangular spray deflector shield with side walls, the deflector mounting member with the ball-shaped male portion, and the adapter mini-insert, according to an embodiment of the invention, which is cut along the cutting-plane line B-B in FIG. 30;

FIG. 30 is a partial front view of the rectangular spray deflector shield with side walls, the deflector mounting member with the ball-shaped male portion, and the adapter mini-insert, according to an embodiment of the invention;

FIG. 31 is an exploded sectional perspective view of the rectangular spray deflector shield with side walls, the deflector mounting member with the ball-shaped male portion, and the adapter mini-insert, according to an embodiment of the invention, which is cut along the cutting-plane line B-B in FIG. 30;

FIG. 55 is a front view of an oval-shaped spray deflector shield, according to an embodiment of the invention;

FIG. 56 is an exploded side view of the oval-shaped spray deflector shield and a deflector mounting member with a ball-shaped male portion, according to an embodiment of the invention;

FIG. 57 is a front view of a rectangular spray deflector shield, according to an embodiment of the invention;

FIG. 58 is a left side view of a rectangular spray deflector shield, according to an embodiment of the invention;

FIG. 59 is a partial front view of the deflector mounting member with the ball-shaped male portion, according to an embodiment of the invention;

FIG. 60 is a sectional perspective view of the deflector mounting member with the ball-shaped male portion, according to an embodiment of the invention, which is cut along the cutting-plane line F-F in FIG. 59;

FIG. 61 is a front view of a rectangular spray deflector shield with side walls, according to an embodiment of the invention;

FIG. 62 is an exploded left side view of the rectangular spray deflector shield with side walls, a deflector mounting member with a ball-shaped male portion, and an adapter mini-insert, according to an embodiment of the invention, wherein front and perspective views of the deflector mounting member with the ball-shaped male portion and the adapter mini-insert are additionally shown;

FIG. 63 is an exploded left side view of a circular spray deflector shield, a deflector mounting member with a ball-shaped male portion, and an adapter cored-insert, according to an embodiment of the invention, wherein perspective views of the deflector mounting member with the ball-shaped male portion and the adapter cored-insert are additionally shown;

FIG. 64 is a front view of a circular spray deflector shield, according to an embodiment of the invention;

FIG. 77 is a side sectional view of the deflector mounting member with the ball-shaped male portion, according to an embodiment of the invention, which is cut along the cutting-plane line I-I in FIG. 78;

FIG. 78 is a partial front view of a deflector mounting member with the ball-shaped male portion, according to an embodiment of the invention;

FIG. 79 is a partial exploded side view of the deflector mounting member with the ball-shaped male portion and the adapter cored-insert, according to an embodiment of the invention;

FIG. 80 is a sectional perspective view of the deflector mounting member with the ball-shaped male portion, according to an embodiment of the invention, which is cut along the cutting-plane line I-I in FIG. 78;

FIG. 109 is a left side view of the cylindrical spray bottle having the non-swivel, circular deflector shield installed thereon, wherein the non-swivel, circular deflector shield is press-fitted over the existing nozzle of the cylindrical spray bottle, according to an embodiment of the invention;

FIG. 110 is a top view of the cylindrical spray bottle having the non-swivel, circular deflector shield installed thereon, wherein the non-swivel, circular deflector shield is press-fitted over the existing nozzle of the cylindrical spray bottle, according to an embodiment of the invention;

FIG. 111 is an enlarged, partial top view of the encircled portion of FIG. 110, which includes a portion of the non-swivel, circular deflector shield and a portion of the existing nozzle and cylindrical spray bottle, according to an embodiment of the invention;

FIG. 112 illustrates side views of various deflector mounting members with ball-shaped male portions and side views of various retrofit replacement nozzle members and nozzle adapters, according to embodiments of the invention;

FIG. 113 illustrates side views of various adapter inserts for spray bottles and side views of various nozzle adapters for spray bottles, according to embodiments of the invention;

FIG. 114 is a disassembled right side view of a flat-body spray bottle and an associated spray assembly;

FIG. 115 illustrates perspective views of various deflector mounting members with ball-shaped male portions and perspective views of various retrofit replacement nozzle members, according to embodiments of the invention;

FIG. 116 illustrates perspective views of various adapter inserts for spray bottles and perspective views of various nozzle adapters for spray bottles, according to embodiments of the invention;

FIG. 117 is a disassembled perspective view of a flat-body spray bottle and an associated spray assembly;

FIG. 118 is a right side view of a cylindrical spray bottle having a spray system installed thereon, wherein the spray system includes a retrofit replacement nozzle member with a ball-shaped male portion and a circular spray deflector shield angled in a downward position, with a curved tubular member inserted into the retrofit nozzle according to an embodiment of the invention;

Figure 119:
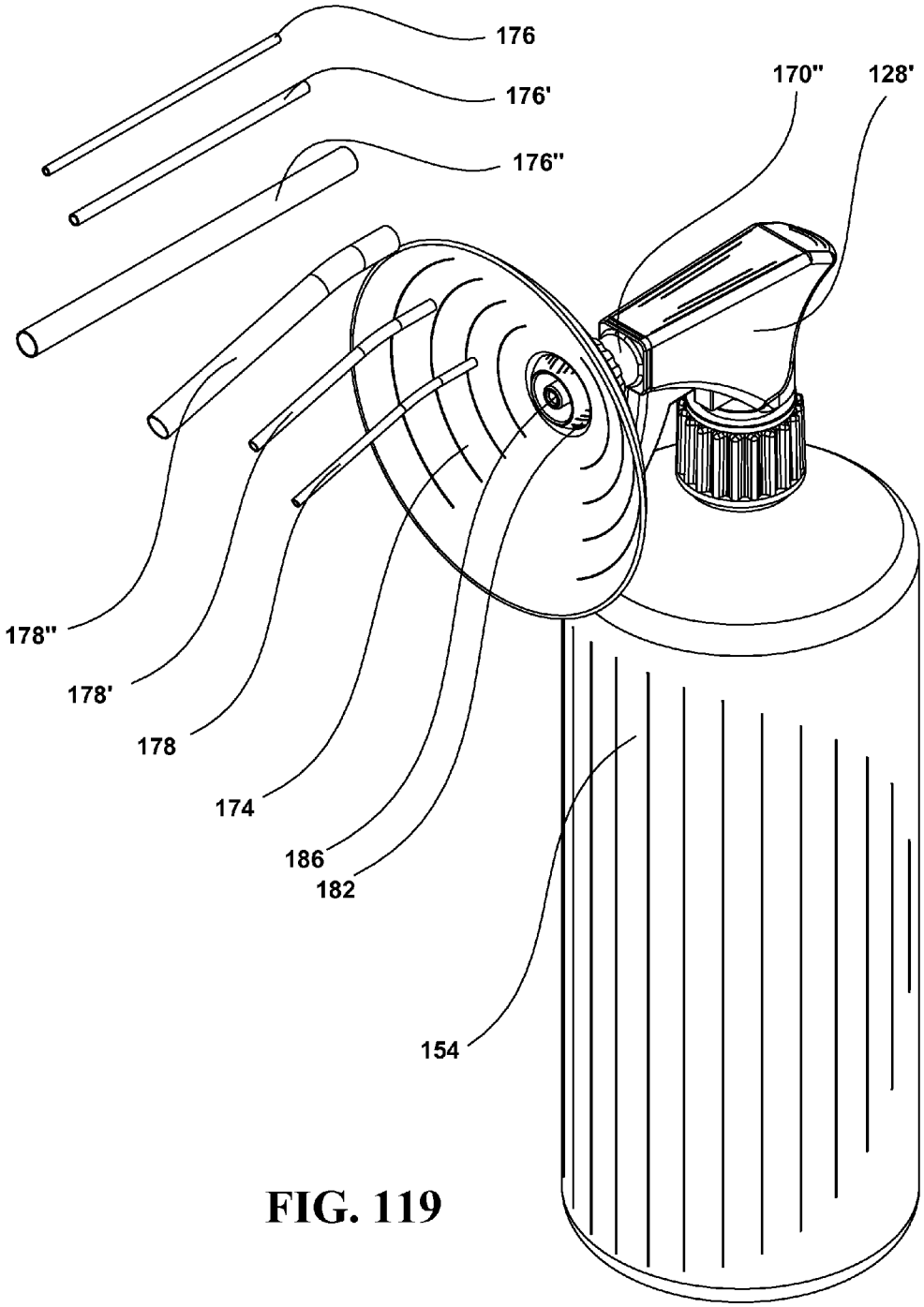
Figures 120, 121:
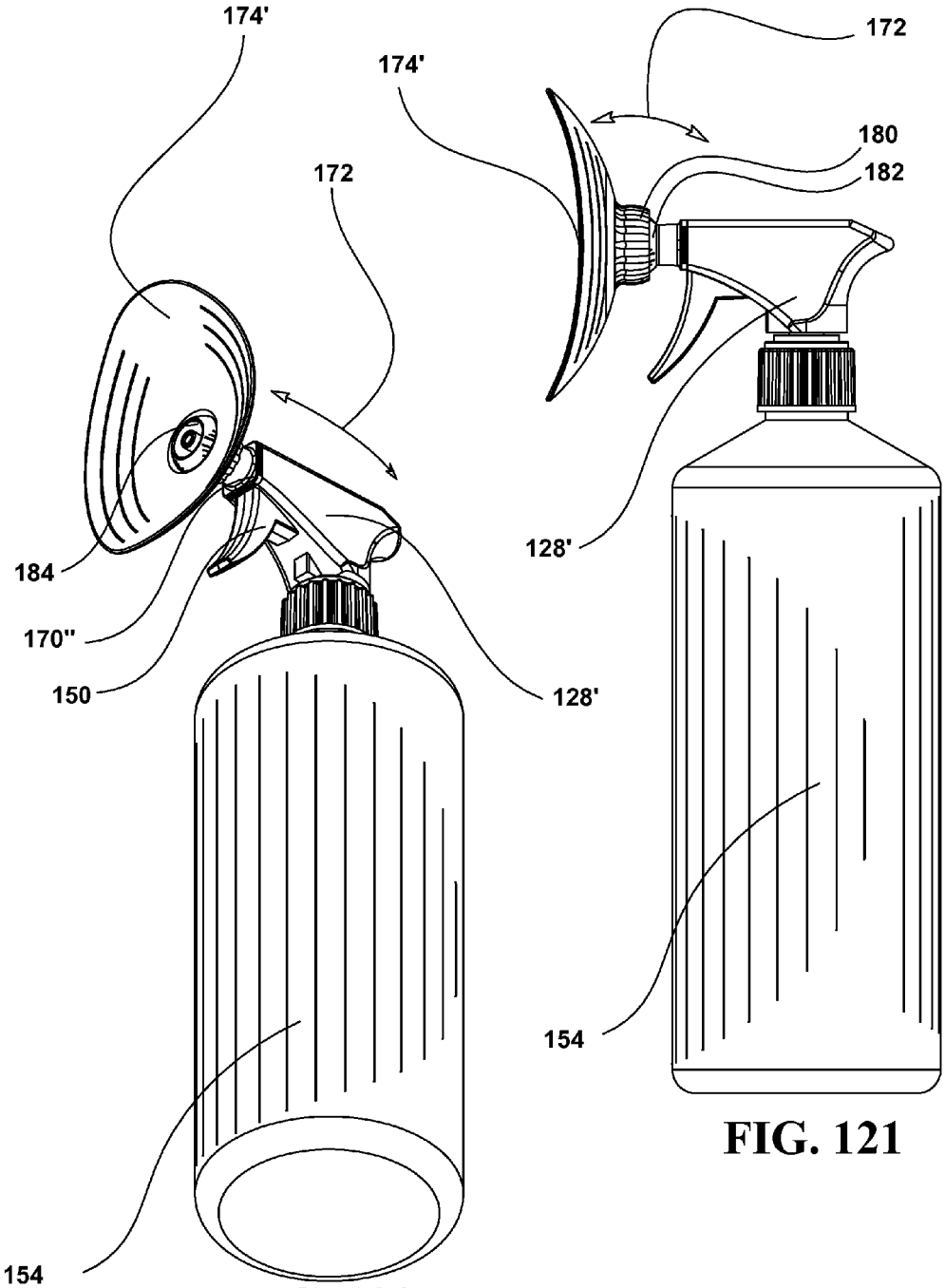
Figures 122, 123, 124:
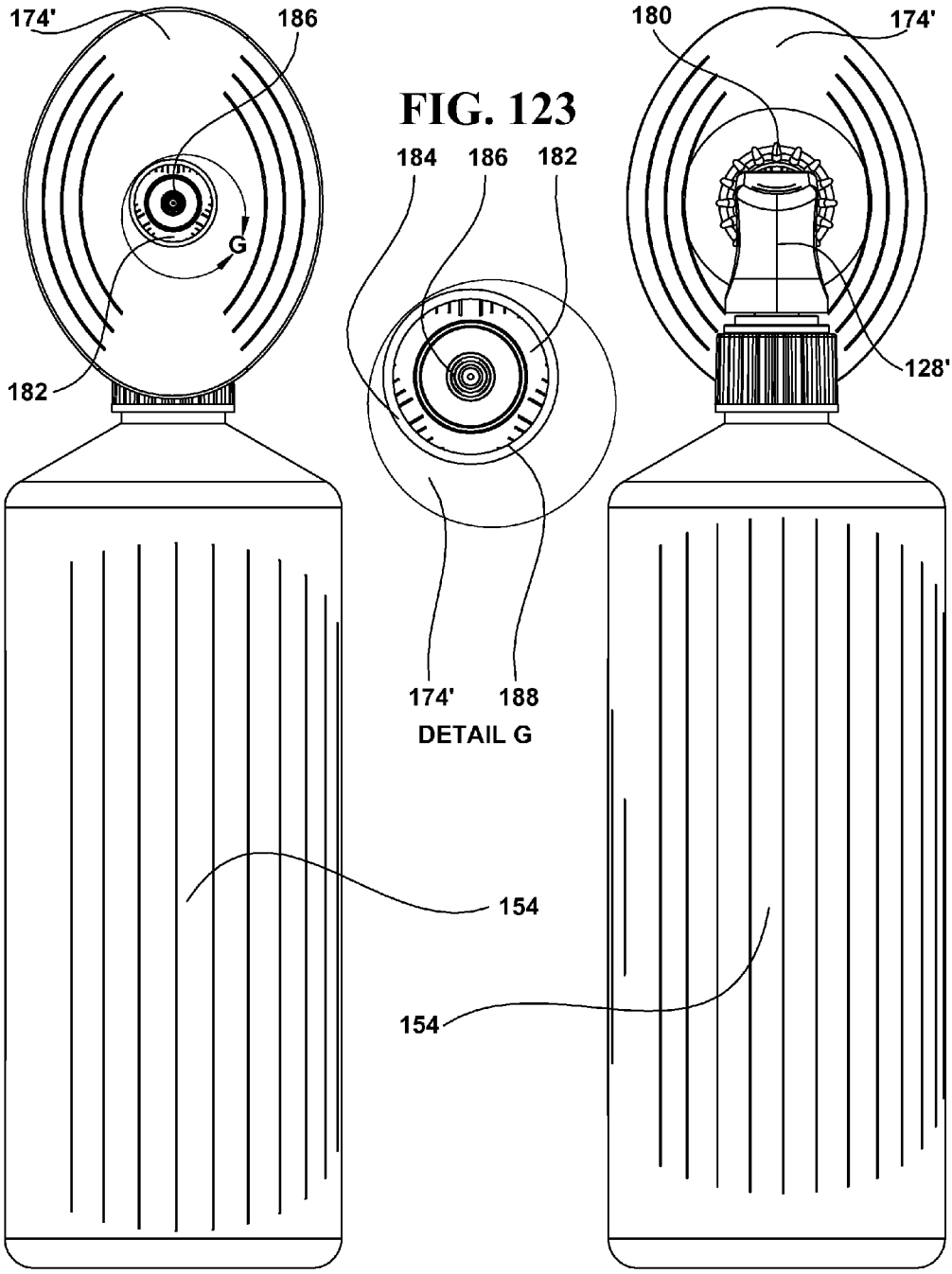
Figure 125:
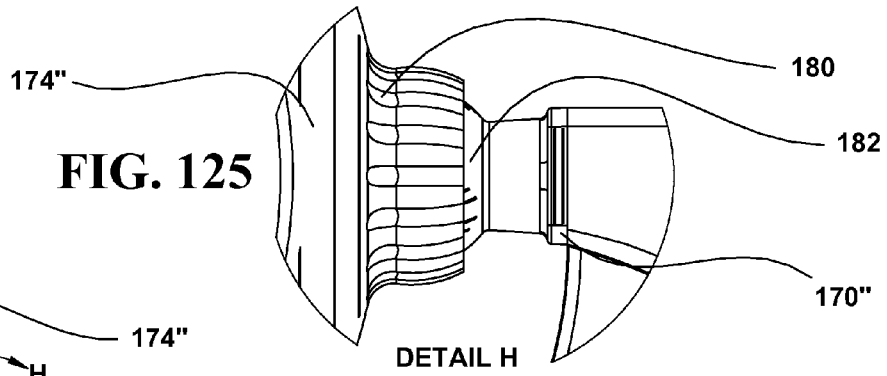
Figure 127:
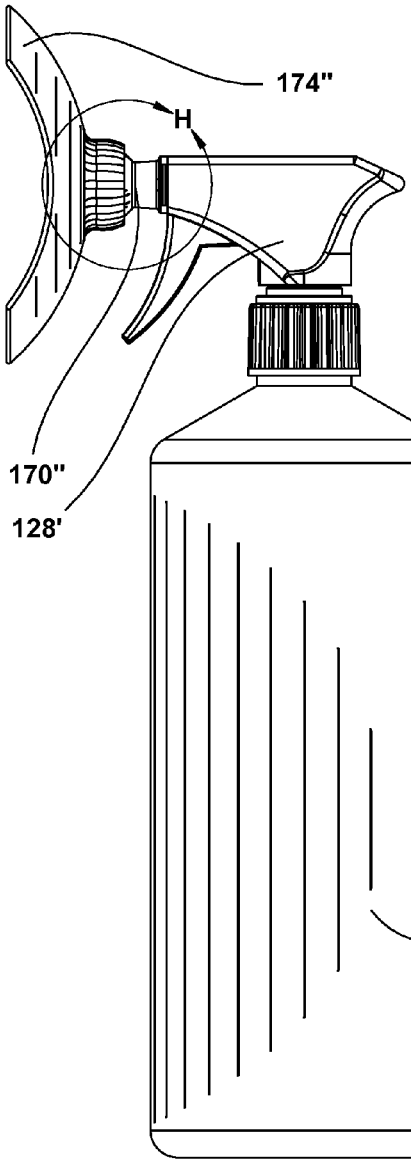
Figure 126:
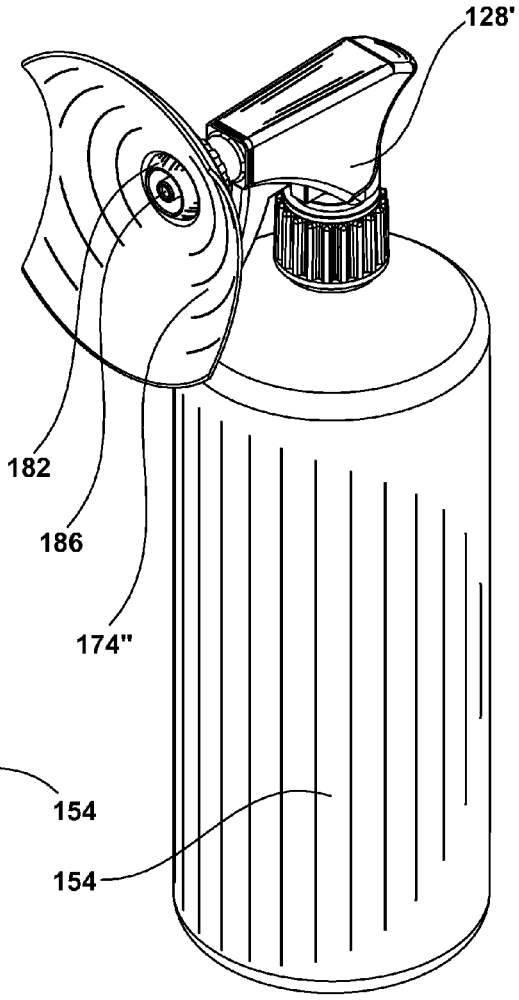
Figures 131A, 131B:
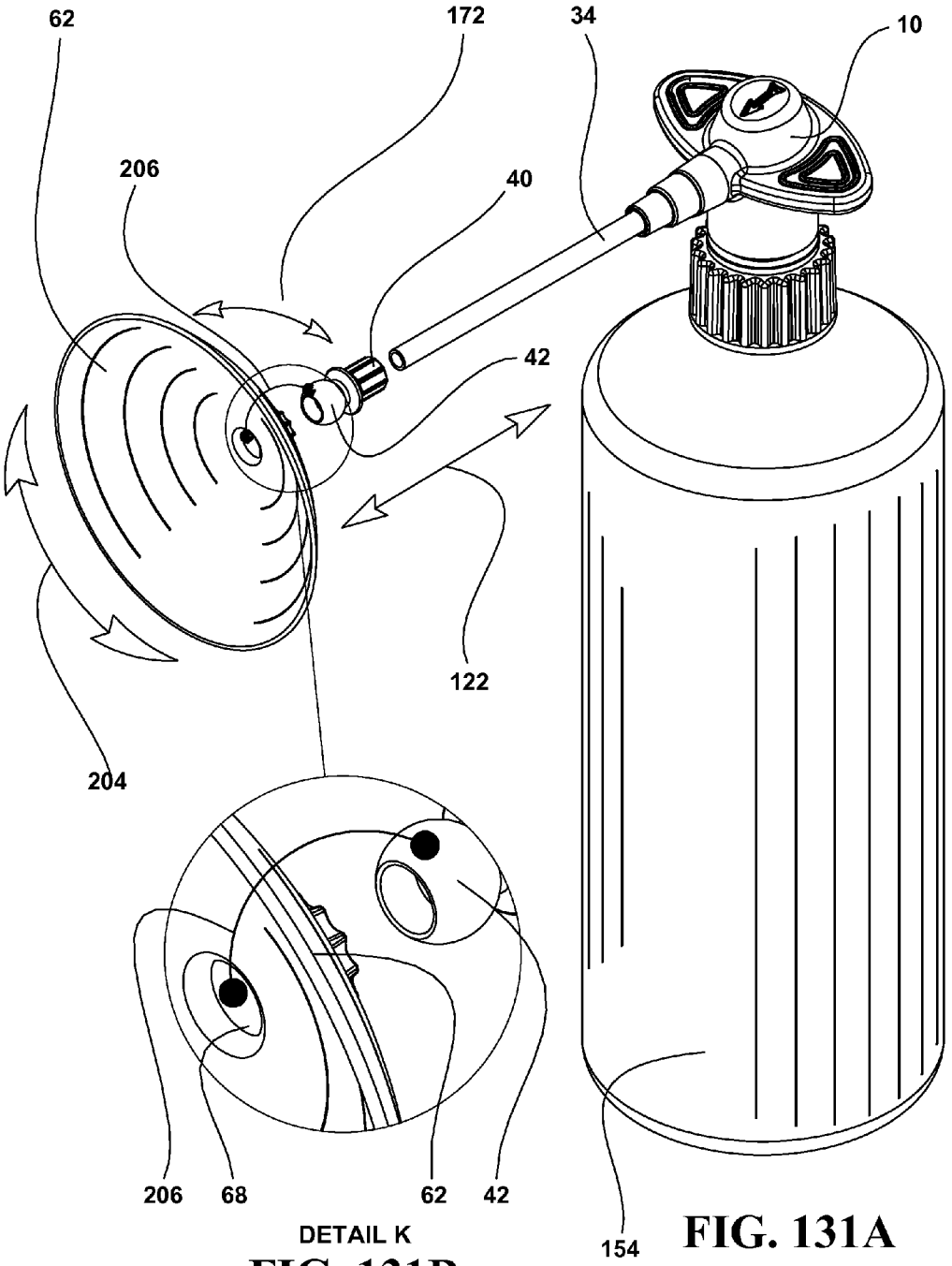
Figures 134, 135:
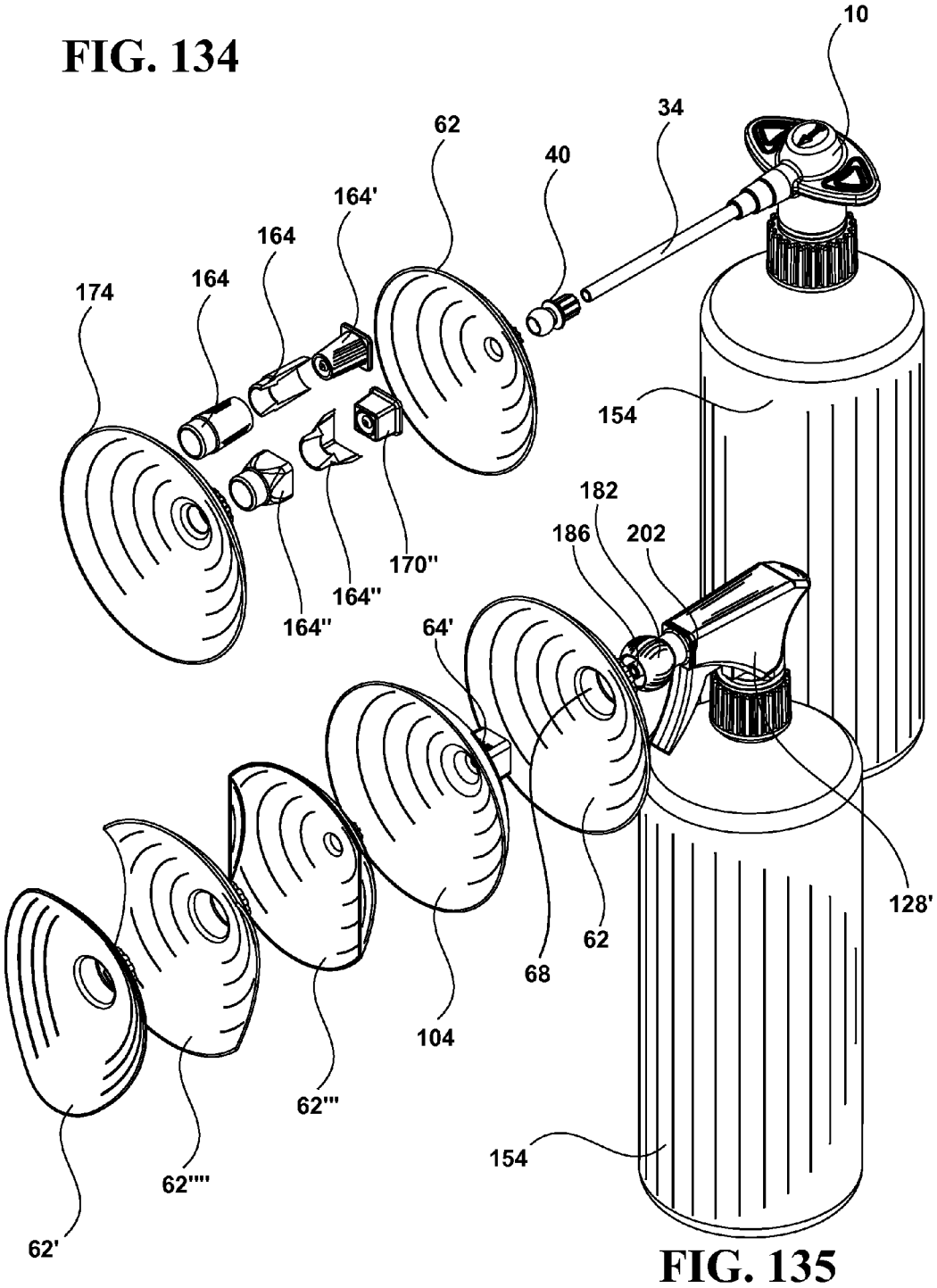
Figures 136, 137:
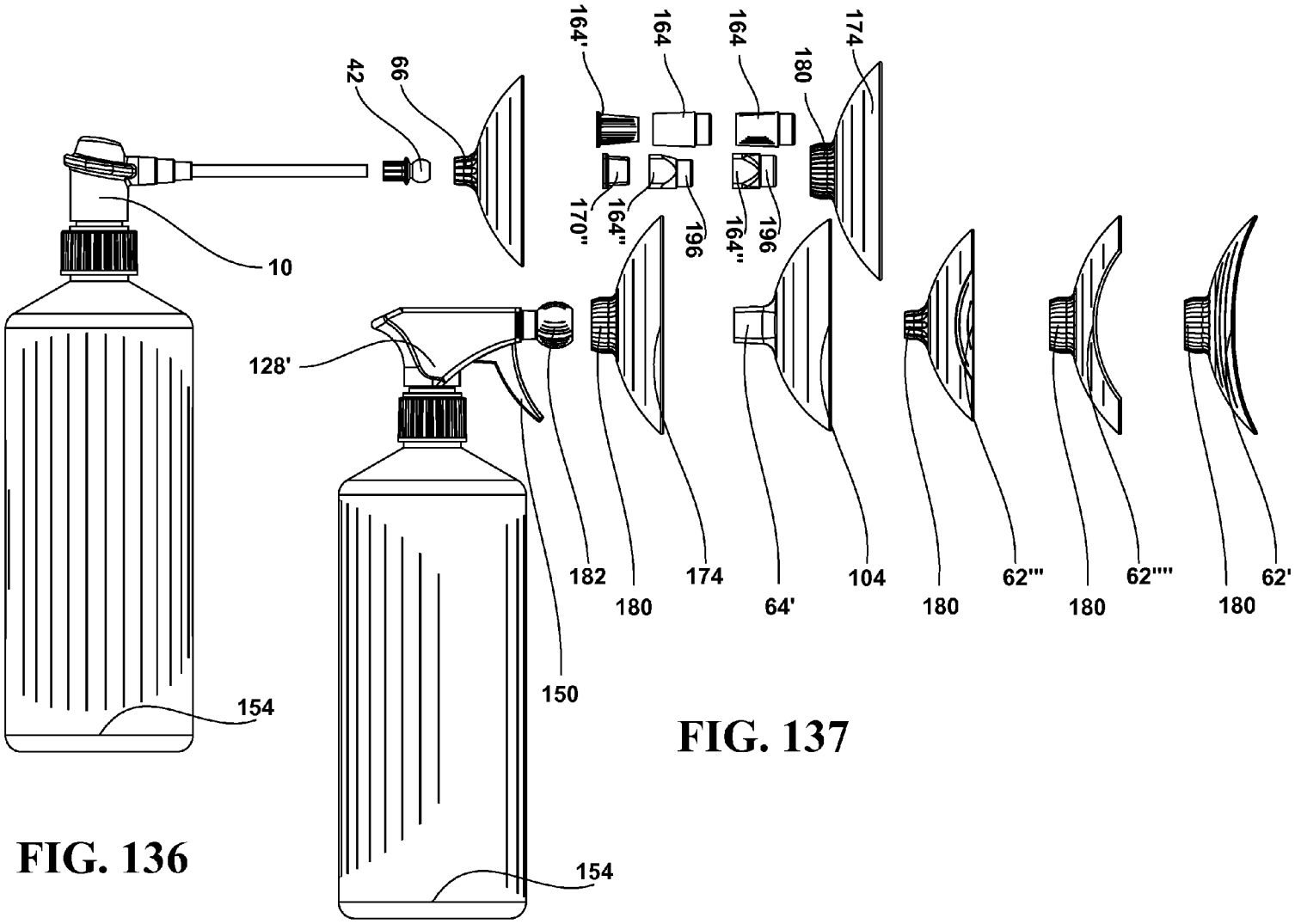
Figures 138, 139:
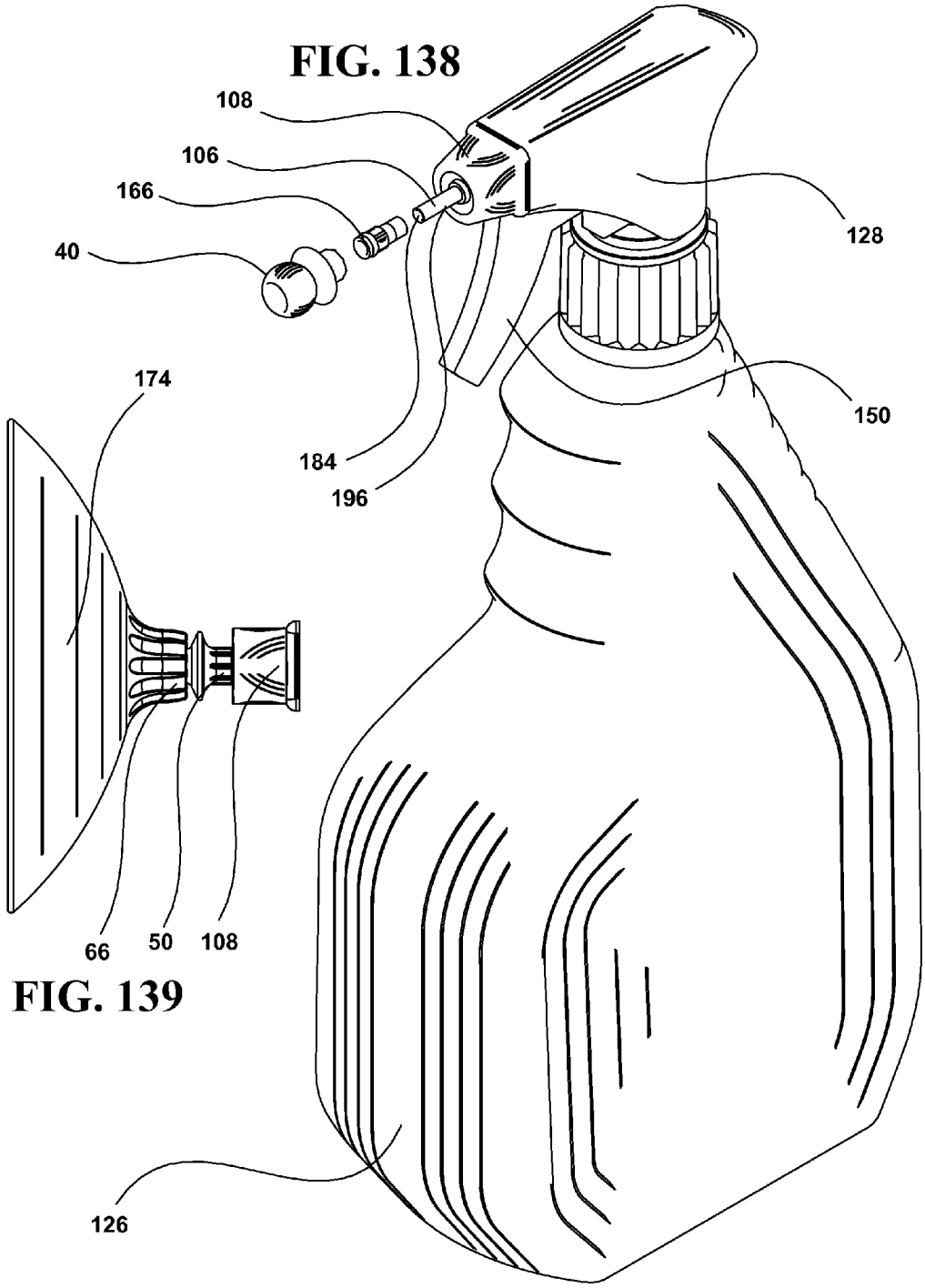
Figure 142:
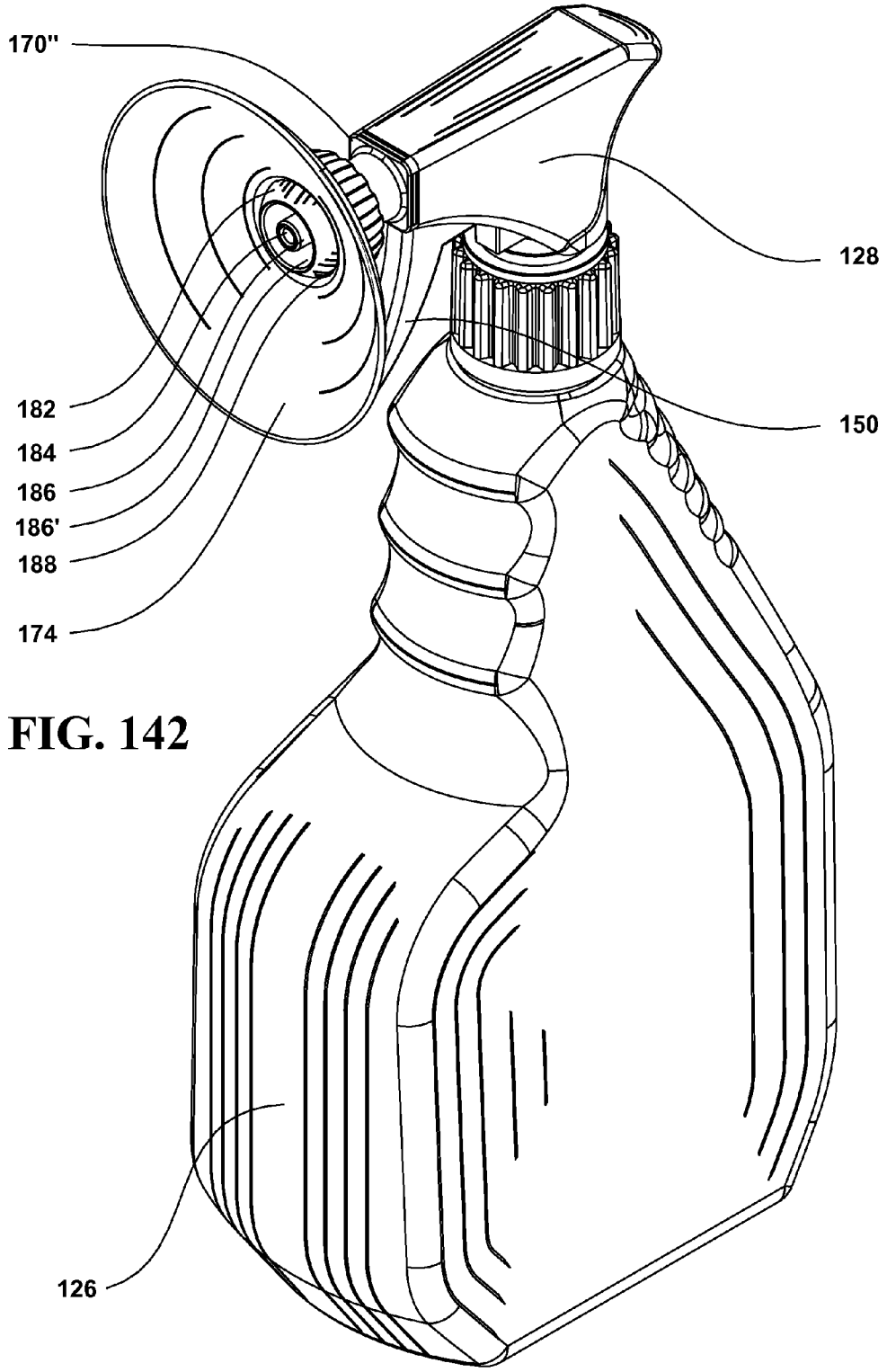
Figures 143, 144:
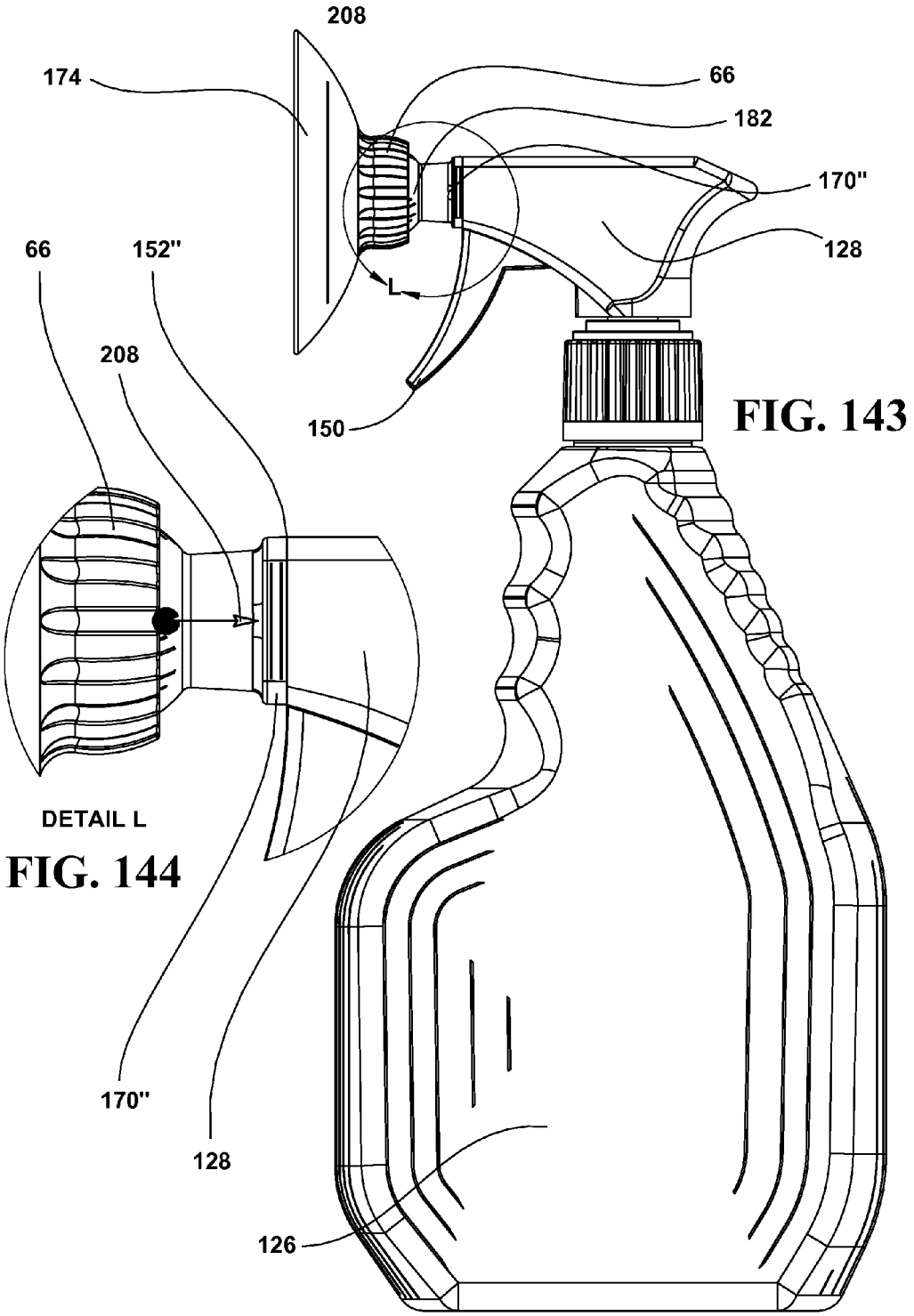
Figure 146:
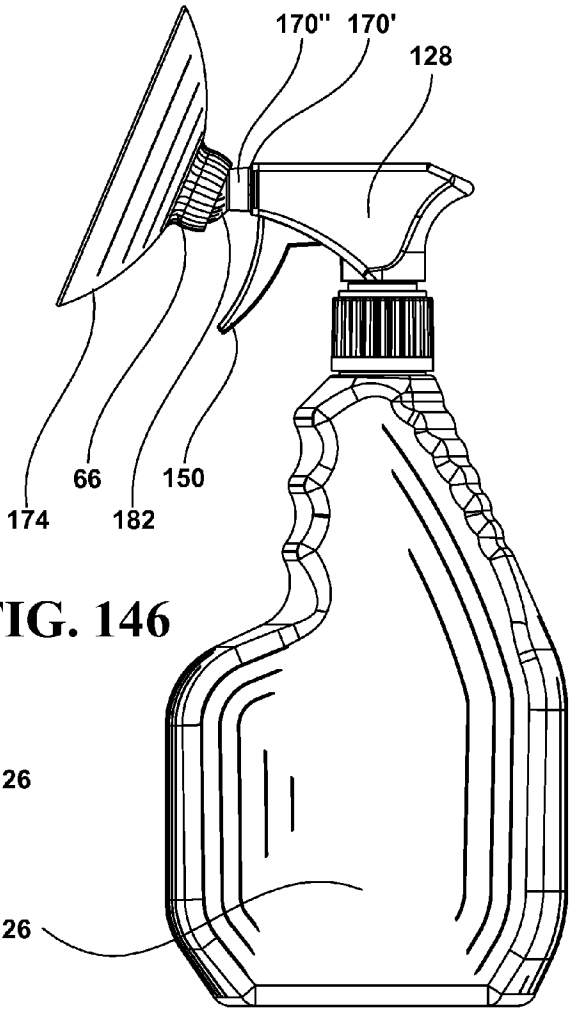
Figure 145:
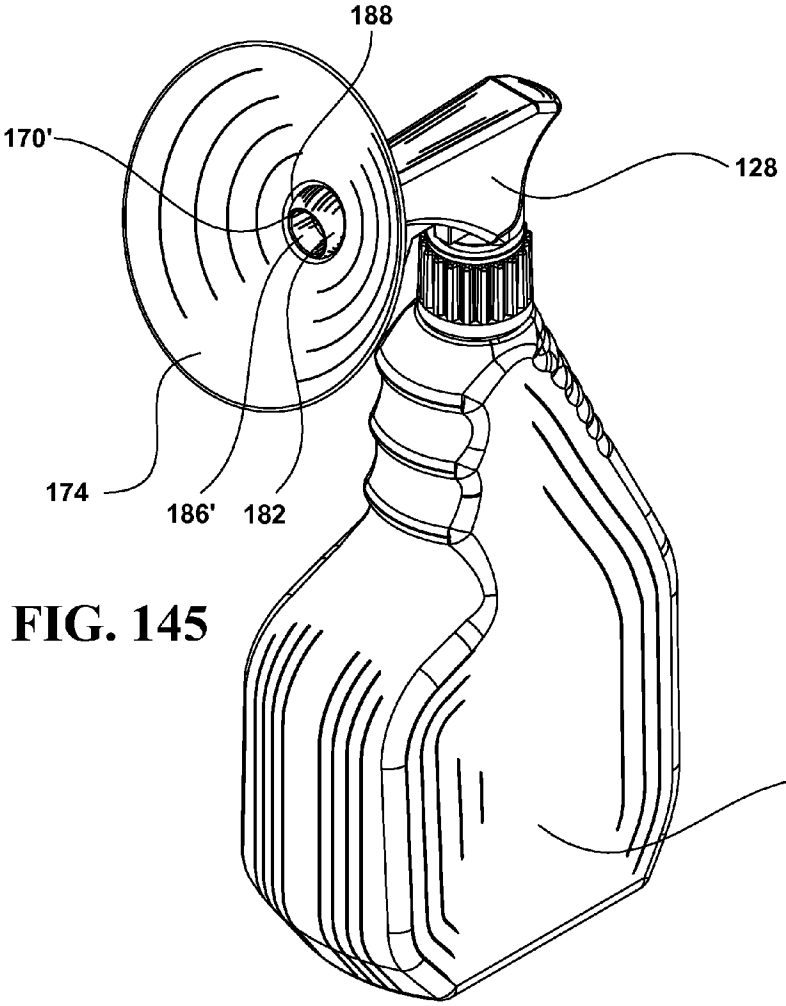
Figure 148:
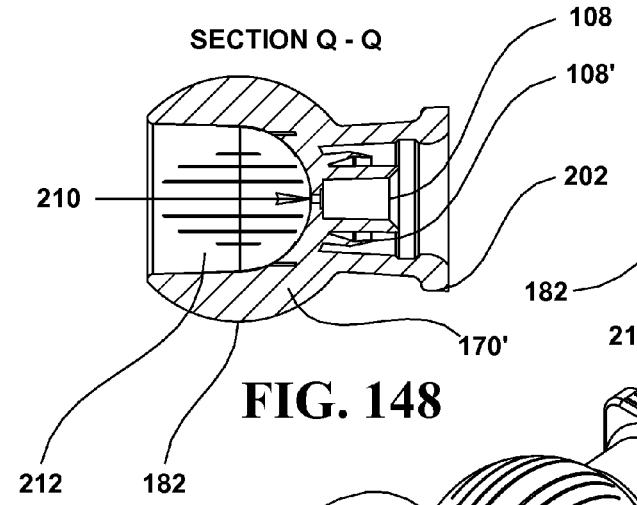
Figure 149:
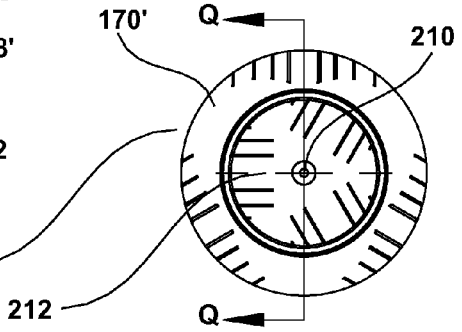
Figure 150:
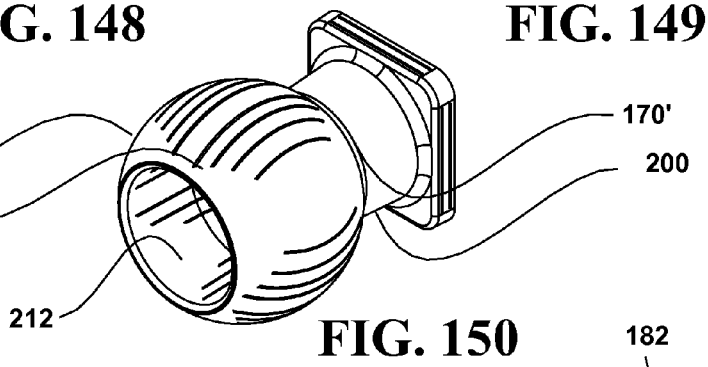
Figure 151:
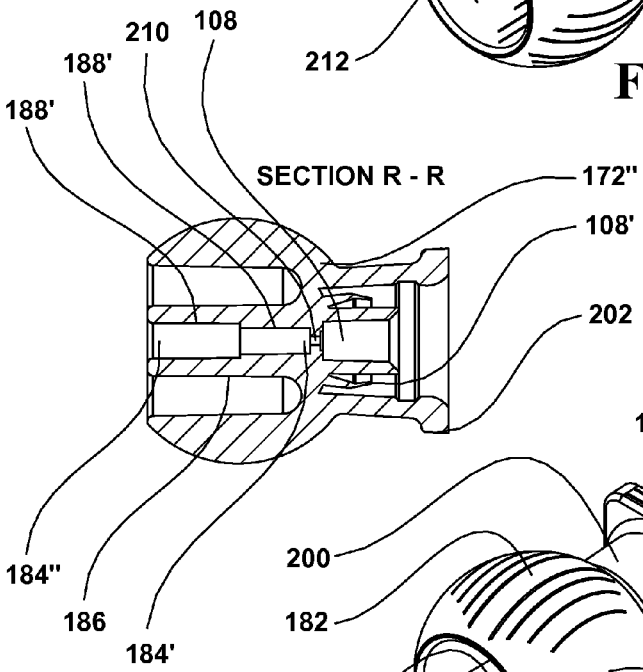
Figure 152:
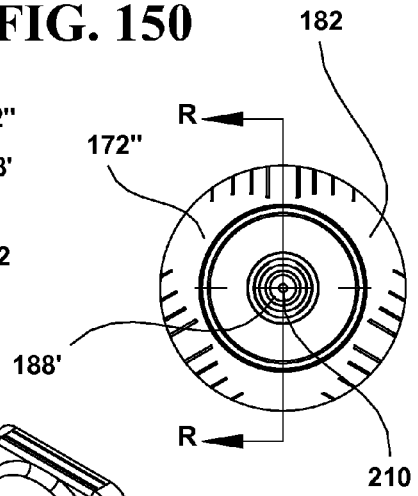
Figure 153:
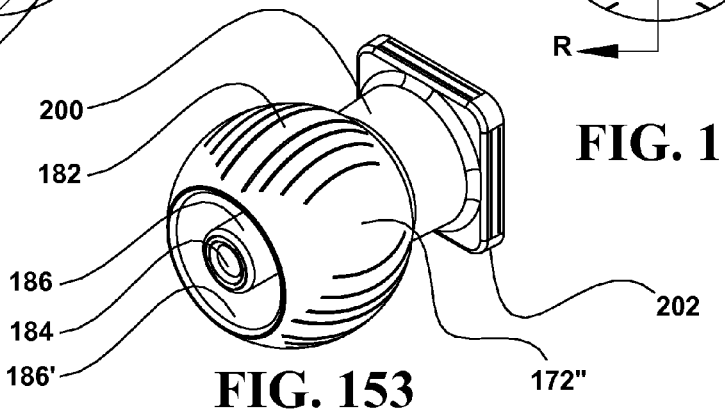
Figures 154, 155, 156:
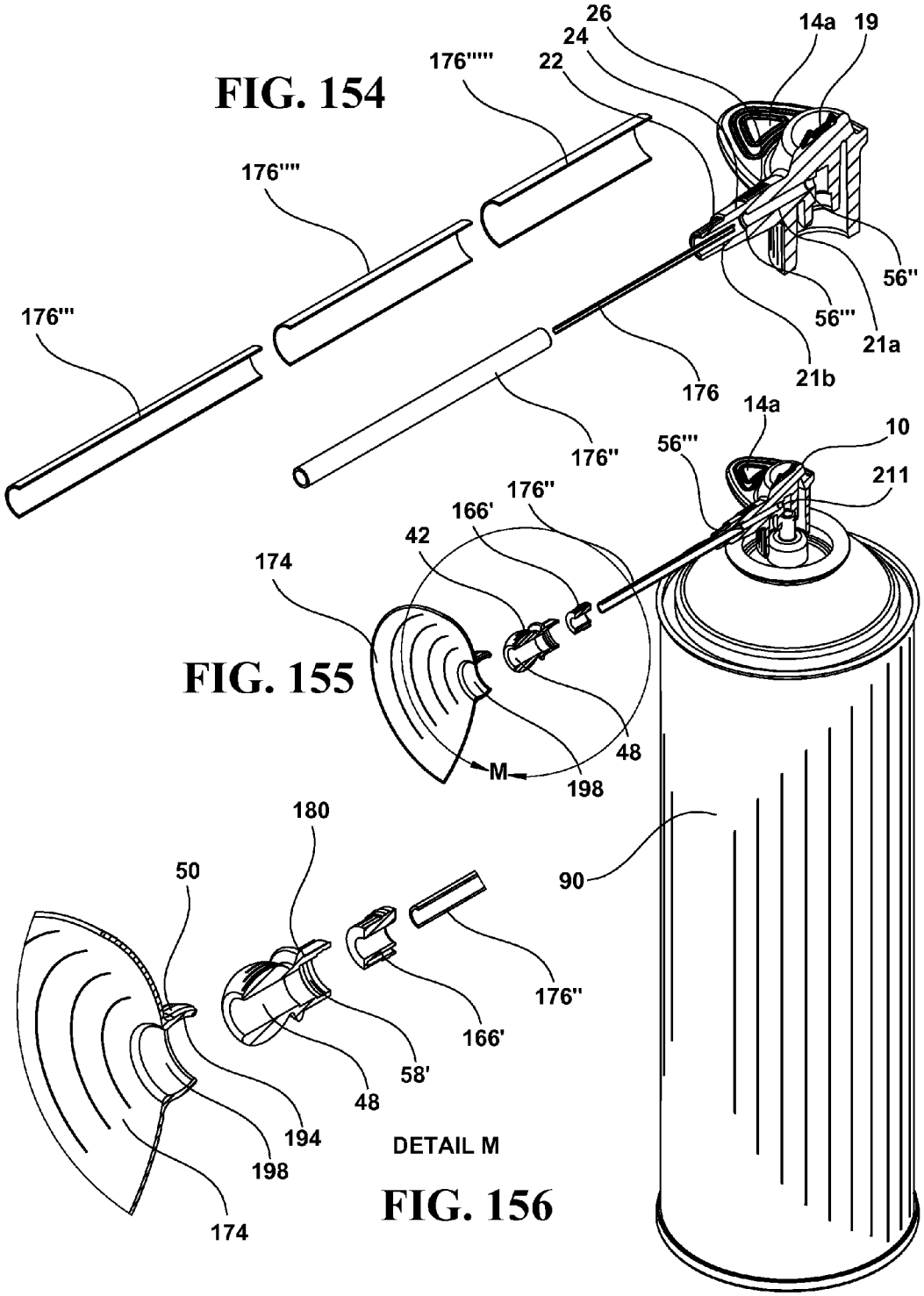
Figure 162:
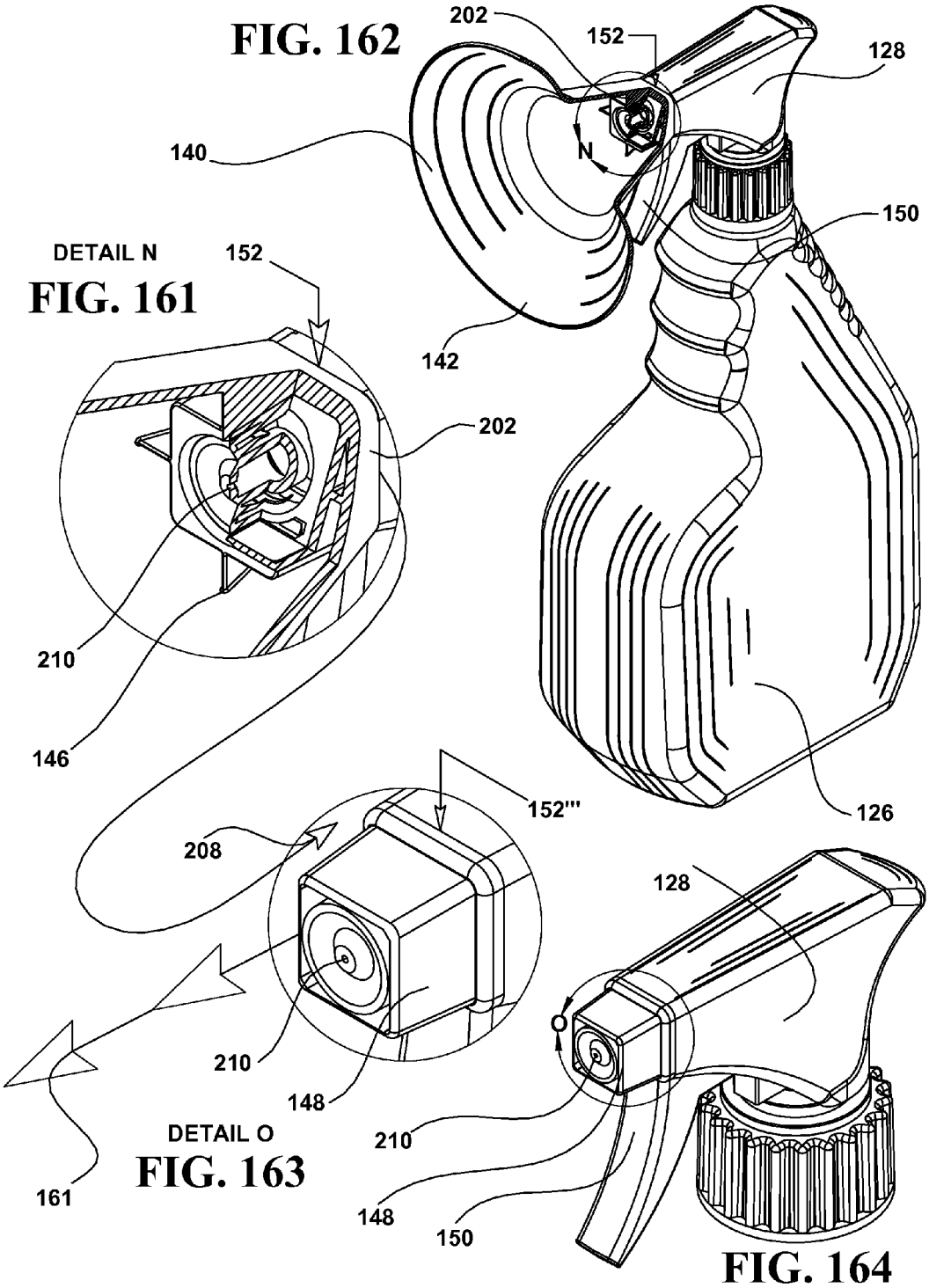

FIG. 119 is a perspective view of the cylindrical spray bottle having the spray system installed thereon, wherein the spray system includes the retrofit replacement nozzle member with the ball-shaped male portion and the circular spray deflector shield, according to an embodiment of the invention, wherein generally straight and bendable outlet tubular members of multiple inner or outer diameters are additionally shown;

FIG. 120 is a perspective view of a cylindrical spray bottle having a spray system installed thereon, wherein the spray system includes a retrofit replacement nozzle member with a ball-shaped male portion and an oval-shaped spray deflector shield, according to an embodiment of the invention;

FIG. 121 is a side view of a cylindrical spray bottle having a spray system installed thereon, wherein the spray system includes a retrofit replacement nozzle member with a ball-shaped male portion and an oval-shaped spray deflector shield, according to an embodiment of the invention;

FIG. 122 is a front view of a cylindrical spray bottle having a spray system installed thereon, wherein the spray system includes a retrofit replacement nozzle member with a ball-shaped male portion and an oval-shaped spray deflector shield, according to an embodiment of the invention;

FIG. 123 is an enlarged, frontal view of the encircled portion of FIG. 122, which includes a portion of the oval-shaped spray deflector shield and the ball-shaped male portion of the deflector mounting member, according to an embodiment of the invention;

FIG. 124 is a rear view of the cylindrical spray bottle having the spray system installed thereon, wherein the spray system includes the retrofit replacement nozzle member with the ball-shaped male portion and the oval-shaped spray deflector shield, according to an embodiment of the invention;

FIG. 125 is an enlarged, side view of the encircled portion of FIG. 127, which includes a portion of the rectangular spray deflector shield, a retrofit replacement nozzle member with a ball-shaped male portion, and a portion of a spray trigger assembly, according to an embodiment of the invention;

FIG. 126 is a perspective view of a cylindrical spray bottle having a spray system installed thereon, wherein the spray system includes a retrofit replacement nozzle member with a ball-shaped male portion and a rectangular spray deflector shield, according to an embodiment of the invention;

FIG. 127 is a side view of the cylindrical spray bottle having the spray system installed thereon, wherein the spray system includes the retrofit replacement nozzle member with the ball-shaped male portion and the rectangular spray deflector shield, according to an embodiment of the invention;

FIG. 128 is an enlarged, partial sectional perspective view of one encircled portion of FIG. 129 (Detail I), which includes a portion of the circular spray deflector shield and a retrofit replacement nozzle member with a ball-shaped male portion with multiple adaptive orifices and boss, according to an embodiment of the invention;

FIG. 129 illustrates partial sectional perspective views of rectangular and oval-shaped slip-on spray deflector shields, and a partial sectional perspective view of circular slip-on spray deflector shield attached to a cylindrical outlet boss of a retrofit replacement nozzle member with a ball-shaped portion, according to embodiments of the invention;

FIG. 130 is an enlarged, partial sectional perspective view of another encircled portion of FIG. 129 (Detail J), which includes a collar portion of the oval-shaped spray deflector shield, according to an embodiment of the invention;

FIG. 131A is an exploded perspective view of the circular spray deflector shield, the deflector mounting member with the ball-shaped male portion, and the nozzle member fitted to a cylindrical spray bottle, according to an embodiment of the invention;

FIG. 131B is an enlarged, partial perspective view of the encircled portion of FIG. 131A, which includes a portion of the circular spray deflector shield and the ball-shaped male portion of the deflector mounting member, according to an embodiment of the invention;

FIG. 132 illustrates side views and sectional sides of various nozzle adapters and replacement nozzles, and additionally illustrates a side view of the circular spray deflector shield, according to embodiments of the invention;

FIG. 133 illustrates perspectives views and sectional perspective sides of various nozzle adapters and replacement nozzles, and additionally illustrates a perspective view of the circular spray deflector shield, according to embodiments of the invention;

FIG. 134 illustrates perspective views and sectional perspective sides of various nozzle adapters and replacement nozzles, perspective views of two circular spray deflector shields, and a perspective view of a cylindrical spray bottle with a nozzle member and generally straight tubular member installed thereon, according to embodiments of the invention;

FIG. 135 illustrates perspective views of spray deflector shields having various geometries, and additionally illustrates a perspective view of a cylindrical spray bottle with a retrofit replacement nozzle member having a ball-shaped male portion installed thereon, according to embodiments of the invention;

FIG. 136 illustrates left side views of various nozzle adapters and replacement nozzles, left side views of two circular spray deflector shields, and a left side view of the cylindrical spray bottle with the nozzle member and generally straight tubular member installed thereon, according to embodiments of the invention;

FIG. 137 illustrates left side views of spray deflector shields having various geometries, and additionally illustrates a left side view of a cylindrical spray bottle with the retrofit replacement nozzle member having the ball-shaped male portion installed thereon, according to embodiments of the invention;

FIG. 138 is a partially exploded perspective view of a flat-body spray bottle having a retrofit replacement nozzle member with a tubular boss, an adapter mini-insert, and a deflector mounting member with a ball-shaped male portion, according to an embodiment of the invention;

FIG. 139 is an assembled right side view of the retrofit replacement nozzle member with the tubular boss, the adapter mini-insert, the deflector mounting member with the ball-shaped male portion, and a circular spray deflector shield, according to an embodiment of the invention;

FIG. 140 illustrates perspective views of spray deflector shields having various geometries, and additionally illustrates a perspective view of a flat-body spray bottle with a retrofit replacement nozzle member with a tubular boss, an adapter mini-insert, and a deflector mounting member with a ball-shaped male portion, according to embodiments of the invention;

FIG. 141 illustrates left side views of spray deflector shields having various geometries, and additionally illustrates a left side view of a flat-body spray bottle with a retrofit replacement nozzle member with a tubular boss, an adapter mini-insert, and a deflector mounting member with a ball-shaped male portion, according to embodiments of the invention;

FIG. 142 is a perspective view of a flat-body spray bottle having a spray system installed thereon, wherein the spray system includes a retrofit replacement nozzle member with a ball-shaped male portion and a circular spray deflector shield, according to an embodiment of the invention;

FIG. 143 is a right side view of the flat-body spray bottle having the spray system installed thereon, wherein the spray system includes the retrofit replacement nozzle member with the ball-shaped male portion and the circular spray deflector shield, according to an embodiment of the invention;

FIG. 144 is an enlarged, partial side view of the encircled portion of FIG. 143, which includes a portion of the circular spray deflector shield, the retrofit replacement nozzle member, and a portion of a spray trigger assembly, according to an embodiment of the invention;

FIG. 145 is a perspective view of the flat-body spray bottle having the spray system installed thereon, wherein the spray system includes the retrofit replacement nozzle member with the ball-shaped male portion and the circular spray deflector shield angled in an upward position, according to an embodiment of the invention;

FIG. 146 is a side view of the flat-body spray bottle having the spray system installed thereon, wherein the spray system includes the retrofit replacement nozzle member with the ball-shaped male portion and the circular spray deflector shield angled in an upward position, according to an embodiment of the invention;

FIG. 147 is a perspective view of a cylindrical spray bottle having a spray system installed thereon, wherein the spray system includes a retrofit replacement nozzle member with a ball-shaped male portion and a circular spray deflector shield that is shown partially cutaway, according to an embodiment of the invention;

FIG. 148 is a side sectional view of a retrofit replacement nozzle member with a ball-shaped male portion and a wide mouth bore, according to an embodiment of the invention, which is cut along the cutting-plane line Q-Q in FIG. 149;

FIG. 149 is a front view of the retrofit replacement nozzle member with the ball-shaped male portion and the wide mouth bore, according to an embodiment of the invention;

FIG. 150 is a perspective view of the retrofit replacement nozzle member with the ball-shaped male portion and the wide mouth bore, according to an embodiment of the invention;

FIG. 151 is a side sectional view of a retrofit replacement nozzle member with a ball-shaped male portion and a cylindrical outlet boss and inner orifice bosses, according to an embodiment of the invention, which is cut along the cutting-plane line R-R in FIG. 152;

FIG. 152 is a front view of the retrofit replacement nozzle member with the ball-shaped male portion and the cylindrical outlet boss and inner orifice bosses, according to an embodiment of the invention;

FIG. 153 is a perspective view of the retrofit replacement nozzle member with the ball-shaped male portion and the cylindrical outlet boss and inner orifice bosses, according to an embodiment of the invention;

FIG. 154 is a sectional perspective view of a nozzle member and a plurality of outlet tubular members of varying diameters and lengths, according to embodiments of the invention;

FIG. 155 is an exploded sectional perspective view of a circular spray deflector shield, a deflector mounting member with the ball-shaped male portion, an adapter cored-insert, a generally straight tubular member, and a nozzle member fitted to an aerosol can, according to an embodiment of the invention;

FIG. 156 is an enlarged, partial sectional perspective view of the encircled portion of FIG. 155, which includes a portion of the circular spray deflector shield, the deflector mounting member with the ball-shaped male portion, the adapter cored-insert, and the generally straight tubular member, according to an embodiment of the invention;

FIG. 157 illustrates sectional side views of a first exemplary circular spray deflector shield, a retrofit replacement nozzle member with a ball-shaped male portion and a wide mouth bore, and a deflector slip-on mounting member, and additionally illustrates a partial rear view of the first exemplary circular spray deflector shield, according to an embodiment of the invention;

FIG. 158 is a perspective view of a first exemplary deflector mounting member with a ball-shaped male portion, according to an embodiment of the invention;

FIG. 159 illustrates sectional side views of a second exemplary circular spray deflector shield, a deflector mounting member with a ball-shaped male portion, and an adapter mini-insert, and additionally illustrates a partial rear view of the second exemplary circular spray deflector shield, according to an embodiment of the invention;

FIG. 160 is a perspective view of a second exemplary deflector mounting member with a ball-shaped male portion, according to an embodiment of the invention;

FIG. 161 is an enlarged, cutaway perspective view of the encircled portion of FIG. 162, which includes a portion of the trumpet-style spray deflector shield and the molded-in nozzle member, wherein the spray deflector shield the nozzle member are shown partially cutaway to more clearly illustrate the internal features of the nozzle member, according to an embodiment of the invention;

FIG. 162 is a perspective view of a flat-body spray bottle having a molded-in retrofit replacement nozzle member and trumpet-style spray deflector shield installed thereon, wherein the spray deflector shield the nozzle member are shown partially cutaway to more clearly illustrate the internal features of the nozzle member, according to an embodiment of the invention;

FIG. 163 is an enlarged perspective view of the encircled portion of FIG. 164, wherein the features of the nozzle are illustrated; and FIG. 164 is a perspective view of a top portion of a spray trigger assembly.

Throughout the figures, the same parts are always denoted using the same reference characters so that, as a general rule, they will only be described once.

DETAILED DESCRIPTION OF THE PREFERRED EMBODIMENTS OF THE INVENTION

Figure 1:
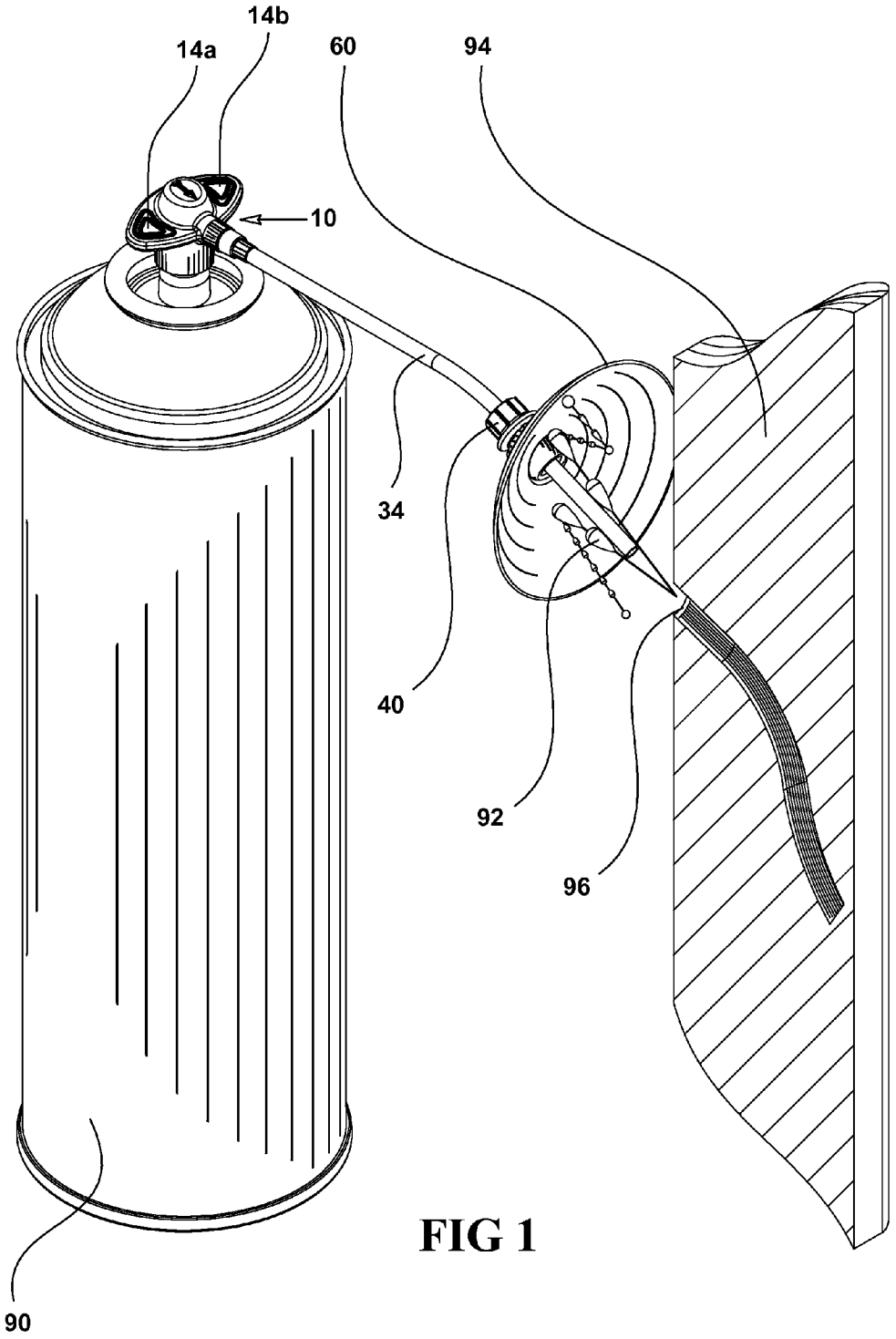
FIG. 1 is a perspective view of an aerosol can having a spray system installed thereon, wherein spray is being delivered to a wooden beam, according to an embodiment of the invention.
Figure 2:
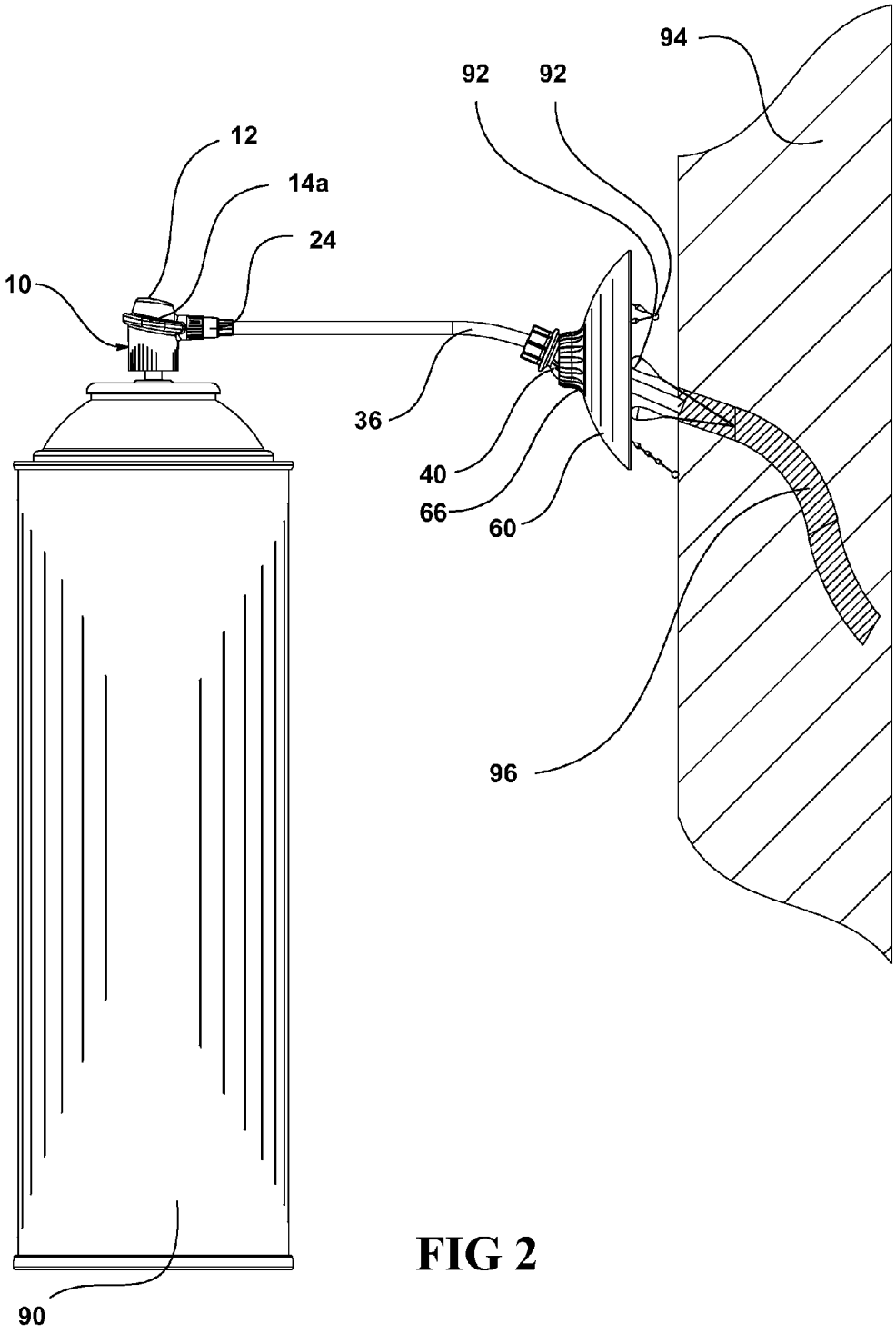
FIG. 2 is a side view of the aerosol can having the spray system installed thereon, wherein spray is being delivered to a wooden beam, according to an embodiment of the invention.

Initially, with reference to FIGS. 1 and 2, a spray system, which includes a spray deflector shield (i.e., spray deflector member 60), is shown deflecting away spray 92 that has reflected back from a curved passageway 96 in a wooden beam 94, according to an embodiment of the invention. As shown in FIGS. 1 and 2, the curved passageway 96 is illustrative of an exemplary hole pattern demonstrating a cavity, or hard to reach area, where "blow-backs" would be a considerable danger to the user or operator. In this example, because the curved passageway 96 is not easily accessible, a flexible tube is inserted into the hole cavity. This configuration would very likely cause a chemical or liquid to blowback out of the hole and spray towards the user or operator. Also, in FIGS. 1 and 2, the deflection shield 60 is shown rotated at an angle to give maximum coverage to the hole or affected area of treatment being applied.

Figure 3:
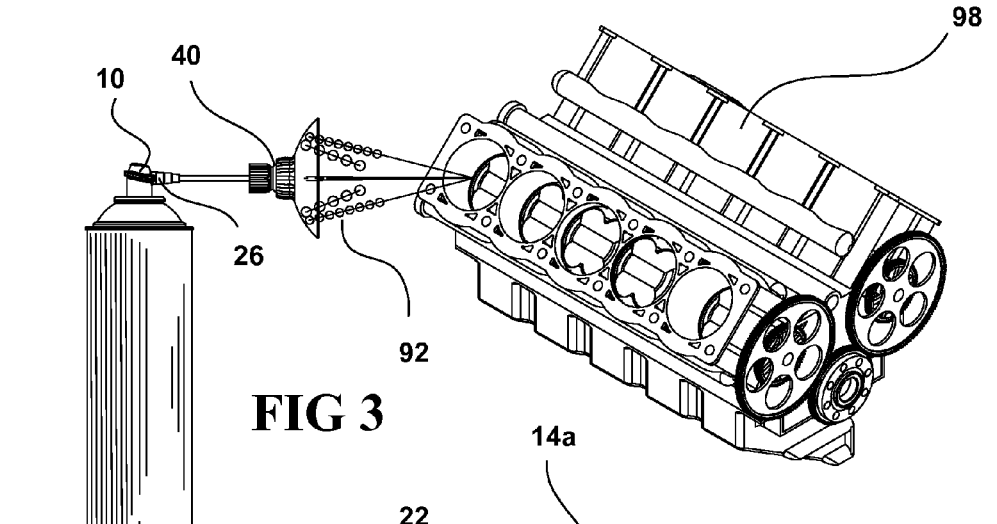
FIG. 3 is a perspective view of an aerosol can having a spray system installed thereon, wherein spray is being delivered to an engine, according to an embodiment of the invention.
Figure 4:
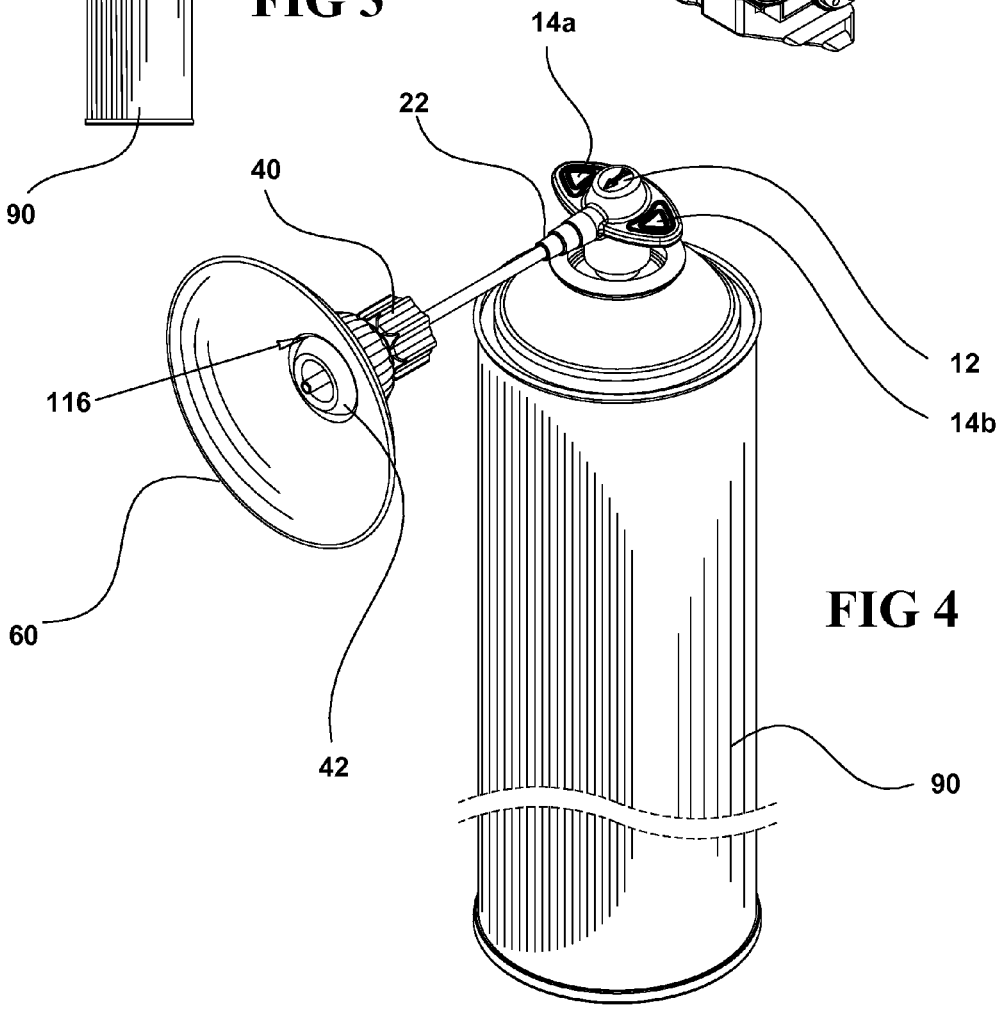
FIG. 4 is a perspective view of an aerosol can having a spray system installed thereon, according to an embodiment of the invention.
Figure 5:
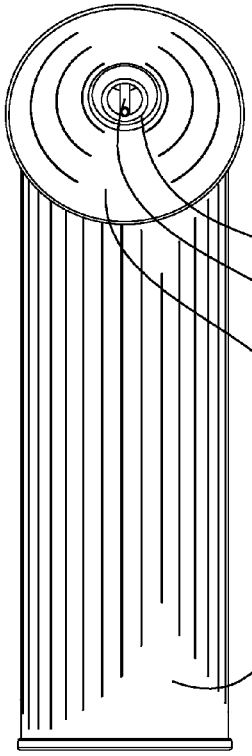
FIG. 5 is a frontal view of an aerosol can having a spray system installed thereon, wherein a nozzle member is coupled to a spray deflector member using a curved tubular member, according to an embodiment of the invention.
Figure 6:
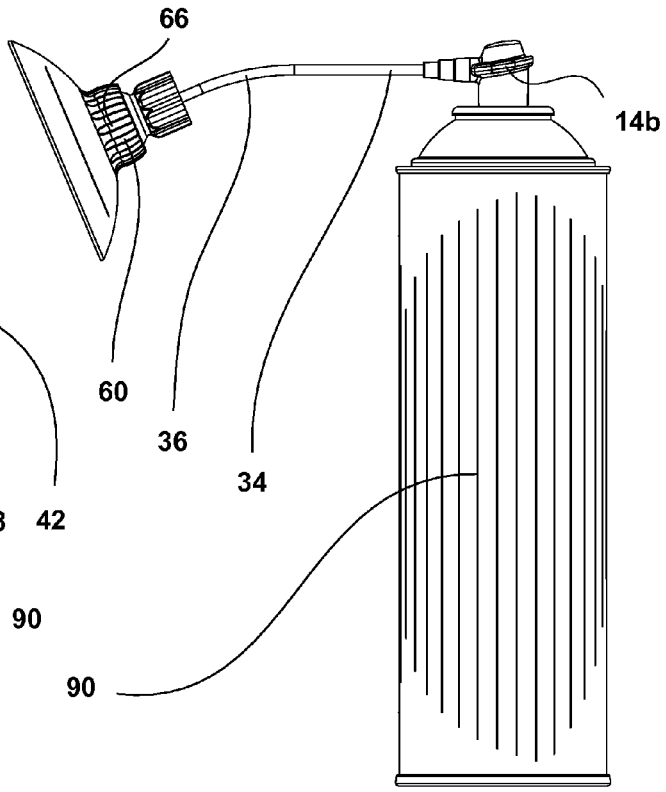
FIG. 6 is a side view of the aerosol can having the spray system installed thereon, wherein the nozzle member is coupled to the spray deflector member using the curved tubular member, according to an embodiment of the invention.
Figure 7:
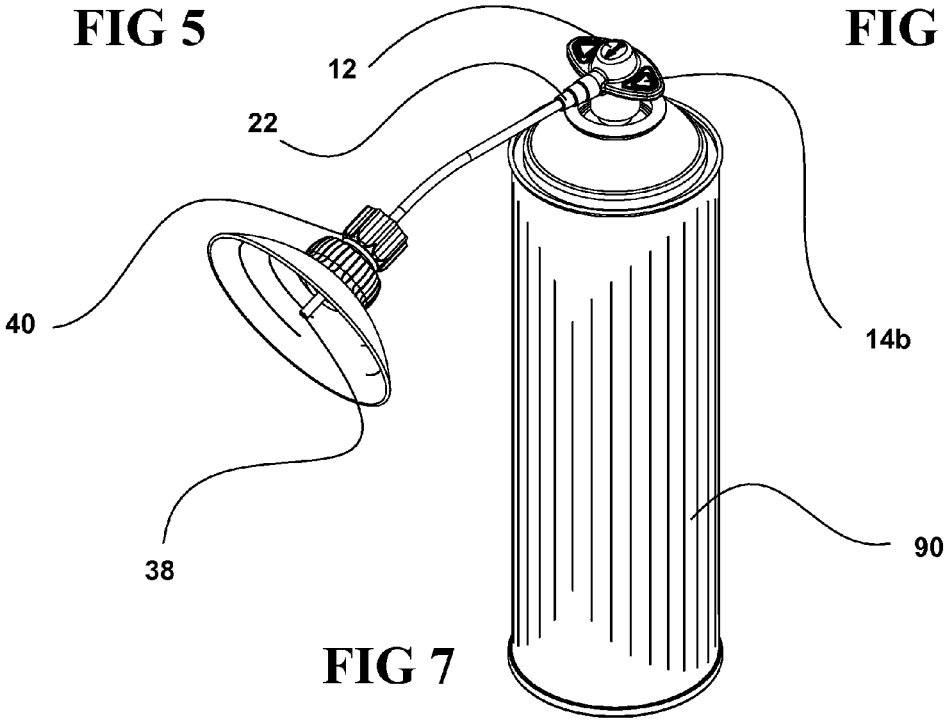
FIG. 7 is a perspective view of the aerosol can having the spray system installed thereon, wherein the nozzle member is coupled to the spray deflector member using the curved tubular member, according to an embodiment of the invention.
Figure 8:
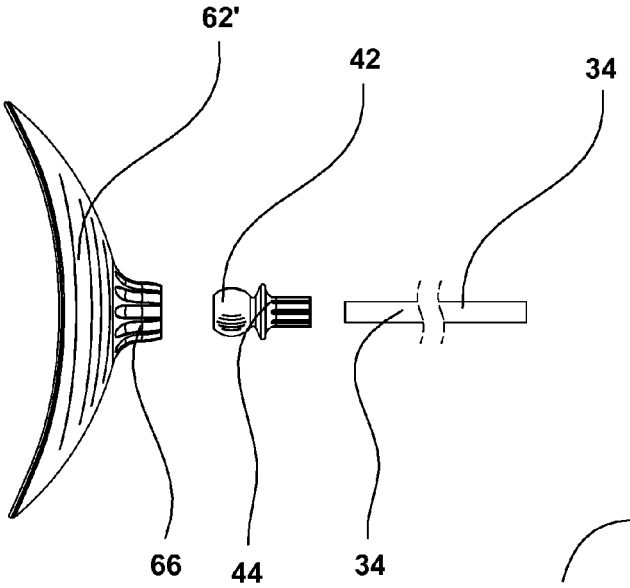
FIG. 8 is an exploded right side view of an oval-shaped spray deflector shield, a deflector mounting member with a ball-shaped male portion, and a generally straight tubular member, according to an embodiment of the invention.
Figure 9:
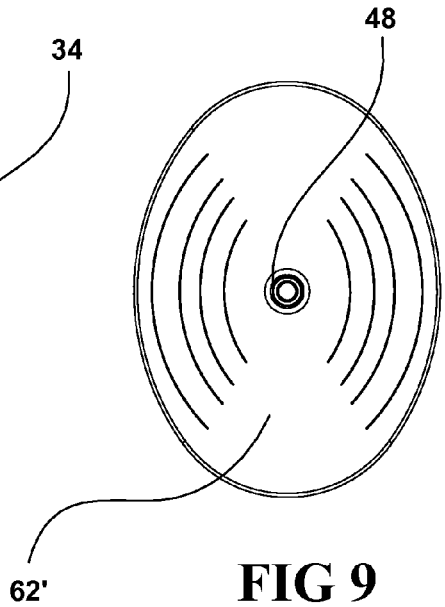
FIG. 9 is a front view of the oval-shaped spray deflector shield, the deflector mounting member with the ball-shaped male portion, and the generally straight tubular member, according to an embodiment of the invention.

Referring now to FIG. 3, a spray system, which includes a spray deflector shield (i.e., spray deflector member 60), is shown deflecting away spray 92 that has reflected back from an engine 98 in this example, according to an embodiment of the invention. Without the shield 60, the spray 92 reflected back from the engine 98 would hit the person's hand and forearm, and maybe his face. If the person is spraying a fluid that includes chemicals harmful to his skin, eyes, mouth and/or clothes, then these could be damaged by the spray 92 reflecting back from the engine 98. Here, in this case, the person is spraying a concentrated, powerful cleaner toward the engine 98 to clean a portion of the engine; however, the shield 60 may be used to protect one from any fluid sprayed from an aerosol spray can 90. For example, the shield 60 may be used to protect when spraying any surface whether oblique, slanted, flat, curved, corner surfaces, flat and multi-directional or protruding surfaces that may be sprayed against. Other examples of sprays that the shield 60 may be used to deflect include household and general purpose cleaners such as Lysol®, 409®, Clorox®, Tilex®. Lysol® advertises that Lysol® may be used on shower doors. tubs and glazed tiles, vanity tops, sinks and chrome fixtures, and cautions that the product may stain or discolor painted surfaces and harm humans and animals. Tilex® advertises that Tilex® may be used to remove mold and Mildew®, and works on grout, tubs, toilets, fiberglass, shower doors, vinyl curtains, sinks and tiles, and cautions against substantial but temporary eye injury, damage to clothes fabric, carpet or paper and harm to humans and animals. Clorox® cleaner with bleach advertises that it removes bathroom stains, removes other stains, disinfects and degreases stove tops, and it cautions against harm to humans and animals. 409 all purpose cleaner advertises the same uses and cautions against the same harm.

An embodiment of a spray system is illustrated in FIGS. 1-7. As shown in these figures, the spray system generally comprises a spray nozzle member 10, which is configured to be fluidly coupled to a fluid discharge passageway of a spray bottle 154 (FIG. 131A) or aerosol spray can 90, and a spray deflector member 60 operatively coupled to the nozzle member 10 by means of deflector inlet tubing 34 and a deflector mounting member 40. It can be seen that the spray deflector member 60 includes a concave deflector portion 62 and a collar portion 66, wherein the concave deflector portion 62 is configured to generally face a target 94, 98 to which a spray is being applied.

Figure 12:
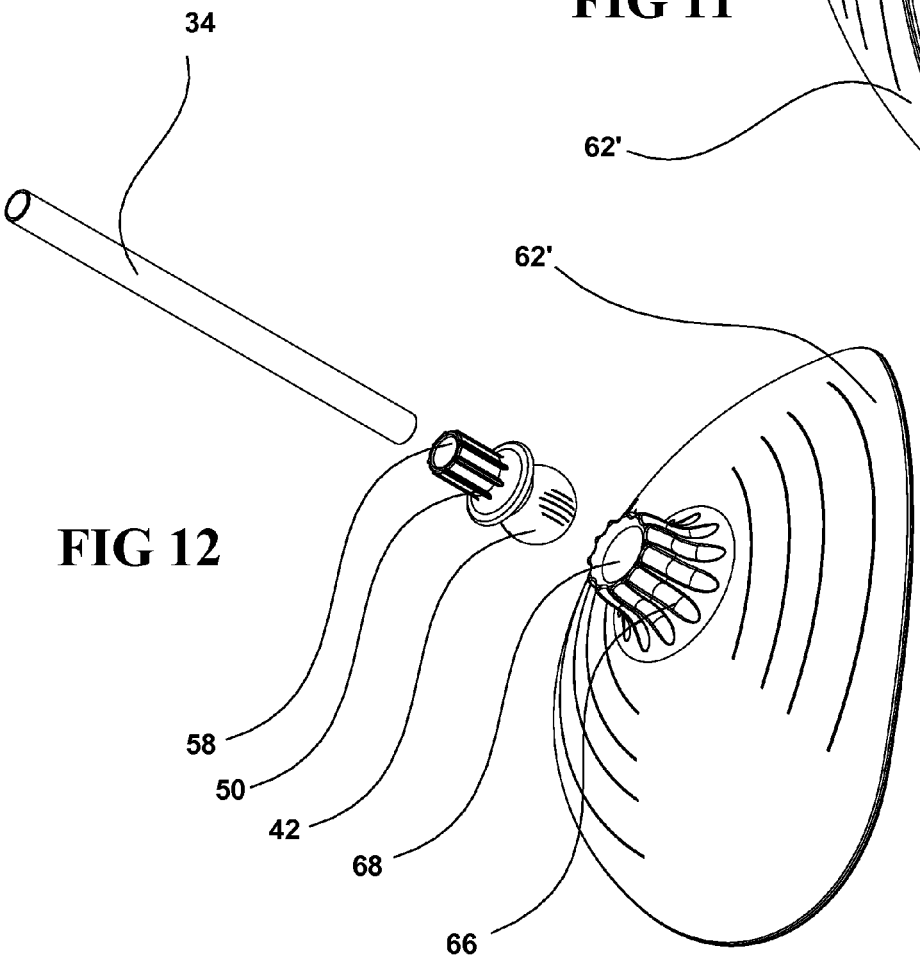
FIG. 12 is an exploded left-rear perspective view of the oval-shaped spray deflector shield, the deflector mounting member with the ball-shaped male portion, and the generally straight tubular member, according to an embodiment of the invention.

The illustrative spray system depicted in FIGS. 1-7 includes a spray shield device subassembly that is configured to deflect spray 92 that is reflected from a target 94, 98. The spray shield device subassembly comprises: (i) a deflector mounting member 40 configured to engage a tubular member (e.g., deflector inlet tubing 34 shown in FIG. 1) of a spray bottle 154 (FIG. 131A) or aerosol spray can 90, the deflector mounting member 40 including a male portion (i.e., ball portion 42 of deflector mounting member 40); and (ii) a spray deflector member 60 including a concave deflector portion 62 and a collar portion 64, the collar portion 64 comprising a female socket 68 (e.g., see FIGS. 12 and 29) for matingly engaging with the male portion 42 of the deflector mounting member 40, wherein the concave deflector portion 62 is configured to generally face a target 94, 98 to which a spray is being applied, in order to capture the "blowback" spray deflected off such surface(s), and re-direct such spray from a person's body, face, mouth or eyes.

Figure 10A:
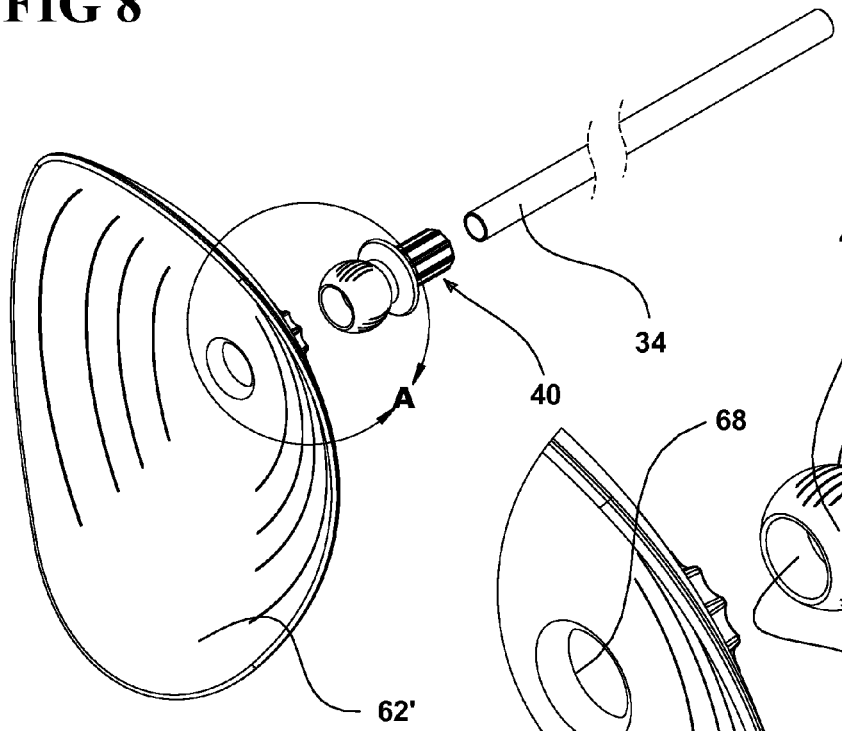
FIG. 10A is an exploded front-right perspective view of the oval-shaped spray deflector shield, the deflector mounting member with the ball-shaped male portion, and the generally straight tubular member, according to an embodiment of the invention.
Figure 10B:
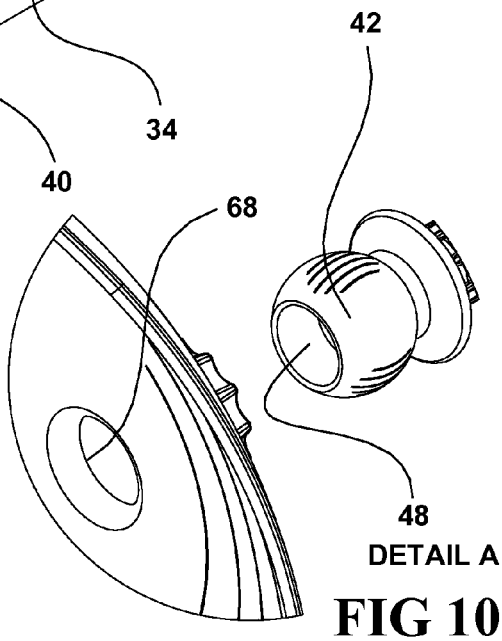
FIG. 10B is an enlarged, exploded perspective view of the encircled portion of FIG. 10A, which includes a portion of the oval-shaped spray deflector shield and a portion of the deflector mounting member, according to an embodiment of the invention.
Figure 11:
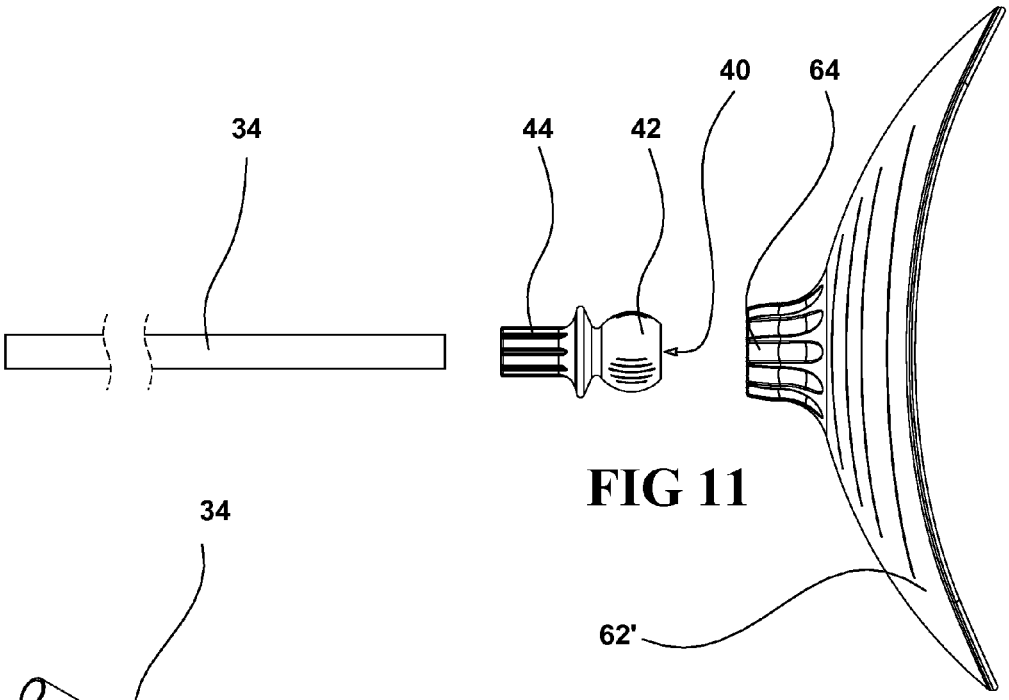
FIG. 11 is an exploded left side view of the oval-shaped spray deflector shield, the deflector mounting member with the ball-shaped male portion, and the generally straight tubular member, according to an embodiment of the invention.
Figure 42:
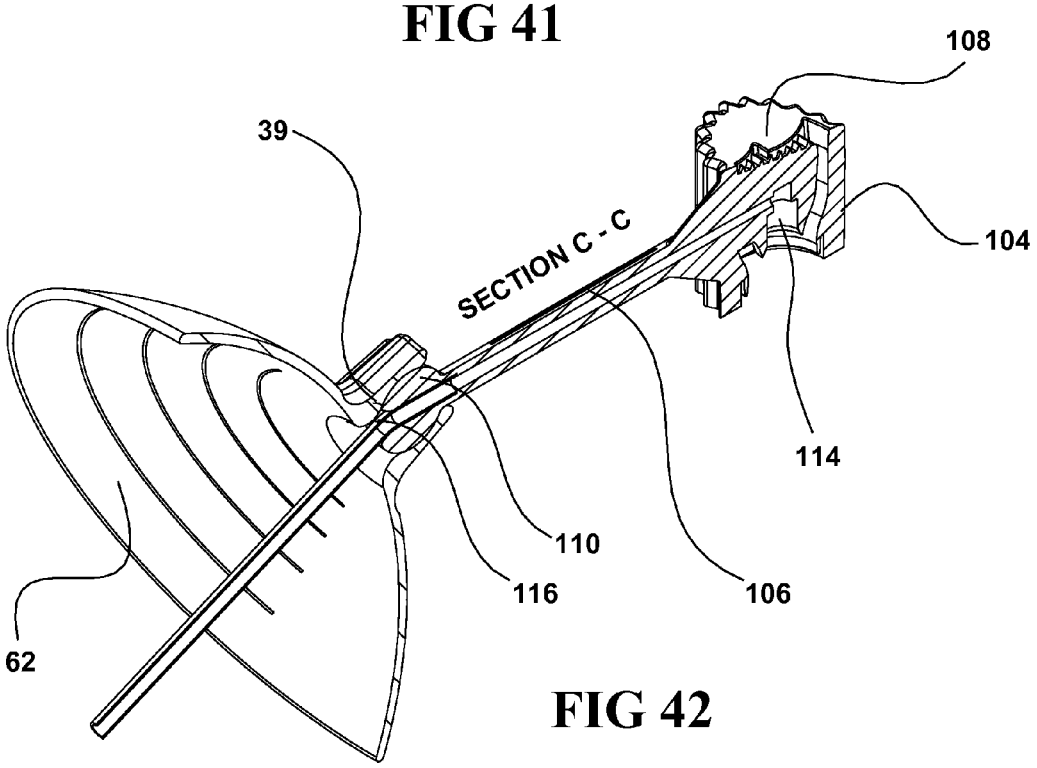
FIG. 42 is a sectional perspective view of the circular spray deflector shield assembled on the one-piece nozzle with a curved tubular member installed, and deflector mounting member, according to an embodiment of the invention, wherein the circular spray deflector shield is rotated in an angled position, and wherein the section is cut along the cutting-plane line C-C in FIG. 41.
Figure 43:
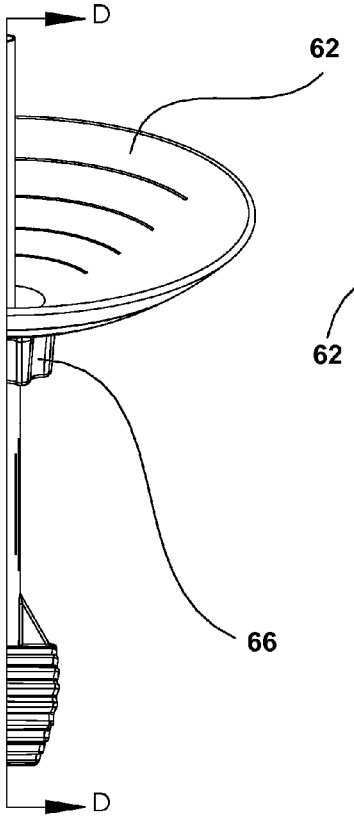
FIG. 43 is a partial side view of a circular spray deflector shield assembled on a one-piece nozzle with a curved tubular member installed, and deflector mounting member, according to an embodiment of the invention, wherein the circular spray deflector shield is rotated in an angled position.
Figure 44:
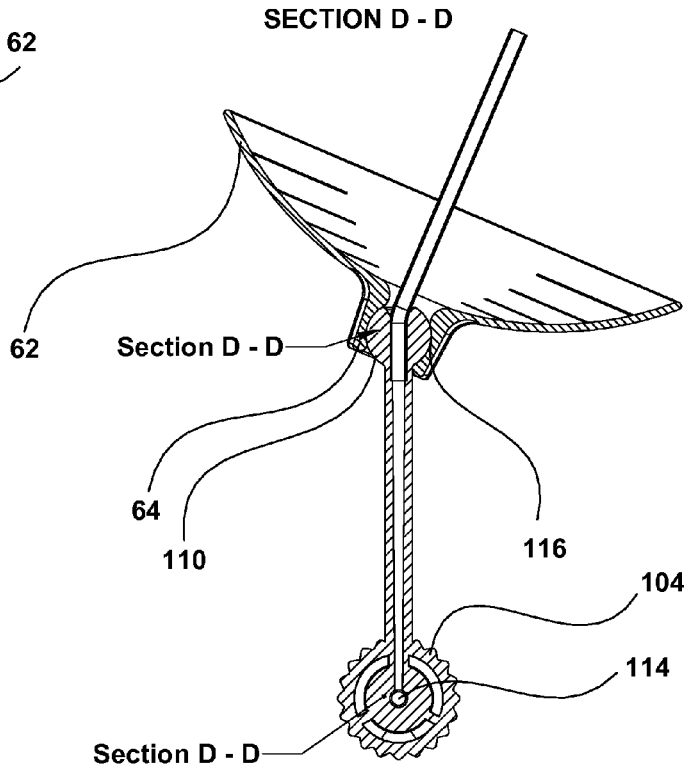
FIG. 44 is a sectional top view of the circular spray deflector shield assembled on the one-piece nozzle with a curved tubular member installed, and deflector mounting member, according to an embodiment of the invention, wherein the circular spray deflector shield is rotated in an angled position, and wherein the section is cut along the cutting-plane line D-D in FIG. 43.
Figure 45:
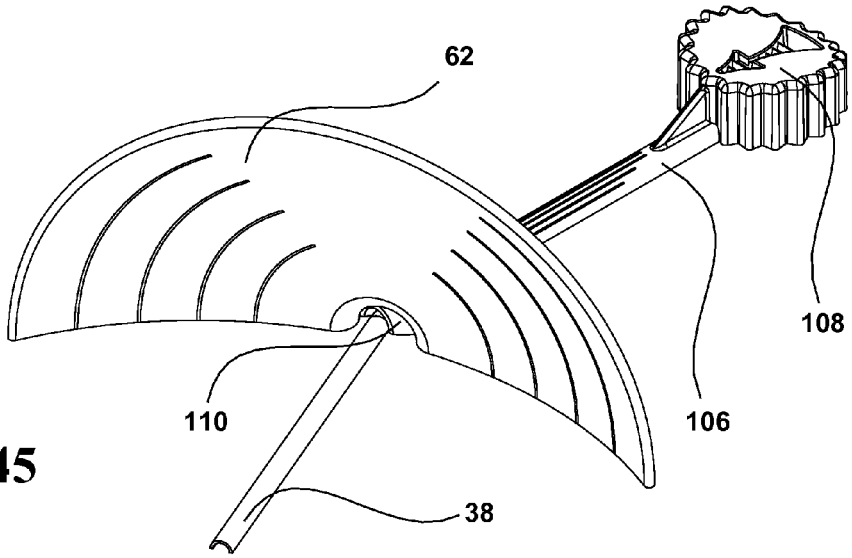
FIG. 45 is a cutaway perspective view of the circular spray deflector shield assembled on the one-piece nozzle with a curved tubular member installed, and deflector mounting member, according to an embodiment of the invention, wherein the circular spray deflector shield is rotated in an angled position.
Figure 46:
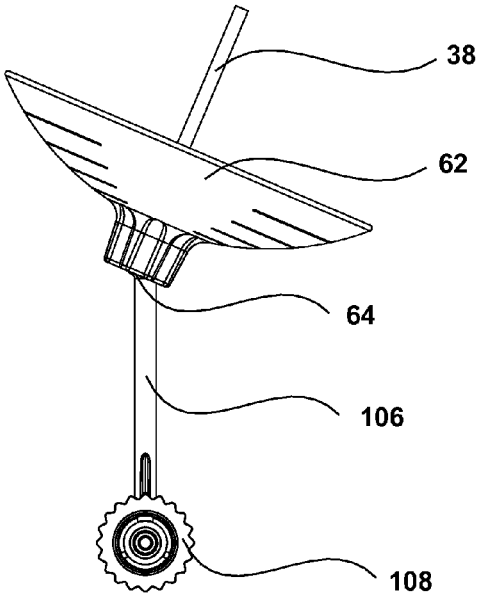
FIG. 46 is a bottom view of the circular spray deflector shield assembled on the one-piece nozzle with a curved tubular member installed, and deflector mounting member, according to an embodiment of the invention, wherein the circular spray deflector shield is rotated in an angled position.
Figure 47:
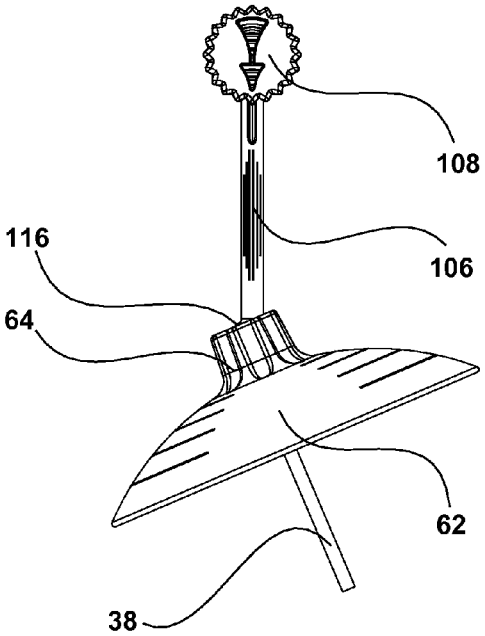
FIG. 47 is a top view of the circular spray deflector shield assembled on the one-piece nozzle with a curved tubular member installed, and deflector mounting member, according to an embodiment of the invention, wherein the circular spray deflector shield is rotated in an angled position.
Figure 48:
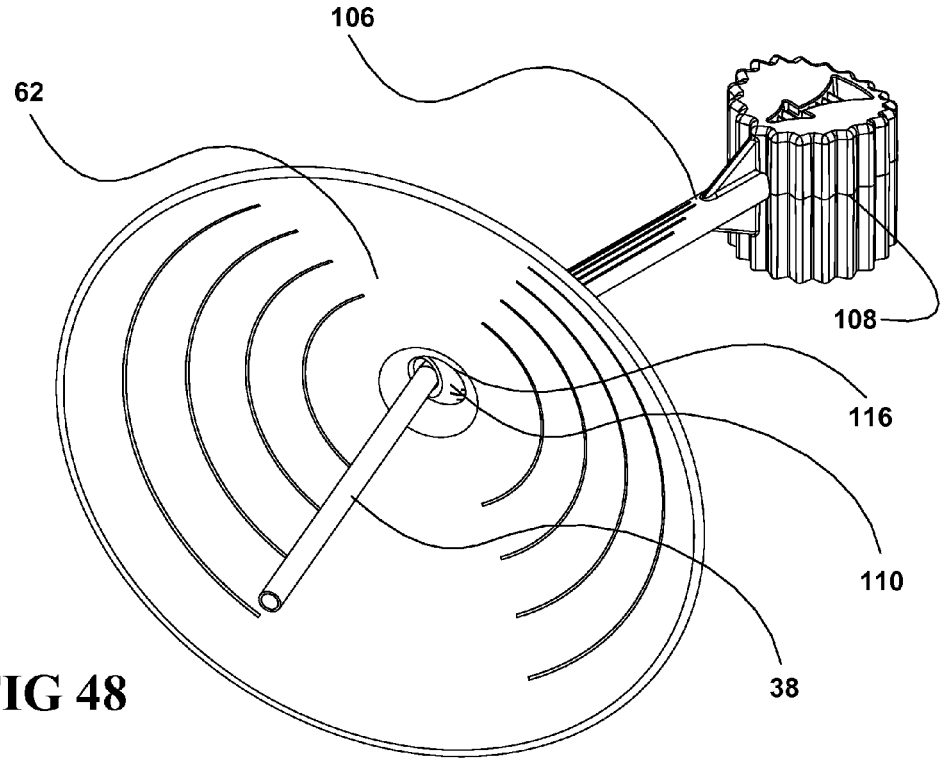
FIG. 48 is a perspective view of the circular spray deflector shield assembled on the one-piece nozzle with a curved tubular member installed, and deflector mounting member, according to an embodiment of the invention, wherein the circular spray deflector shield is rotated in an angled position.
Figure 49:
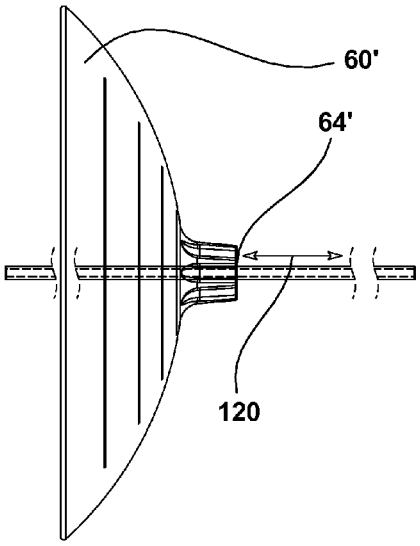
FIG. 49 is a right side view of a non-swivel, circular spray deflector shield slidably disposed on a generally straight tubular member, according to an embodiment of the invention.

As depicted in FIGS. 1-7, the spray system further includes a tubular member (i.e., deflector inlet tubing 34) disposed between the nozzle member 10 and the spray deflector member 60, the tubular member 34 coupled to an outlet of the nozzle member 10, and coupled to a collar portion 64 of the spray deflector member 60 by means of the deflector mounting member 40, wherein the deflector mounting member 40 includes a male portion 42 for matingly engaging with a female socket 68 provided in the collar portion 64 of the spray deflector member 60 (see e.g., FIGS. 10B and 11). As particularly shown in FIG. 2, one or more elbow sections 36 of deflector inlet tubing may be provided in conjunction with the spray system described herein in order to better accommodate hard-to-reach areas that require spraying. Also, referring to FIG. 7, deflector outlet tubing sections 38, which are provided downstream of the spray deflector member 60, may also be provided in conjunction with the spray system so that the use of the spray deflector member 60 does not interfere the required application of the spray. Similar to the inlet deflector tubing, the outlet deflector tubing may also utilize one or more elbows or curvature feature sections 39 (see e.g., FIG. 42) to facilitate the application of the spray at a particular location. The assembly direction of components forming various embodiments of the spray system is diagrammatically represented by the arrow 122 in FIGS. 71, 98, 101, and 131A.

Figure 28:
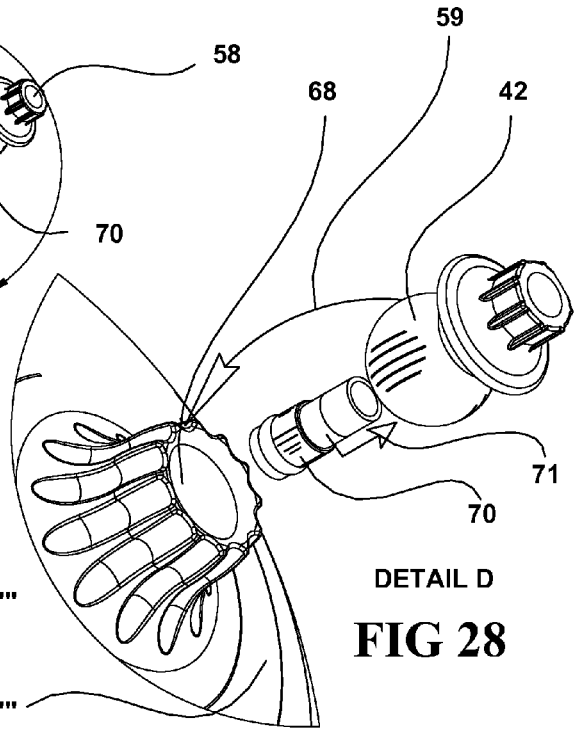
FIG. 28 is an enlarged, partial rear perspective view of the encircled portion of FIG. 27, which includes a portion of the rectangular spray deflector shield with side walls, the deflector mounting member with the ball-shaped male portion, and the adapter mini-insert, according to an embodiment of the invention.
Figure 32:
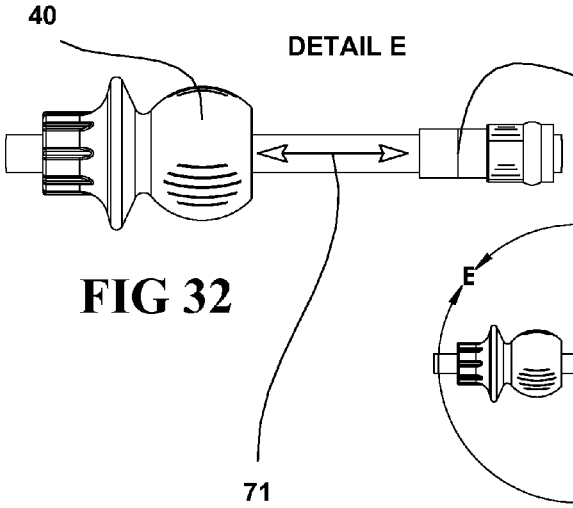
FIG. 32 is an enlarged, partial exploded side view of the encircled portion of FIG. 33, which includes the deflector mounting member with the ball-shaped male portion, the adapter mini-insert, and the generally straight tubular member, according to an embodiment of the invention, wherein the adapter mini-insert is spaced apart from the deflector mounting member along the length of the generally straight tubular member and its directional movement is indicated.
Figure 33:
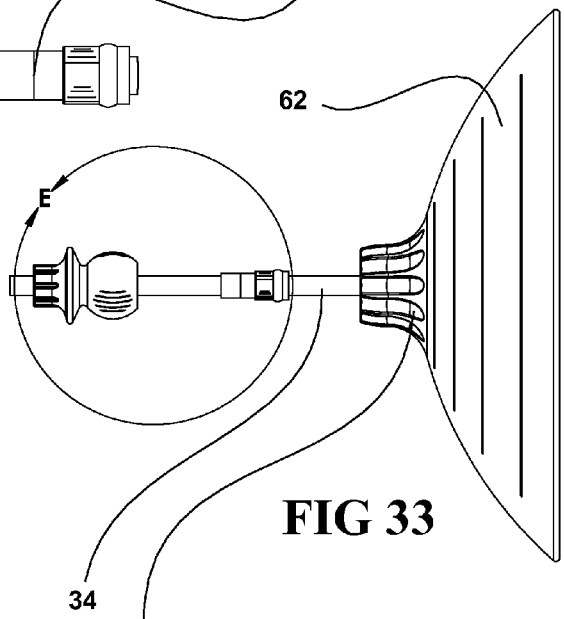
FIG. 33 is a partially exploded left side view of a circular spray deflector shield, the deflector mounting member with the ball-shaped male portion, the adapter mini-insert, and the generally straight tubular member, according to an embodiment of the invention, wherein the adapter mini-insert is spaced apart from the deflector mounting member along the length of the generally straight tubular member and its directional movement is indicated.
Figure 34:
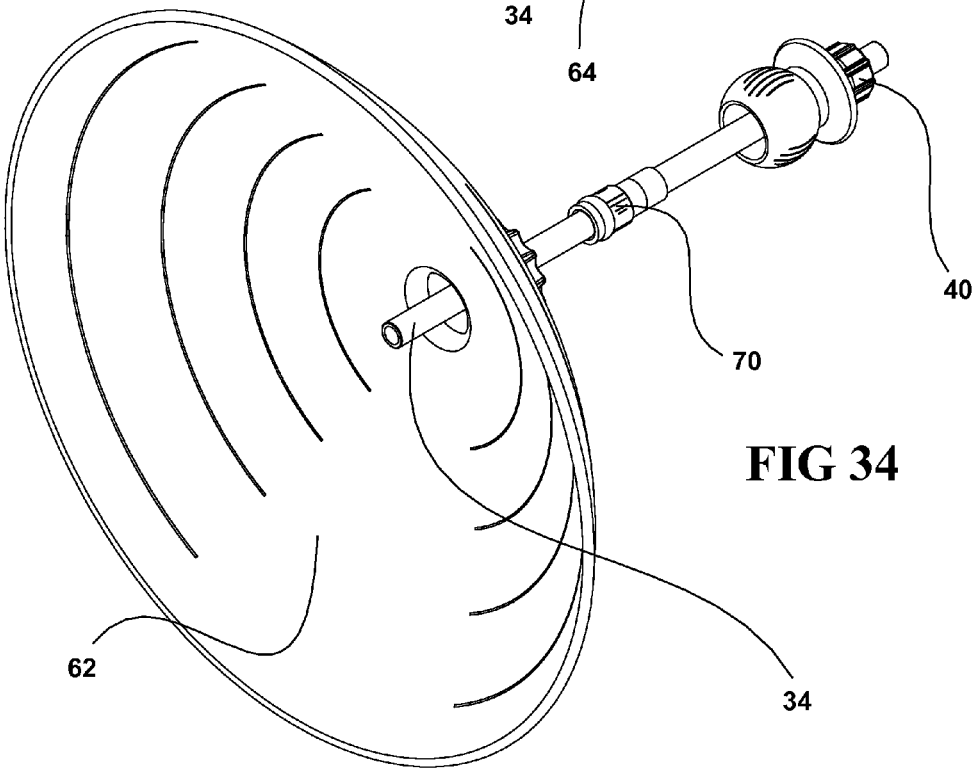
FIG. 34 is a partially exploded perspective view of the circular spray deflector shield, the deflector mounting member with the ball-shaped male portion, the adapter mini-insert, and the generally straight tubular member, according to an embodiment of the invention, wherein the adapter mini-insert is spaced apart from the deflector mounting member along the length of the generally straight tubular member.
Figure 35:
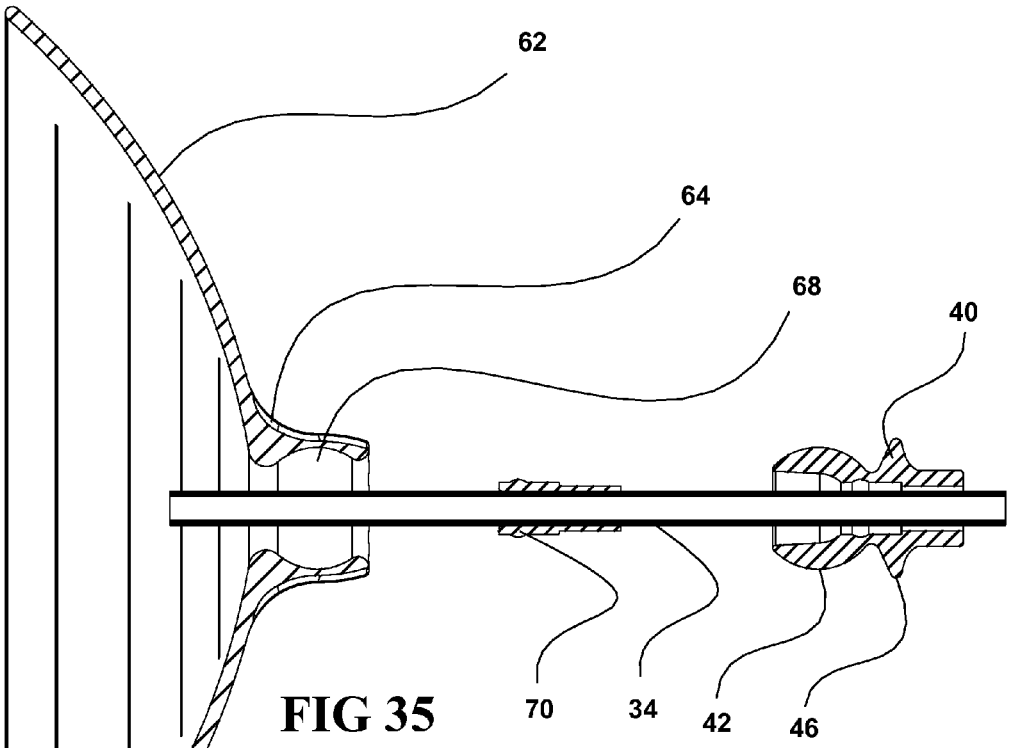
FIG. 35 is a partially exploded right side sectional view of the circular spray deflector shield, the deflector mounting member with the ball-shaped male portion, the adapter mini-insert, and the generally straight tubular member, according to an embodiment of the invention, wherein the adapter mini-insert is spaced apart from the deflector mounting member along the length of the generally straight tubular member.
Figure 36:
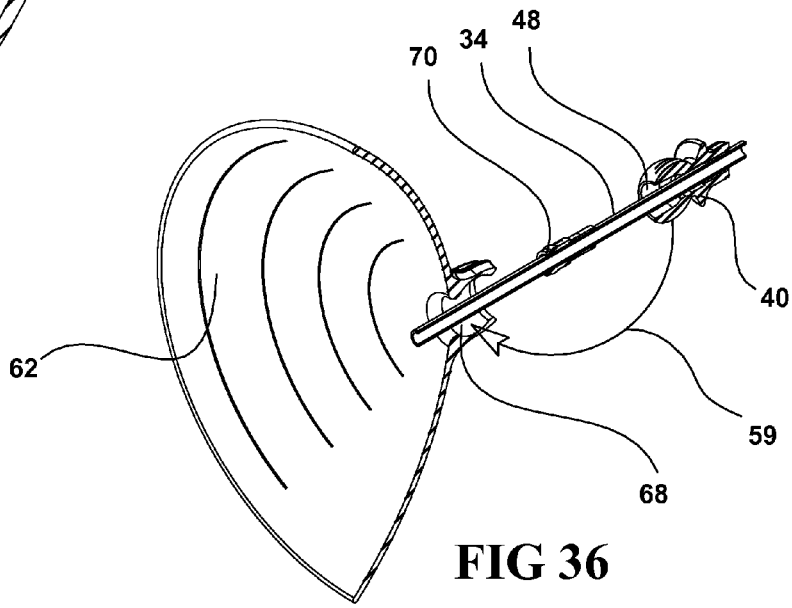
FIG. 36 is a partially exploded right side sectional view of the circular spray deflector shield, the deflector mounting member with the ball-shaped male portion, the adapter mini-insert, and the generally straight tubular member, according to an embodiment of the invention, wherein the adapter mini-insert is spaced apart from the deflector mounting member along the length of the generally straight tubular member.
Figure 37:
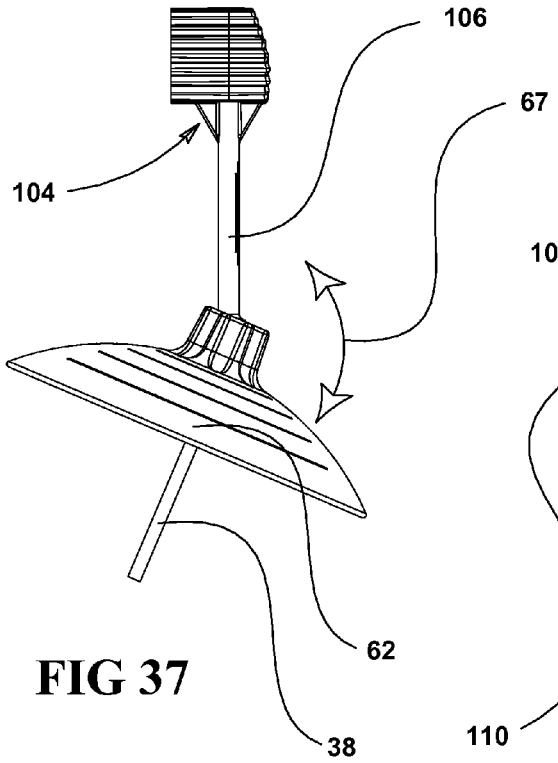
FIG. 37 is a right side view of a circular spray deflector shield assembled on a one-piece nozzle with a curved tubular member installed, and deflector mounting member, according to an embodiment of the invention, wherein the circular spray deflector shield is rotated in an angled position.
Figure 38:
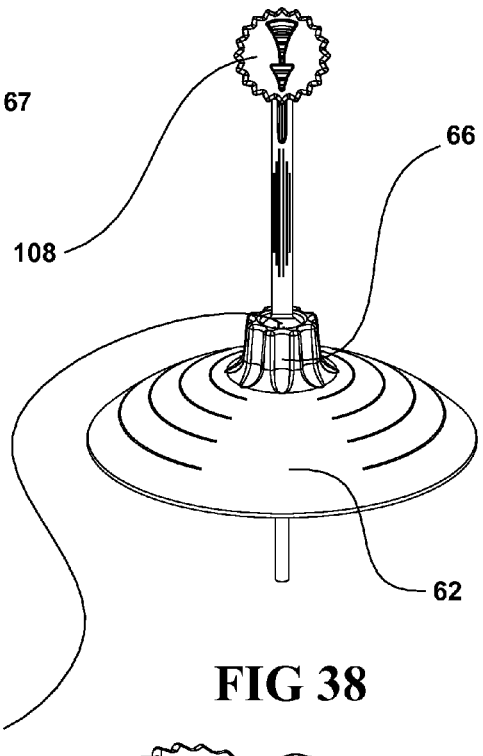
FIG. 38 is a top view of the circular spray deflector shield assembled on the one-piece nozzle with a curved tubular member installed, and deflector mounting member, according to an embodiment of the invention.
Figure 39:
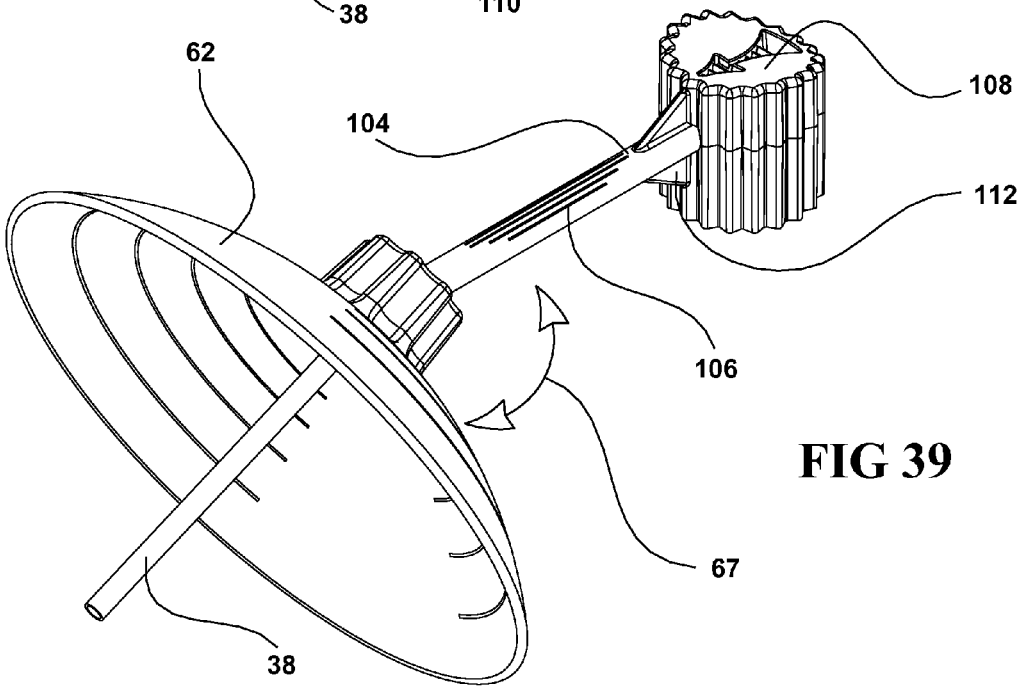
FIG. 39 is a front-right perspective view of the circular spray deflector shield assembled on the one-piece nozzle with a curved tubular member installed, and deflector mounting member, according to an embodiment of the invention, wherein the circular spray deflector shield is rotated in an angled position.
Figure 40:
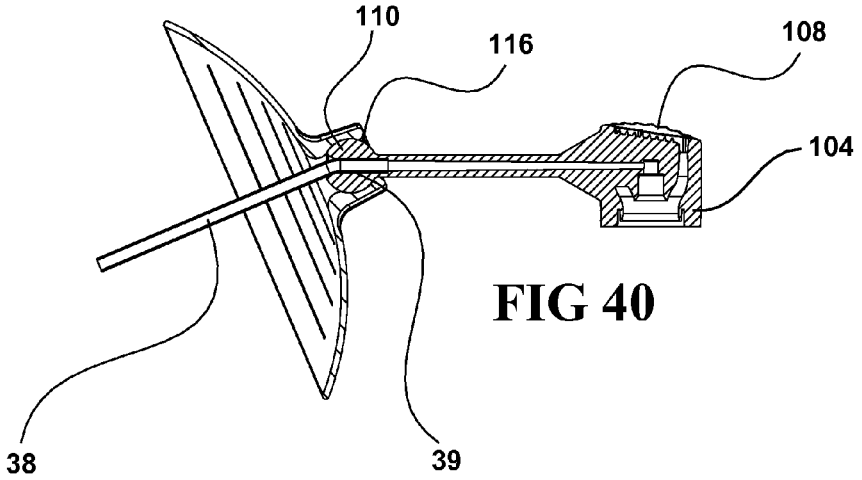
FIG. 40 is a sectional side view of the circular spray deflector shield assembled on the one-piece nozzle with a curved tubular member installed, and deflector mounting member, according to an embodiment of the invention, wherein the circular spray deflector shield is rotated in an angled position, and wherein the section is cut along the cutting-plane line C-C in FIG. 41.
Figure 41:
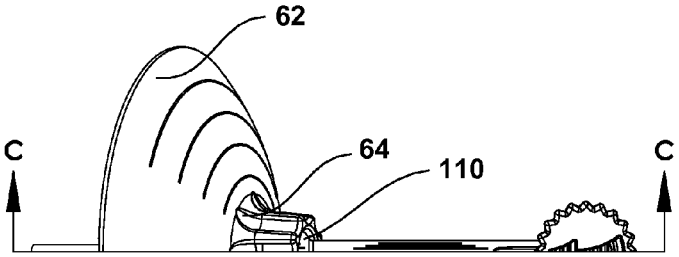
FIG. 41 is a partial top view of a circular spray deflector shield assembled on a one-piece nozzle with a curved tubular member installed, and deflector mounting member, according to an embodiment of the invention, wherein the circular spray deflector shield is rotated in an angled position.
Figure 84A:
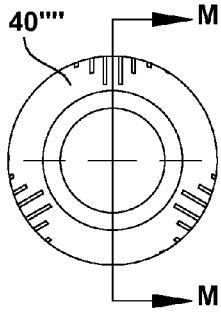
FIG. 84A is a front view of a fourth exemplary deflector mounting member with a ball-shaped male portion, according to an embodiment of the invention.
Figure 84B:
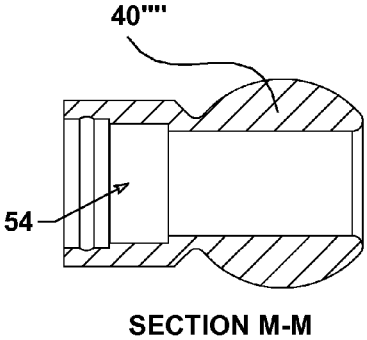
FIG. 84B is a side sectional view of the fourth exemplary deflector mounting member with the ball-shaped male portion, according to an embodiment of the invention, which is cut along the cutting-plane line M-M in FIG. 84A.
Figure 84C:
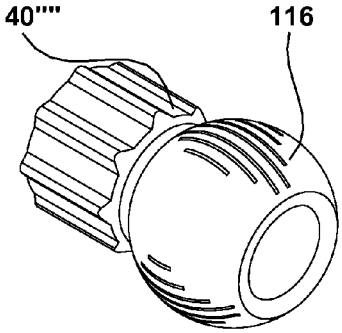
FIG. 84C is a perspective view of the fourth exemplary deflector mounting member with the ball-shaped male portion, according to an embodiment of the invention.
Figure 85:
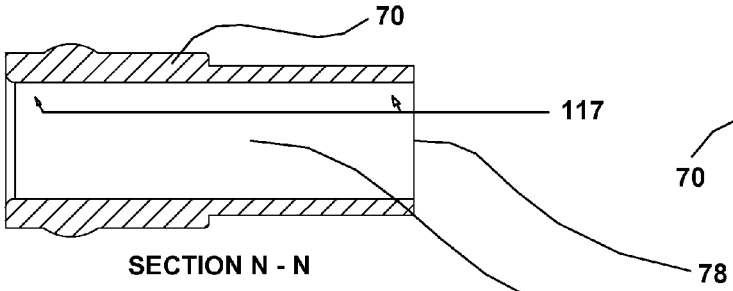
FIG. 85 is a side sectional view of an adapter mini-insert, according to an embodiment of the invention, which is cut along the cutting-plane lines N-N in FIGS. 86 and 87.
Figure 86:
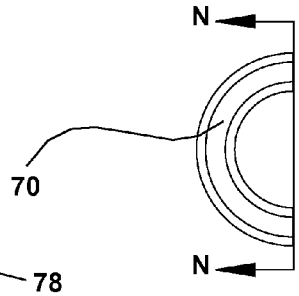
FIG. 86 is a partial front view of the adapter mini-insert, according to an embodiment of the invention.
Figure 87:
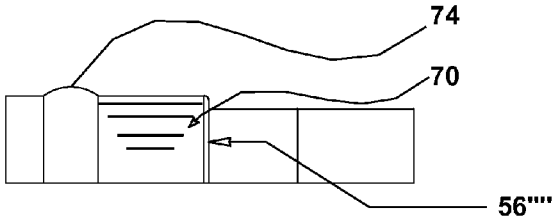
FIG. 87 is a partial side view of the adapter mini-insert, according to an embodiment of the invention.
Figure 118:
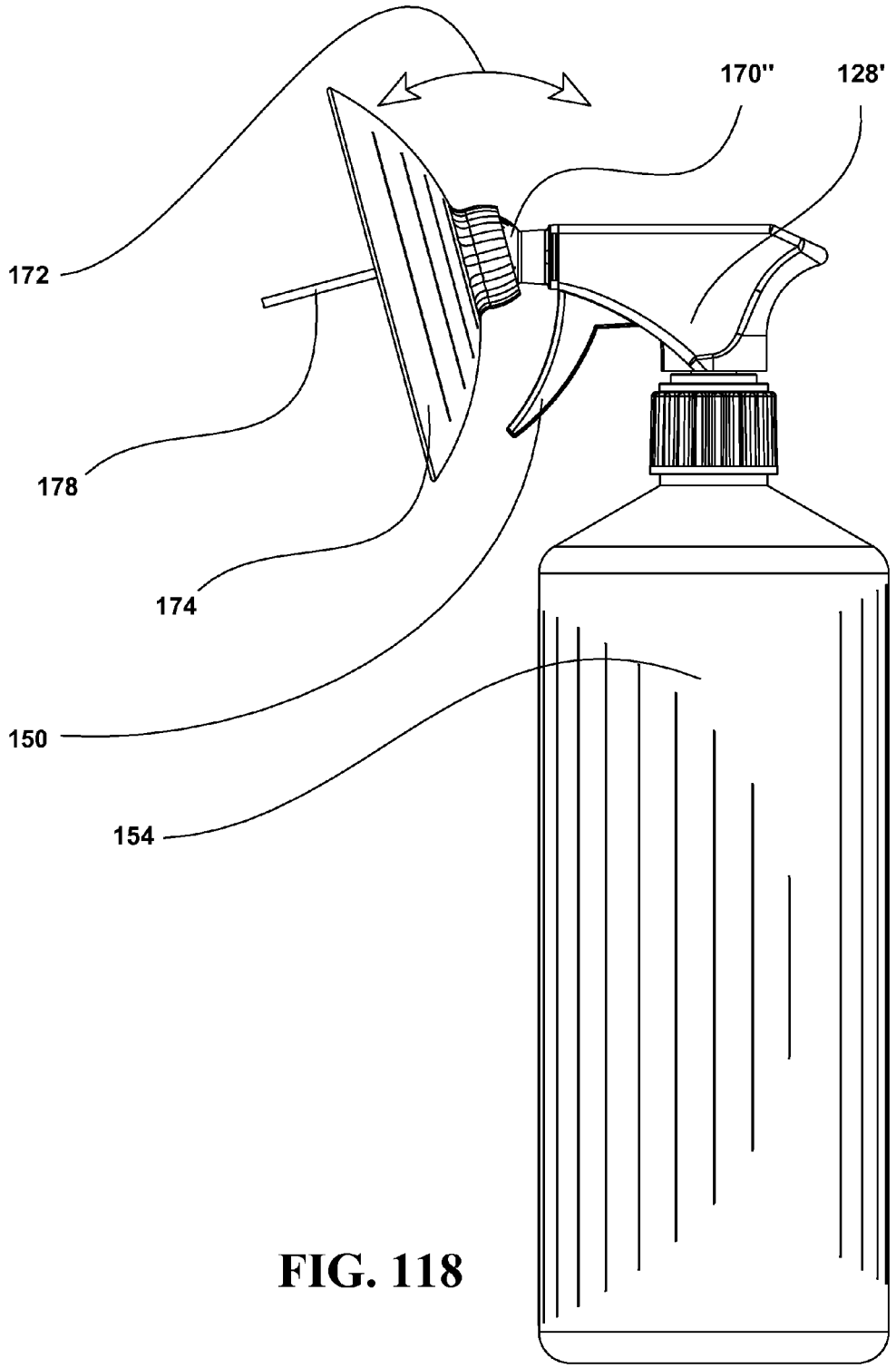

In one or more embodiments, the male portion 42 of the deflector mounting member 40 has a generally spherical or ball shape (e.g., see FIGS. 10A and 10B). The female socket 68 of the spray deflector mounting member 40 has a concave curvature that substantially corresponds to an outer curvature of the male portion 42 of the deflector mounting member 40 such that the male portion 42 is configured to engage with the female socket 68 and form a ball-and-socket joint therewith. In FIG. 28, the directional arrow 59 diagrammatically illustrates the manner in which the male (ball) portion 42 is inserted into the female socket 68. The arrow 67 in FIGS. 37 and 39, and the arrow 172 in FIG. 118, diagrammatically illustrates the manner in which the shield can be rotated about the male (ball) portion 42 of the deflector mounting member 40 (i.e., 360 degrees of rotation is enabled by the ball-and-socket joint). The circumferential rotation of the spray deflector member (shield) is indicated by the curved arrow 204 in FIG. 131A. The manner in which the shield socket is engaged with the ball portion 42 is diagrammatically illustrated by the curved line 206 in FIG. 131A. Preferably, the ball-and-socket joint comprises a friction fit engagement between the male portion 42 and the female socket 68 such that a selected position of the spray deflector member 60 relative to the deflector mounting member 40 is capable of being maintained. In FIG. 10B, it can be seen that the male (ball) portion 42 of the deflector mounting member 40 is provided with an outlet bore 48 therein for allowing the spray to be freely discharged therefrom in a generally unobstructed manner. Also, as shown in FIG. 84B, the outlet bore 48 of the deflector mounting member 40 is fluidly connected to an inner passageway 54.

Various configurations of the spray deflector mounting member 40 that have been contemplated by the inventor are illustrated in FIGS. 81A-84C and 94-95. In particular, these figures illustrate five (5) different variations 40', 40", 40'", 40"", and 40""" of the spray deflector mounting member. Another variation of the deflector mounting member, namely a deflector slip-on mounting member 41 is illustrated in FIG. 157. As shown in FIG. 157, the slip-on deflector mounting member 41 includes a ball portion 42 and an elongated fluid passageway disposed therethrough that is designed to receive a tubular member (e.g., deflector tubing 34) in a friction fit engagement 196'.

Figure 15:
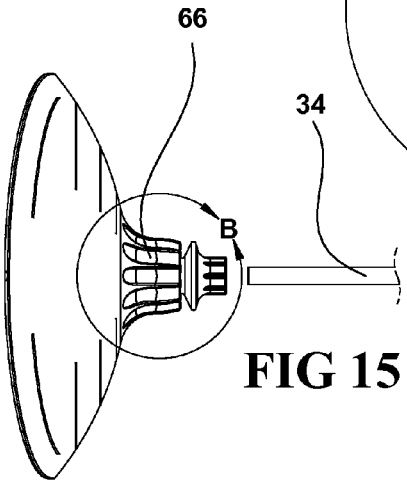
FIG. 15 is a right side view of the swivel ball socket jointed, oval-shaped spray deflector shield, the deflector mounting member assembled thereto, and the generally straight tubular member exploded therefrom, according to an embodiment of the invention.
Figure 16:
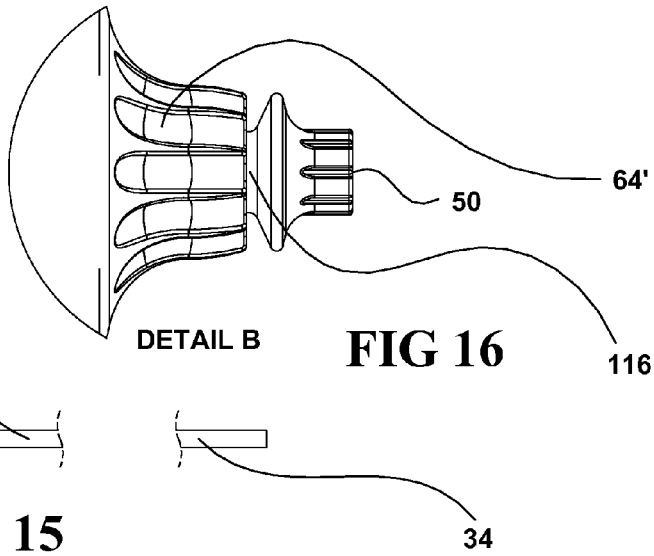
FIG. 16 is an enlarged, right side view of the encircled portion of FIG. 15, which includes a portion of the oval-shaped spray deflector shield, finger projection and the deflector mounting member assembled thereto, according to an embodiment of the invention.
Figures 112, 113, 114, 115, 116, 117:
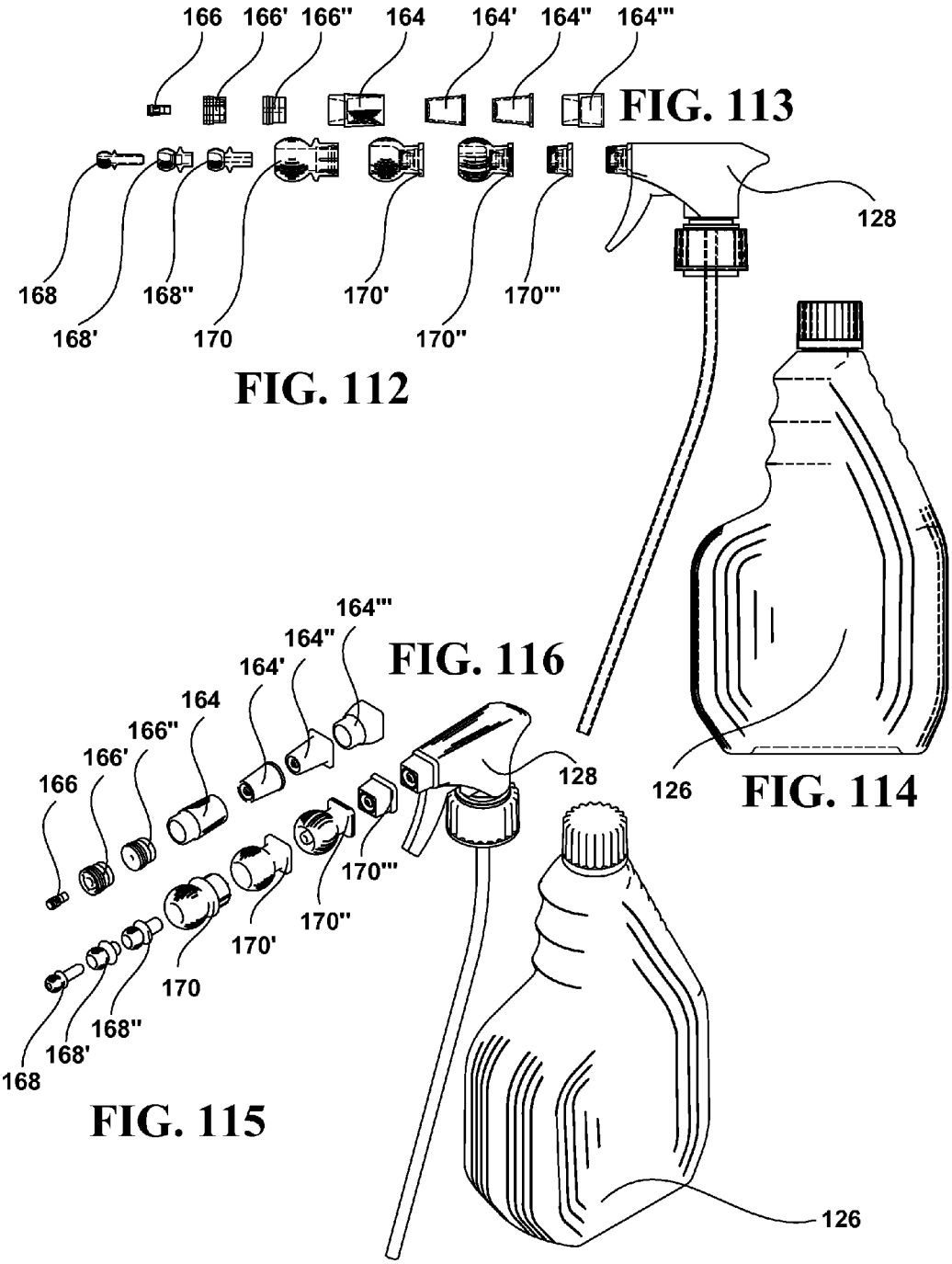

Also, in one or more embodiments (e.g., see FIGS. 6 and 15), the collar portion 64 of the spray deflector member 40 further comprises a ribbed finger grip portion (i.e., with finger grip projections 66) for facilitating an adjustment of an angular position of the spray deflector member 60 relative to the deflector mounting member 40. Similarly, the deflector mounting member 40 further includes a ribbed finger grip portion 44 (with finger grip projections 50) for facilitating the grasping thereof by a user (e.g., refer to FIGS. 12 and 75). As shown in FIGS. 35, 75, 77, 80, 90 and 93, a collar 46 separates the finger grip portion of the deflector mounting member 40 from the ball portion 42. Other deflector mounting members 168, 168', and 168" are illustrated in FIG. 112.

Figure 73:
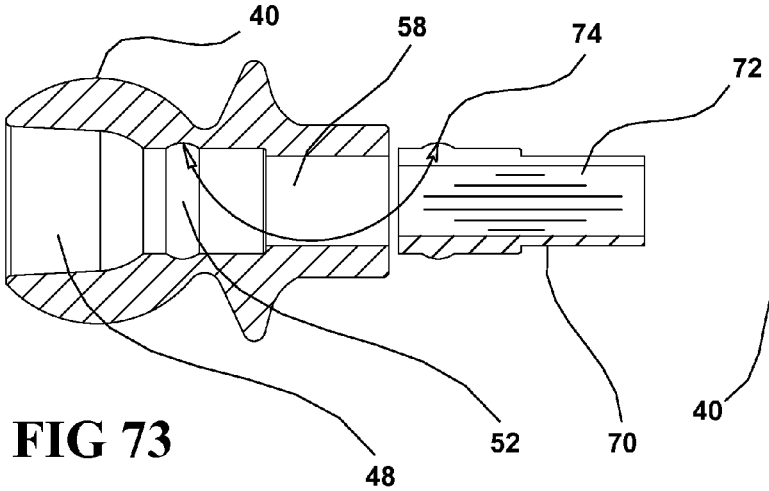
FIG. 73 is a side sectional view of a deflector mounting member with a ball-shaped male portion and an adapter cored-insert, according to an embodiment of the invention, which is cut along the cutting-plane line H-H in FIG. 74.
Figure 74:
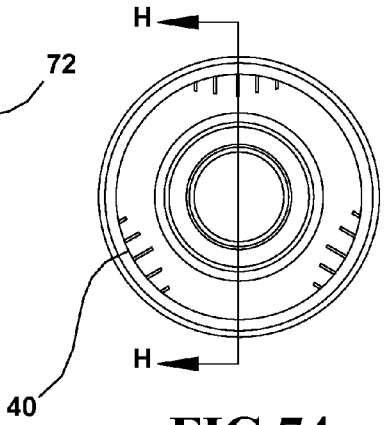
FIG. 74 is a front view of a deflector mounting member with the ball-shaped male portion and the adapter cored-insert therebehind, according to an embodiment of the invention.
Figure 75:
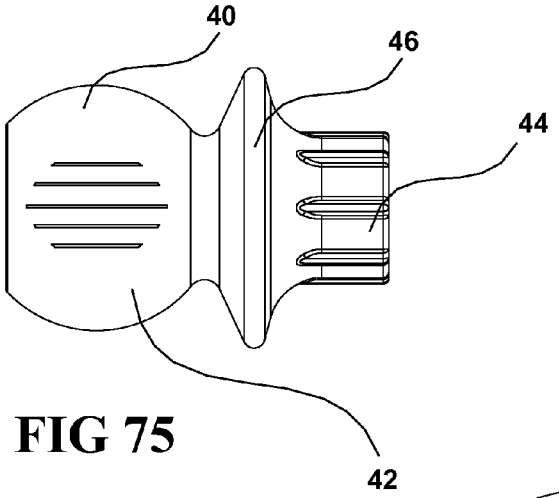
FIG. 75 is a right side view of the deflector mounting member with the ball-shaped male portion, according to an embodiment of the invention.
Figure 76:
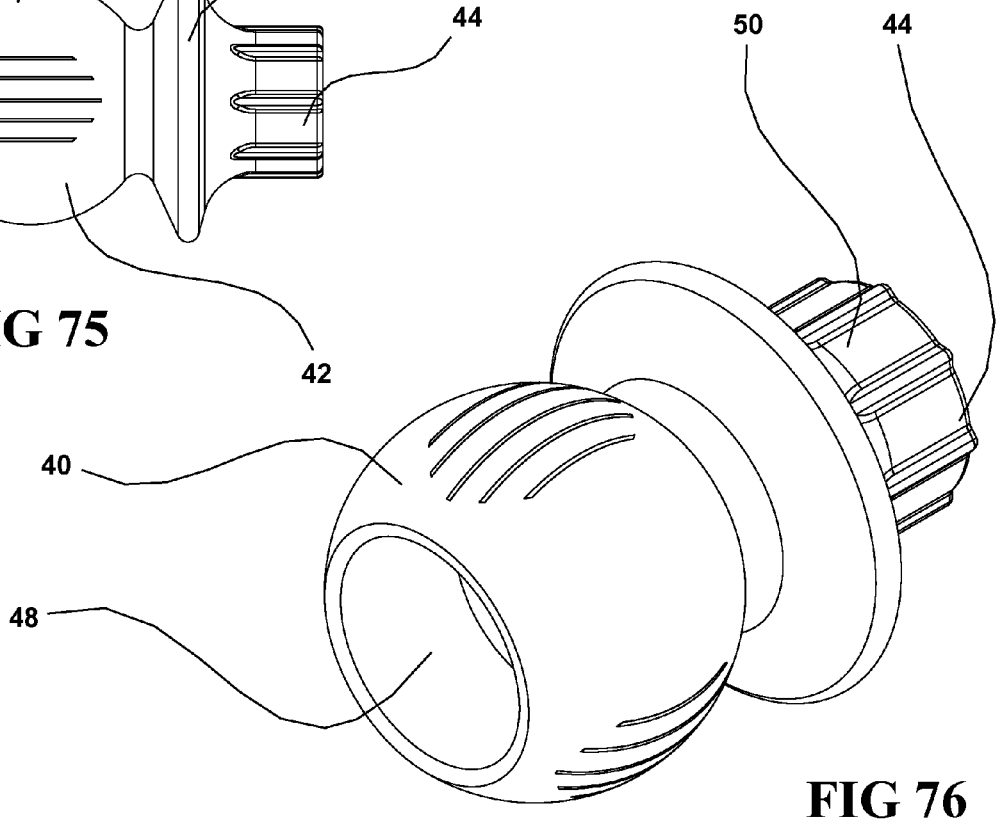
FIG. 76 is a perspective view of the deflector mounting member with the ball-shaped male portion, according to an embodiment of the invention.
Figure 81A:
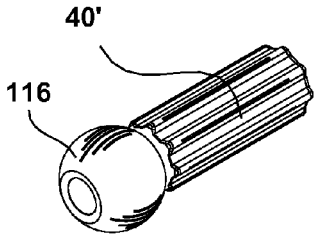
FIG. 81A is a perspective view of a first exemplary deflector mounting member with a ball-shaped male portion, according to an embodiment of the invention.
Figure 81B:
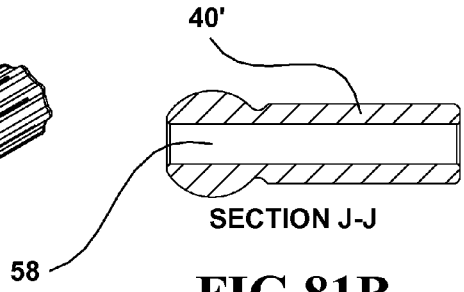
FIG. 81B is a side sectional view of the first exemplary deflector mounting member with the ball-shaped male portion, according to an embodiment of the invention, which is cut along the cutting-plane line J-J in FIG. 81C.
Figure 81C:
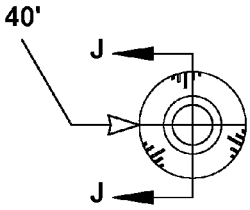
FIG. 81C is a front view of the first exemplary deflector mounting member with the ball-shaped male portion, according to an embodiment of the invention.
Figure 82A:
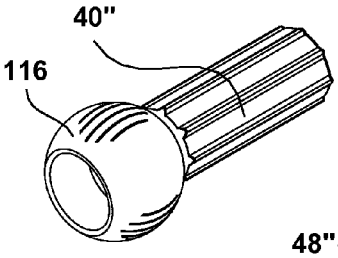
FIG. 82A is a perspective view of a second exemplary deflector mounting member with a ball-shaped male portion, according to an embodiment of the invention.
Figure 82B:
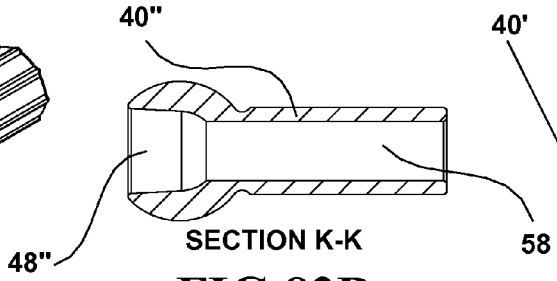
FIG. 82B is a side sectional view of the second exemplary deflector mounting member with the ball-shaped male portion, according to an embodiment of the invention, which is cut along the cutting-plane line K-K in FIG. 82C.
Figure 82C:
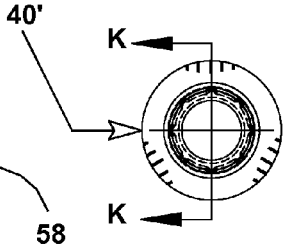
FIG. 82C is a front view of the second exemplary deflector mounting member with the ball-shaped male portion, according to an embodiment of the invention.
Figure 83A:
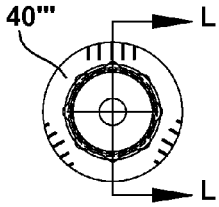
FIG. 83A is a front view of a third exemplary deflector mounting member with a ball-shaped male portion, according to an embodiment of the invention.
Figure 83B:
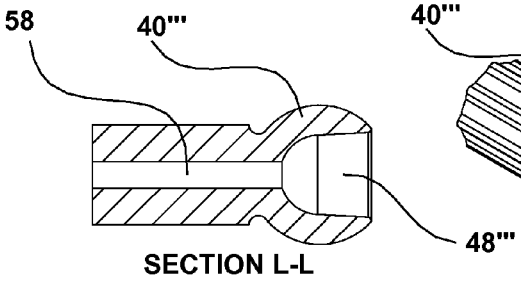
FIG. 83B is a side sectional view of the third exemplary deflector mounting member with the ball-shaped male portion, according to an embodiment of the invention, which is cut along the cutting-plane line L-L in FIG. 83A.
Figure 83C:
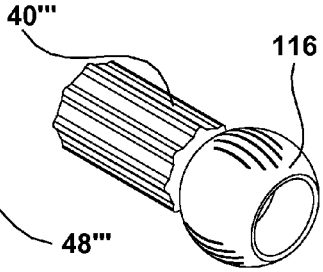
FIG. 83C is a perspective view of the third exemplary deflector mounting member with the ball-shaped male portion, according to an embodiment of the invention.
Figure 88:
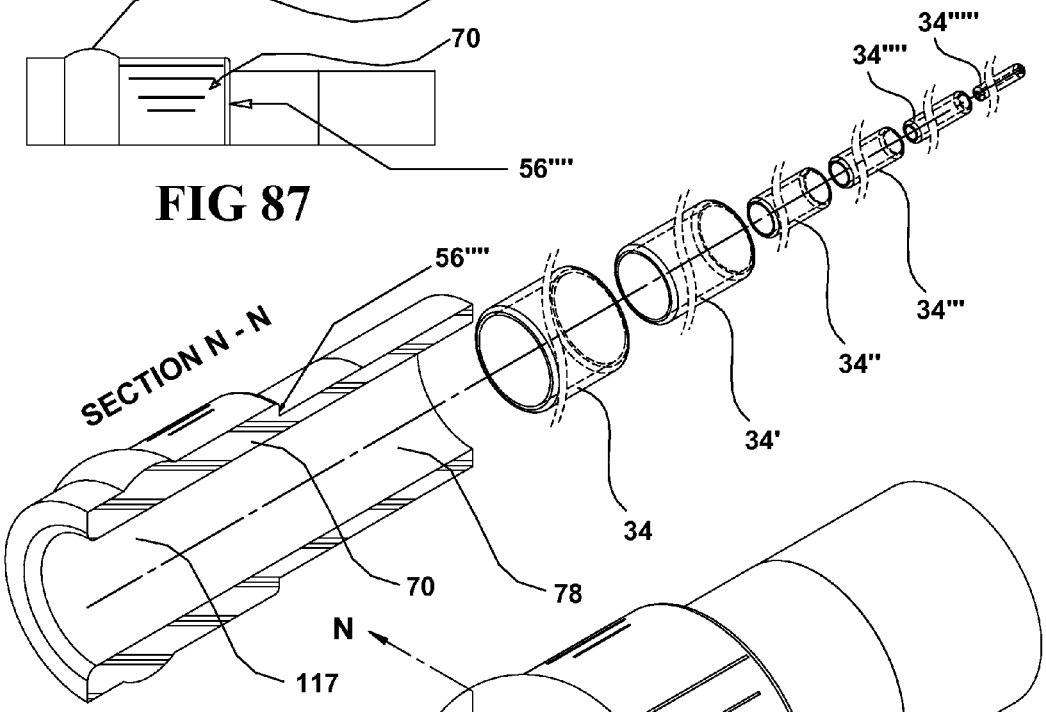
FIG. 88 is a sectional perspective view of the adapter mini-insert, and a perspective view of a plurality of tubular members having a plurality of different inner and outer diameters, according to an embodiment of the invention, wherein the section through the adapter mini-insert is cut along the cutting-plane lines N-N in FIGS. 86 and 87.
Figure 89:
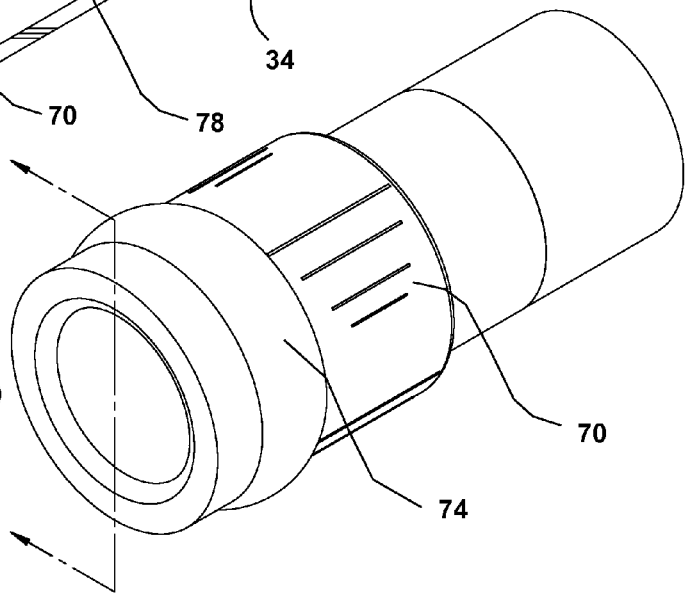
FIG. 89 is an enlarged perspective view of the adapter mini-insert, according to an embodiment of the invention.
Figure 90:
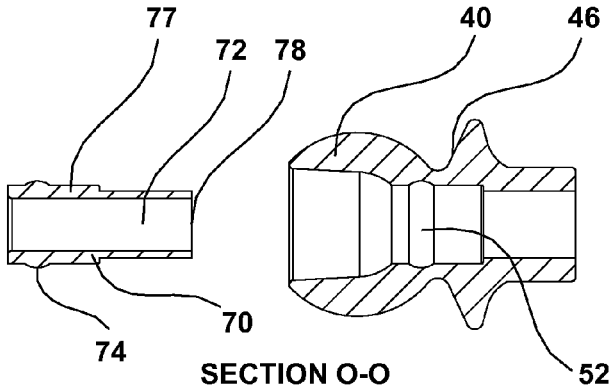
FIG. 90 is an exploded side sectional view of an adapter mini-insert and a deflector mounting member with a ball-shaped male portion, according to an embodiment of the invention, which is cut along the cutting-plane line O-O in FIG. 91.
Figure 91:
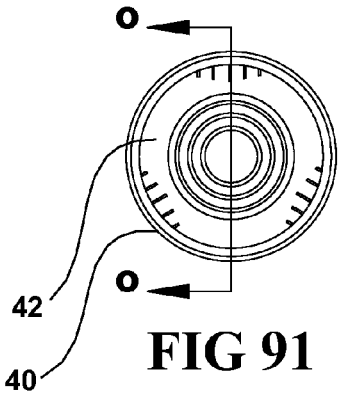
FIG. 91 is a front view of the deflector mounting member with the ball-shaped male portion and the adapter mini-insert, according to an embodiment of the invention.
Figure 92:
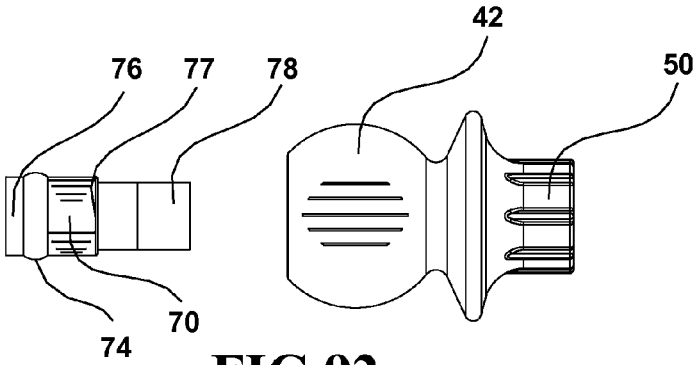
FIG. 92 is an exploded side view of the adapter mini-insert and the deflector mounting member with the ball-shaped male portion, according to an embodiment of the invention.
Figure 93:
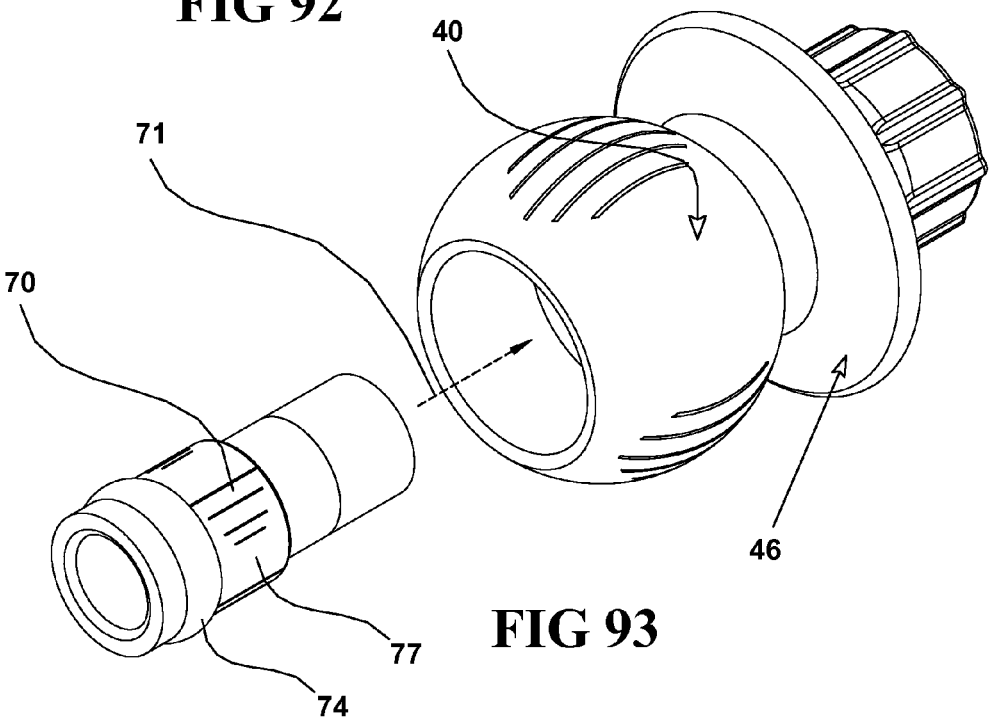
FIG. 93 is an exploded perspective view of the adapter mini-insert and the deflector mounting member with the ball-shaped male portion, according to an embodiment of the invention.
Figure 94:
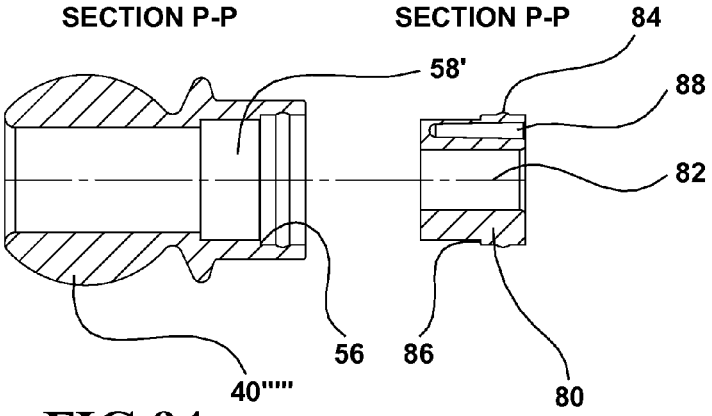
FIG. 94 is an exploded side sectional view of a deflector mounting member with a ball-shaped male portion and an adapter cored-insert, according to an embodiment of the invention, which is cut along the cutting-plane line P-P in FIG. 94.
Figure 95:
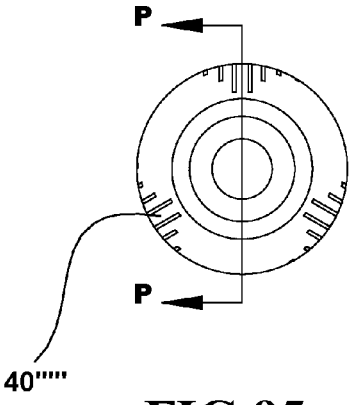
FIG. 95 is a front view of the deflector mounting member with the ball-shaped male portion and the adapter cored-insert, according to an embodiment of the invention.
Figure 96:
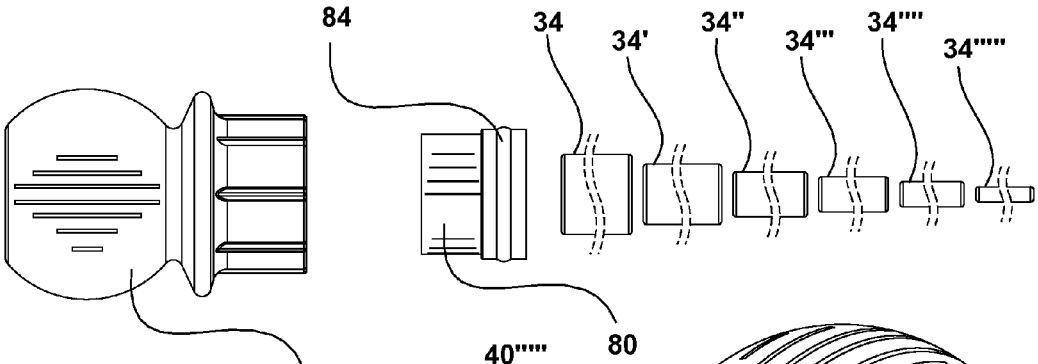
FIG. 96 is an exploded side view of the deflector mounting member with the ball-shaped male portion, the adapter cored-insert, and a plurality of tubular members having a plurality of different inner and outer diameters, according to an embodiment of the invention.
Figure 97:
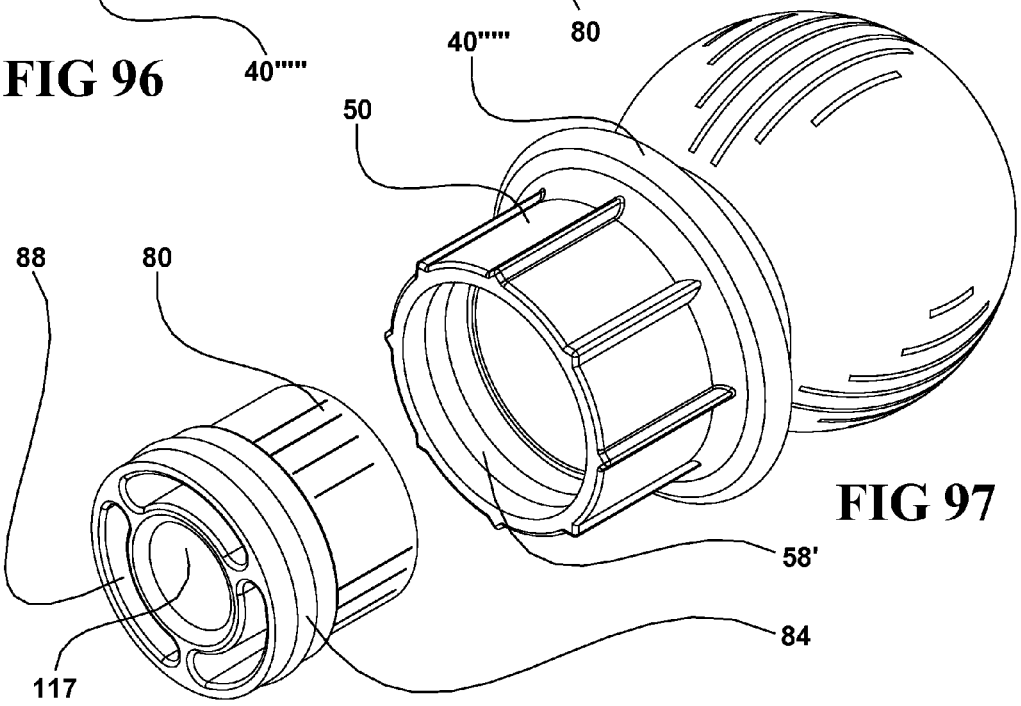
FIG. 97 is an exploded perspective view of the adapter cored-insert and the deflector mounting member with the ball-shaped male portion, according to an embodiment of the invention.
Figure 98:
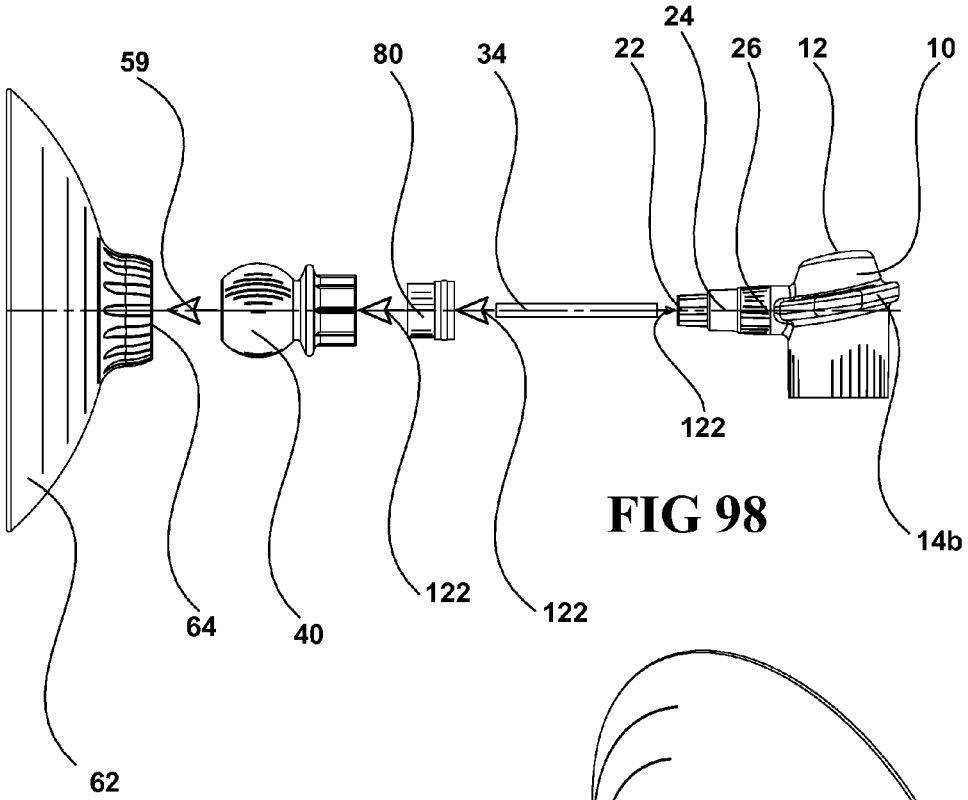
FIG. 98 is an exploded right side view of a circular spray deflector shield, a deflector mounting member with a ball-shaped male portion, an adapter cored-insert, a generally straight tubular member, and a nozzle member, according to an embodiment of the invention.
Figure 99:
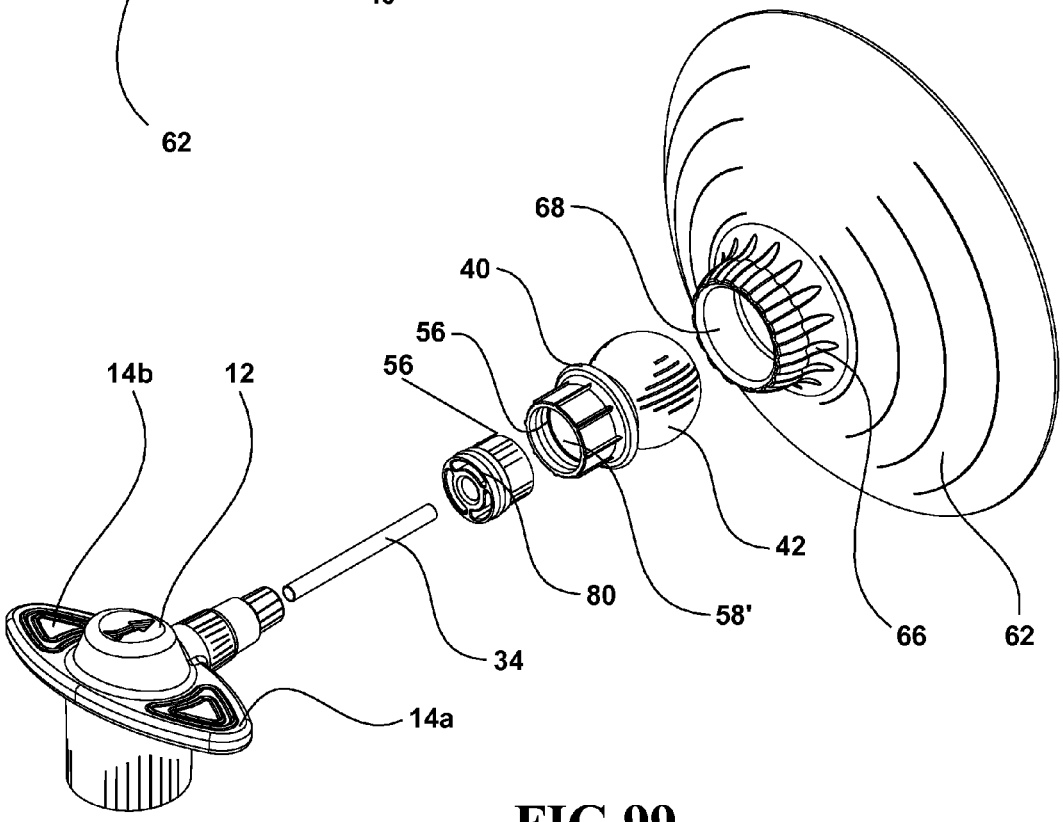
FIG. 99 is an exploded perspective view of the circular spray deflector shield, the deflector mounting member with the ball-shaped male portion, the adapter cored-insert, the generally straight tubular member, and the nozzle member, according to an embodiment of the invention.
Figure 100:
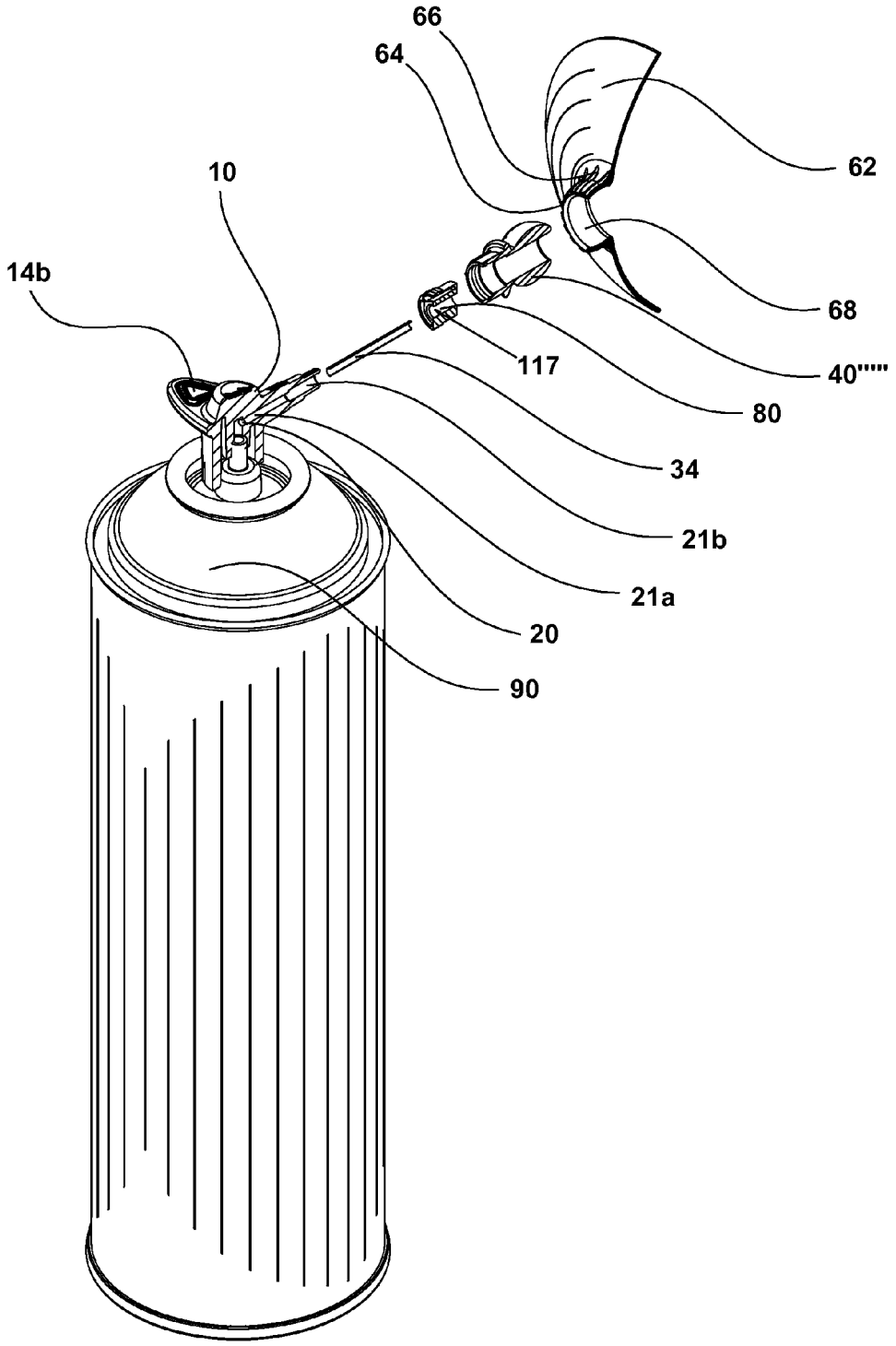
FIG. 100 is an exploded sectional perspective view of the circular spray deflector shield, the deflector mounting member with the ball-shaped male portion, the adapter cored-insert, the generally straight tubular member, and the nozzle member fitted to an aerosol can, according to an embodiment of the invention.
Figure 101:
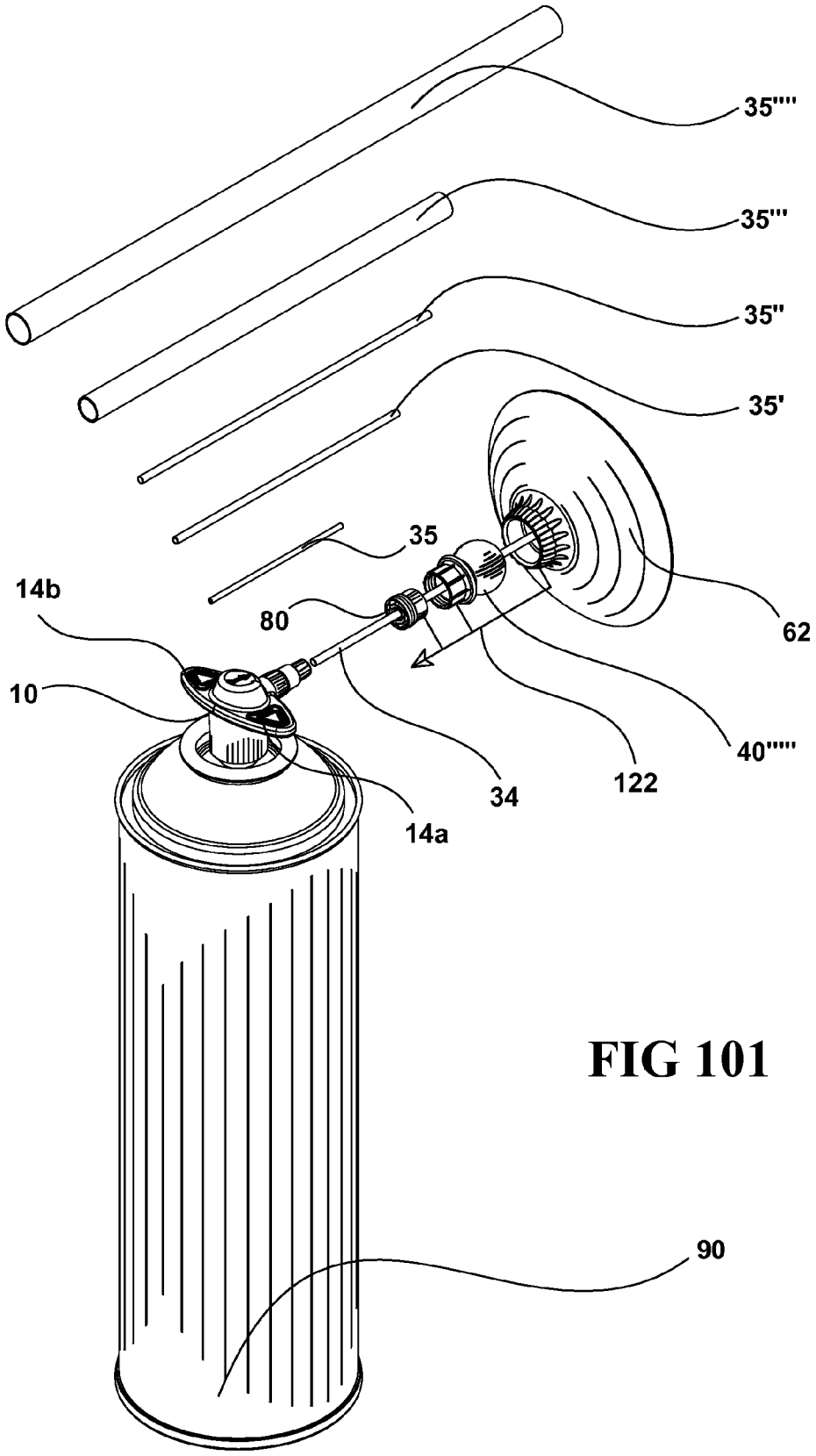
FIG. 101 is a partially exploded perspective view of the circular spray deflector shield, the deflector mounting member with the ball-shaped male portion, the adapter cored-insert, the generally straight tubular member, and the nozzle member fitted to an aerosol can, according to an embodiment of the invention, wherein tubular members having varying lengths, inner and outer diameters are additionally shown.
Figure 102:
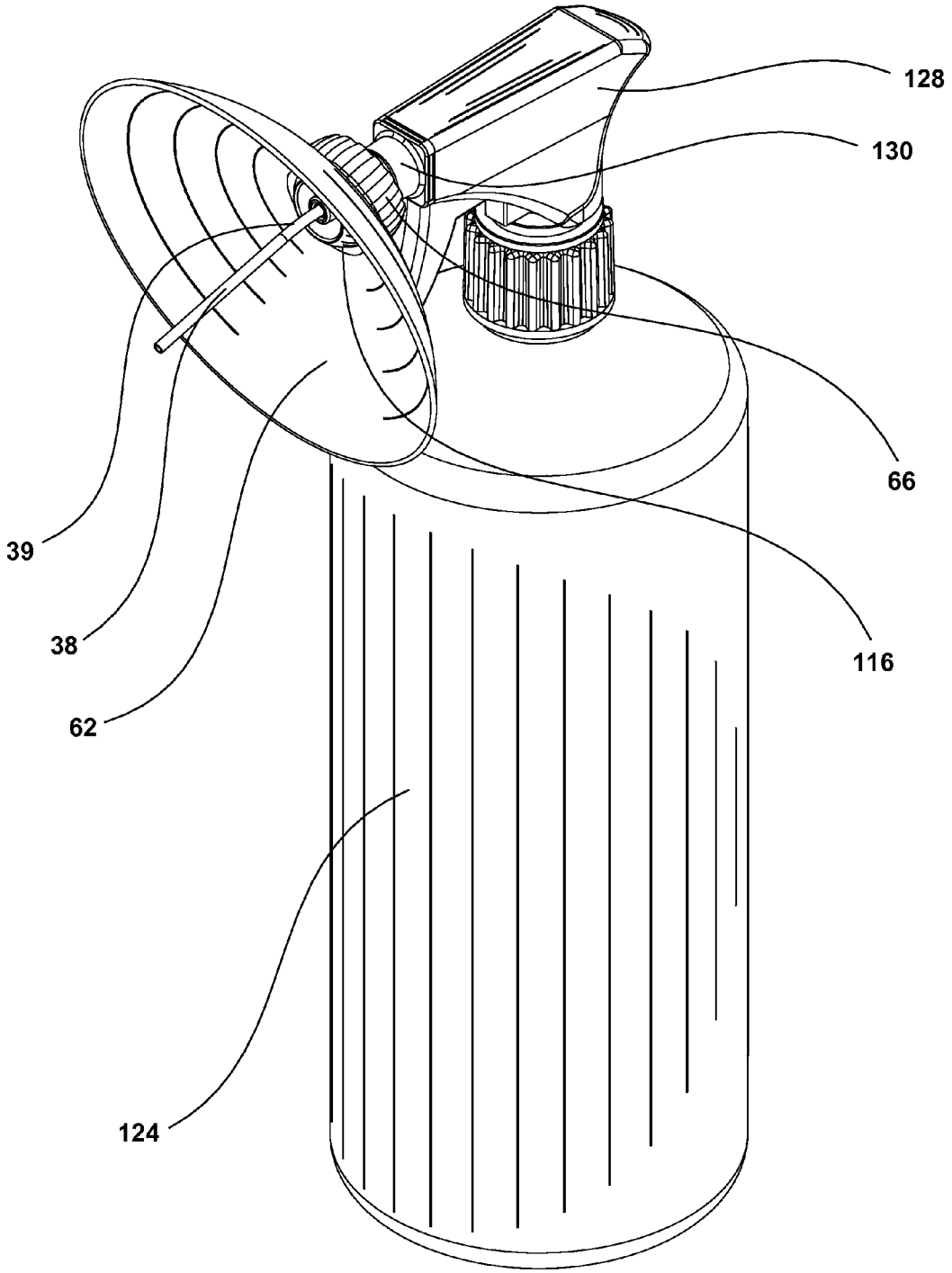
FIG. 102 is a perspective view of a cylindrical spray bottle having a spray system installed thereon, wherein the spray system includes a retrofit replacement nozzle member with a ball-shaped male portion and a circular spray deflector shield, according to an embodiment of the invention.

In one or more further embodiments, the deflector mounting member 40 further comprises at least one insert adapter member 70 for engaging the tubular member of the spray bottle 154 or aerosol spray can 90, the at least one insert adapter member 70 including one or more annular projections 74 (e.g., see FIG. 84) for engaging with one or more respective grooves 43, 52 in a bore 58' of the deflector mounting member 40 (e.g., refer to FIGS. 73, 77, and 90). As shown in FIG. 90, the annular projection 74 of the insert adapter member 70 can be located on a collar portion 77 thereof. The insert adapter member 70 has a fluid passageway disposed therethrough (see e.g., FIG. 29), and an outlet section 76 and an inlet section 78 (see e.g., FIG. 92). Also, the interior of the deflector mounting member 40 preferably includes an insert abutment 56 for governing the position of the insert adapter member 70 therein (see e.g., FIGS. 80, 94, and 99). In FIG. 160, it can be seen that the mini-insert adapter member 70 is provided with an abutment face 56", which is configured to abut the insert abutment 56 of the deflector mounting member 40 when the insert 70 is disposed therein. In FIGS. 27, 28, 62, 79, and 93, the directional arrow 71 diagrammatically illustrates the direction of insertion for the insert 70 into the deflector mounting member 40. As shown in FIGS. 88 and 96, the at least one insert adapter member 70 may comprise a plurality of insert adapter members (e.g., mini-insert adapter member 70 or cored-insert member 80) that are capable of being interchangeably and removably engaged with the one or more respective grooves 43, 52 in inlet bores 58, 58' of the deflector mounting member 40 (see e.g., FIGS. 73, 77, and 90), the plurality of insert adapter members 70, 80 being configured to accommodate tubular members 34, 34', 34", 34''', 34'''', 34''''' of spray bottles 154 or aerosol spray cans 90 having varying diameters (e.g., see FIGS. 88 and 96). Similarly, as depicted in FIG. 101, cored-insert adapter members 80 having various internal diameters would permit a plurality of different tubular members (e.g., deflector tubing members 35, 35', 35", 35''', 35'''') having various diameters (and lengths) to be easily accommodated in the inventive spray system described herein. In FIG. 64, the directional arrow 81 diagrammatically illustrates the direction of insertion for the cored-insert adapter member 80 into the deflector mounting member 40. As shown in FIG. 94, the cored-insert adapter member 80 comprises a fluid passageway 82 disposed therethrough, an annular projection 84 for engaging with a corresponding groove (e.g., in a deflector mounting member 40), a collar portion 86, and a plurality of arc-shaped cavities 88 disposed therein (refer also to FIG. 97).

Figure 13:
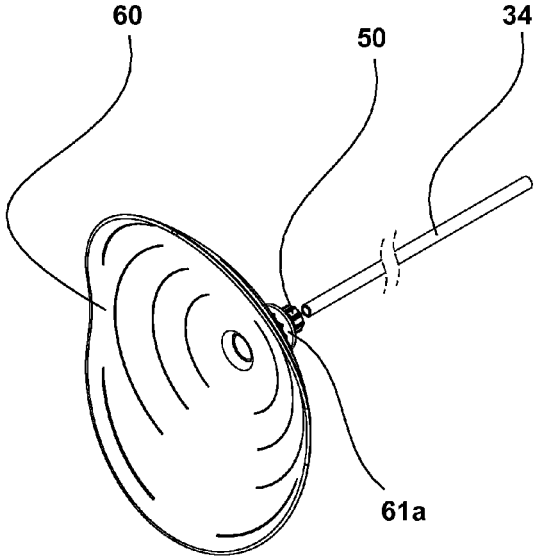
FIG. 13 is a front-right perspective view of a swivel ball socket jointed, oval-shaped spray deflector shield, a deflector mounting member assembled thereto, and a generally straight tubular member exploded therefrom, according to an embodiment of the invention.
Figure 14:
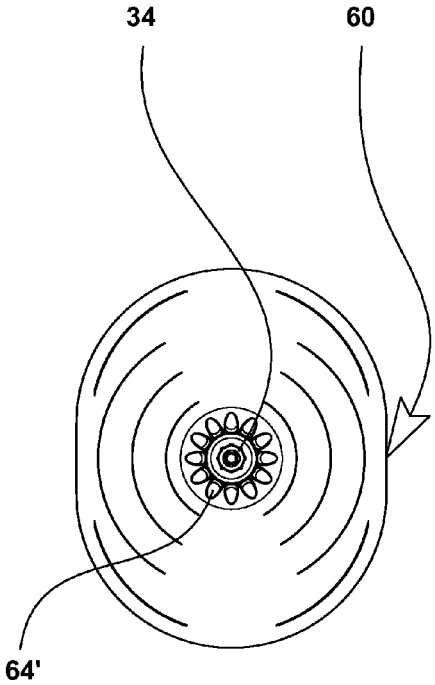
FIG. 14 is an assembled rear view of the swivel ball socket jointed, oval-shaped spray deflector shield, the deflector mounting member, and the generally straight tubular member, according to an embodiment of the invention.

In FIG. 13, an insert 61*a* of a swivel-type spray deflector member is shown. As shown in this figure, the spray deflector shield is generally oval-shaped.

Figure 24:
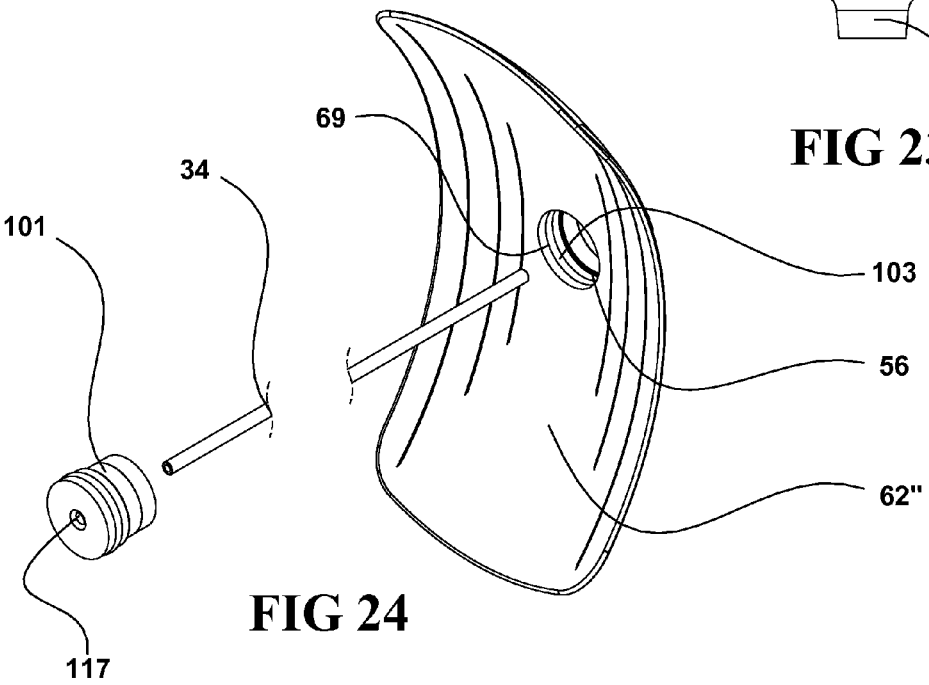
FIG. 24 is an exploded perspective view of the rectangular spray deflector shield, the cored insert, and the generally straight tubular member, according to an embodiment of the invention.
Figure 25:
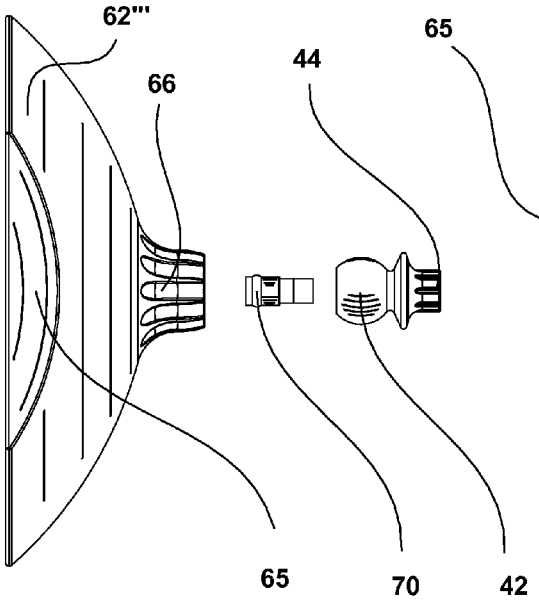
FIG. 25 is an exploded right side view of a rectangular spray deflector shield with side walls, a deflector mounting member with a ball-shaped male portion, and an adapter mini-insert, according to an embodiment of the invention.
Figure 26:
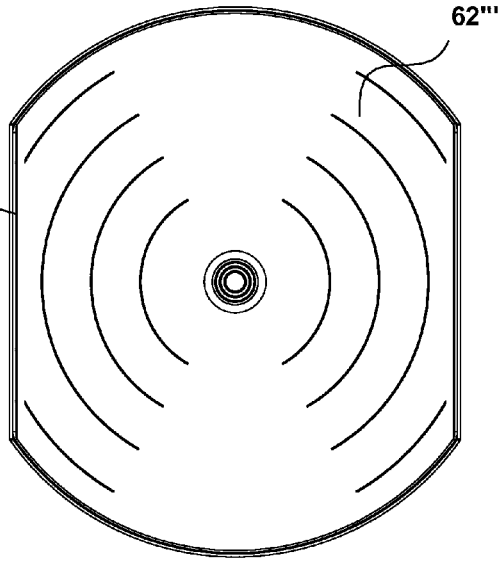
FIG. 26 is a front view of the rectangular spray deflector shield with side walls, the deflector mounting member with the ball-shaped male portion, and the adapter mini-insert, according to an embodiment of the invention.
Figure 27:
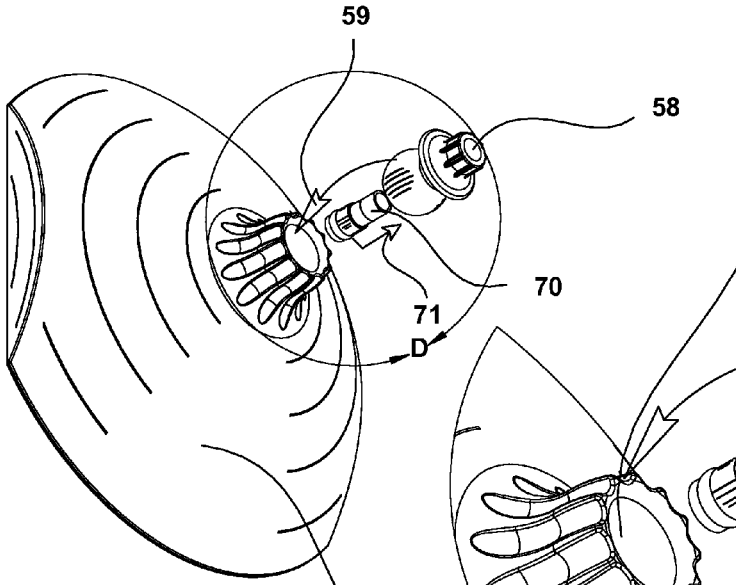
FIG. 27 is an exploded rear perspective view of the rectangular spray deflector shield with side walls, the deflector mounting member with the ball-shaped male portion, and the adapter mini-insert, according to an embodiment of the invention.
Figure 50:
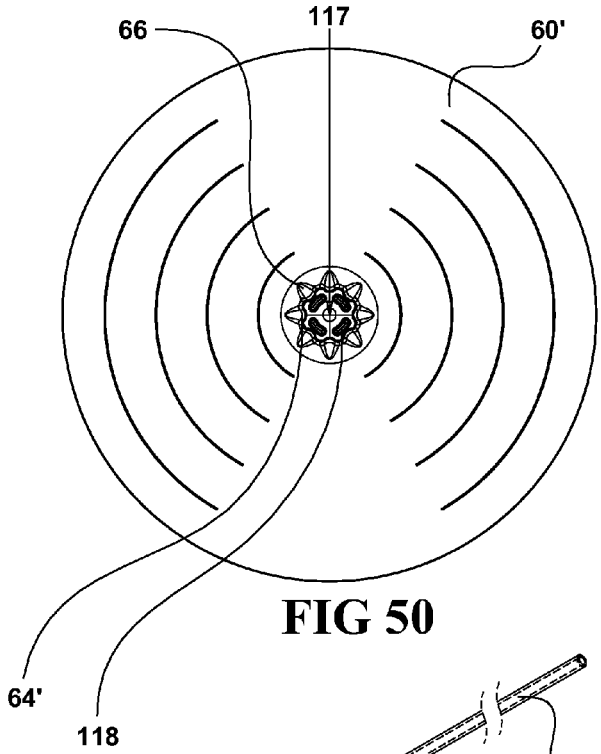
FIG. 50 is a rear view of the non-swivel, circular spray deflector shield and the generally straight tubular member, according to an embodiment of the invention.
Figure 51:
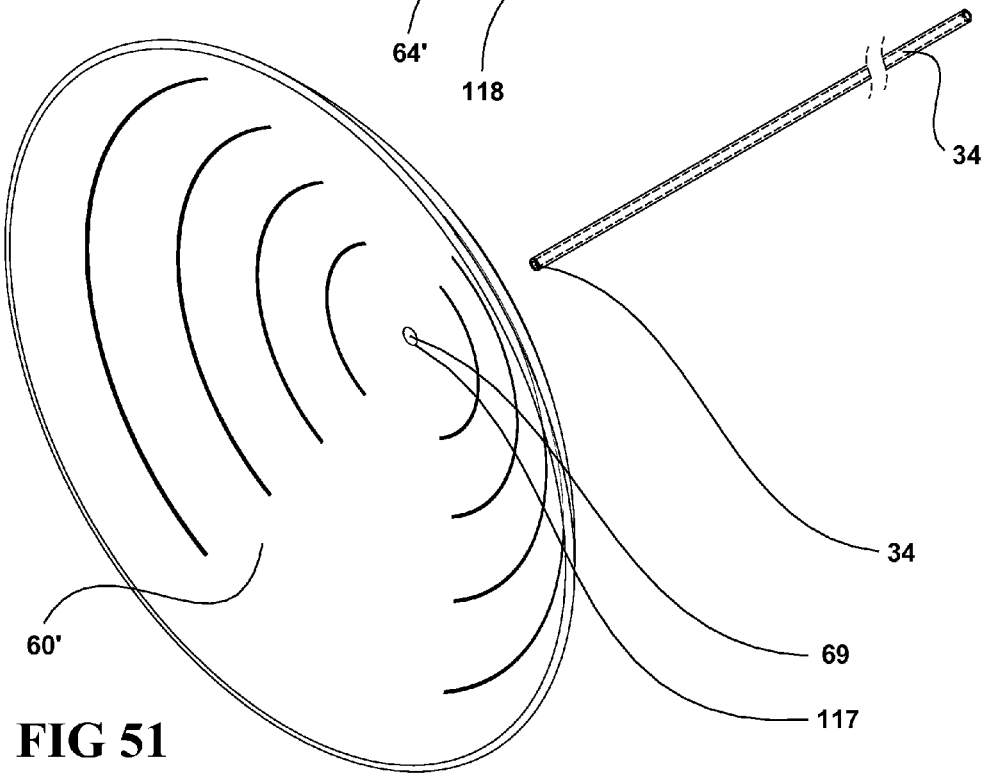
FIG. 51 is an exploded perspective view of the non-swivel, circular spray deflector shield and the generally straight tubular member, according to an embodiment of the invention.
Figure 52:
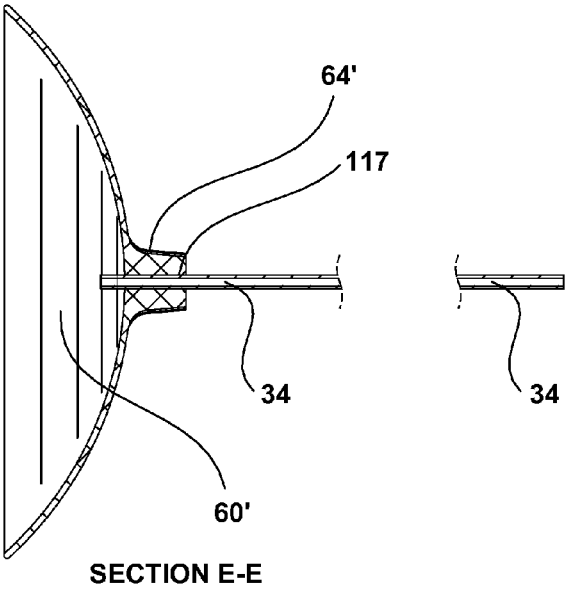
FIG. 52 is a sectional side view of the non-swivel, circular spray deflector shield and the generally straight tubular member, according to an embodiment of the invention, which is cut along the cutting-plane line E-E in FIG. 53.
Figure 53:
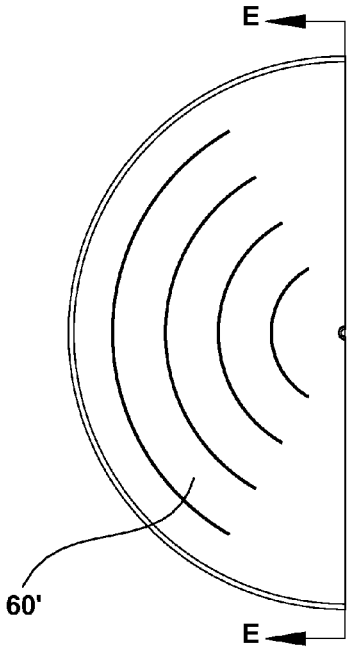
FIG. 53 is a partial front view of the non-swivel, circular spray deflector shield and the generally straight tubular member, according to an embodiment of the invention.
Figure 54:
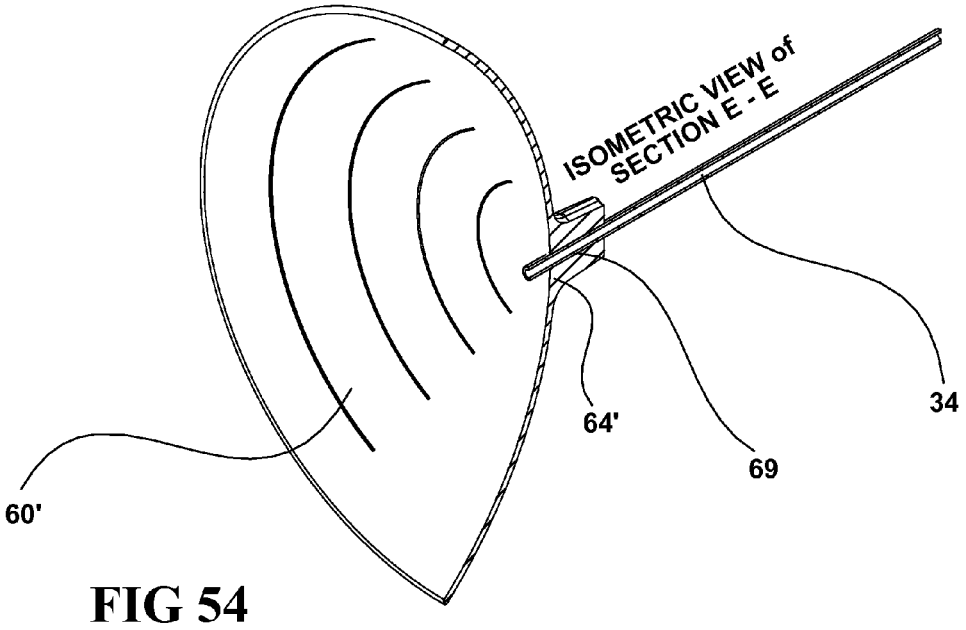
FIG. 54 is a sectional perspective view of the non-swivel, circular spray deflector shield and the generally straight tubular member, according to an embodiment of the invention, which is cut along the cutting-plane line E-E in FIG. 53.

In one or more embodiments, a spray shield deflection device (see e.g., FIGS. 21-24), which is configured to deflect spray that is reflected from a target, comprises: (ii) a concave deflector portion 62" configured to generally face a target to which a spray is being applied; and (ii) a collar portion 64' coupled to the concave deflector portion 62", the collar portion 64' including an insert aperture 69 disposed therethrough for receiving an insert adapter member 100 (as shown in FIG. 24). In another embodiment (e.g., as shown in FIGS. 49-54), the collar portion 64' of a spray deflector member 60' includes an insert aperture 69 disposed therethrough for receiving a tubular member (e.g., deflector tubing 34) of a spray bottle or aerosol can. The spray deflection devices illustrated in FIGS. 21-24 and FIGS. 49-54 are both non-swivel-type spray deflection shields. Although, as indicated by the directional arrow 120 in FIG. 49, it is possible to adjust the position of the spray deflector member or shield 60' along the length of the tubular member 34 by sliding the spray deflector member 60' therealong. It is to be understood that the insert aperture 69 of the collar portion 64' of the spray deflector member 60' engages the tubular member 34 with a slight friction fit 117. As best shown in FIG. 50, the illustrated collar portion 64' of the spray deflector member 60' is provided with a plurality of cavities 118 disposed therein, which are generally arranged in annular pattern about the insert aperture 69.

While the deflector portion 62" of FIGS. 21-24 is generally rectangular in shape, it is to be appreciated that other suitable shapes for the deflector portion of the spray deflector member have been contemplated as well. For example, in FIGS. 55 and 56, the deflector portion 62' is oval-shaped, while the deflector portion 62'''' in FIGS. 57 and 58 is generally rectangular with rounded top and bottom sides, and no sidewalls. In contrast, the deflector portion 62''' of FIGS. 61 and 62 is generally rectangular with rounded top and bottom sides, and is provided with sidewalls 65. Also, it is to be understood that concave geometry of the deflector portion of the spray deflector member may be embodied in various suitable forms as well, as such as a parabolic shape, a hemispherical shape, or a multi-faceted shape, similar to the top of a diamond.

The spray deflector member can be formed from various suitable materials as well. In one embodiment, the spray deflector member comprises a polymeric material (e.g., acrylic/SAN/polystyrene/polypropylene/polycarbonate/Isoplast) and at least the deflector portion thereof is generally transparent so as to allow one to see a desired target positioned in front of the deflector spray shield. In addition, the spray deflector member and the other components of the spray system (e.g., the nozzle member 10 and the deflector mounting member 40) may be made using other suitable materials as well, such as biodegradable plastic resins, polyethylene, polycarbonate and glass filled polycarbonates, K resin, nylons—including (glass filled nylon), ASS (acrylonitrile-butadiene-styrene), Ultem, or the deflector and other components of the spray system may be made of metal, such as aluminum. Also, it is possible to even form the spray deflector member from wood, such as balsa or birch.

Figure 17:
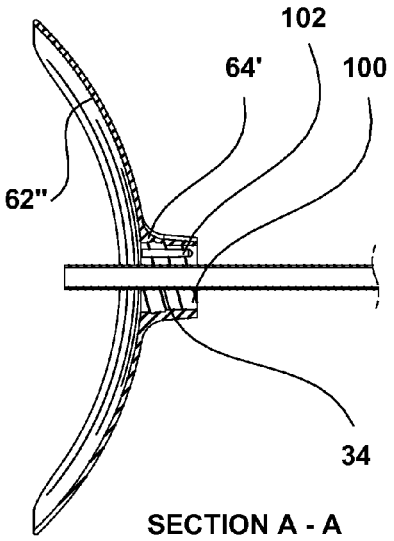
FIG. 17 is a sectional side view of a rectangular spray deflector shield with a cored insert, and mounted on a generally straight tubular member, according to an embodiment of the invention, which is cut along the cutting-plane line A-A in FIG. 18.
Figure 18:
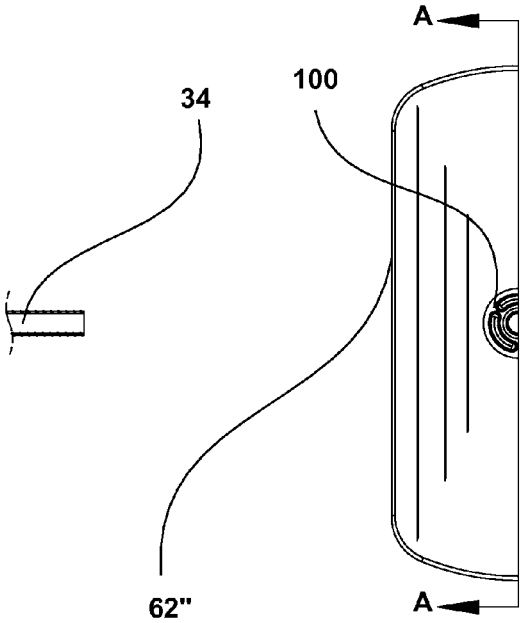
FIG. 18 is a partial front view of the rectangular spray deflector shield with the cored insert, and mounted on the generally straight tubular member, according to an embodiment of the invention.
Figure 19:
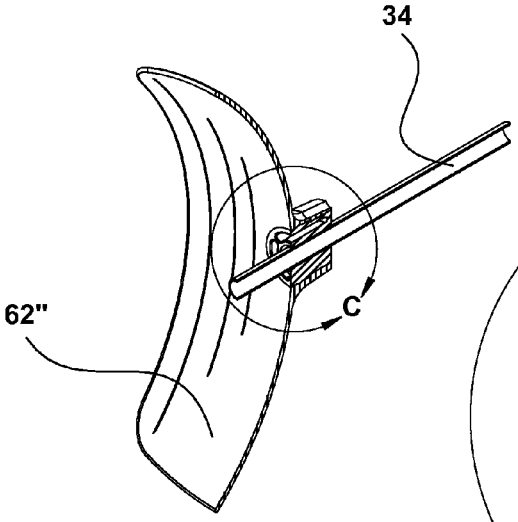
FIG. 19 is a partial sectional perspective view of the rectangular spray deflector shield with the cored insert, and mounted on the generally straight tubular member, according to an embodiment of the invention.
Figure 20:
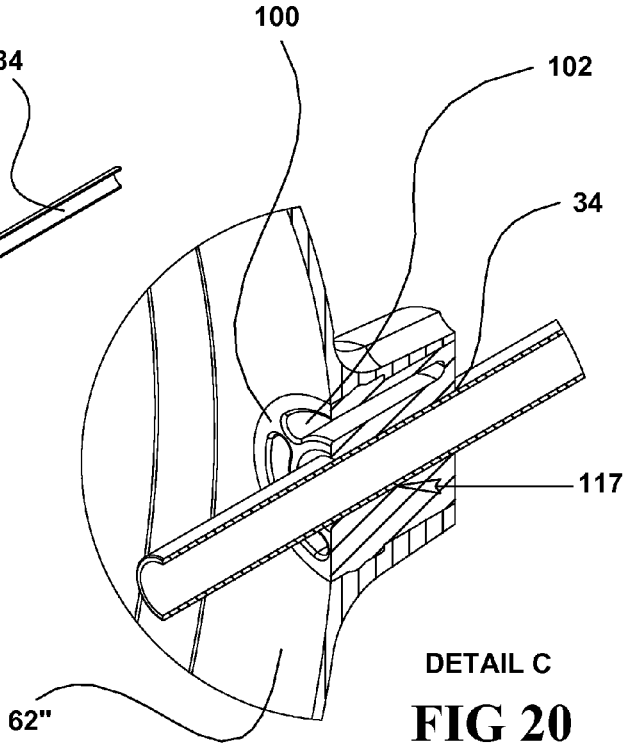
FIG. 20 is an enlarged, partial sectional perspective view of the encircled portion of FIG. 19, which includes a portion of the rectangular spray deflector shield, the cored insert, and a portion of the generally straight tubular member, according to an embodiment of the invention.
Figure 21:
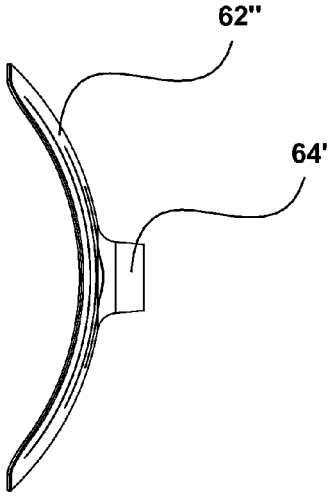
FIG. 21 is a side view of the rectangular spray deflector shield, according to an embodiment of the invention.
Figure 22:
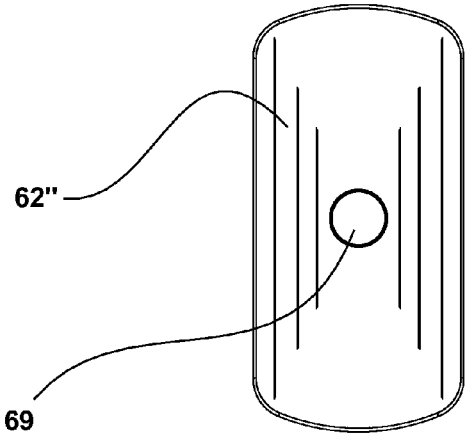
FIG. 22 is a front view of the rectangular spray deflector shield, according to an embodiment of the invention.
Figure 23:
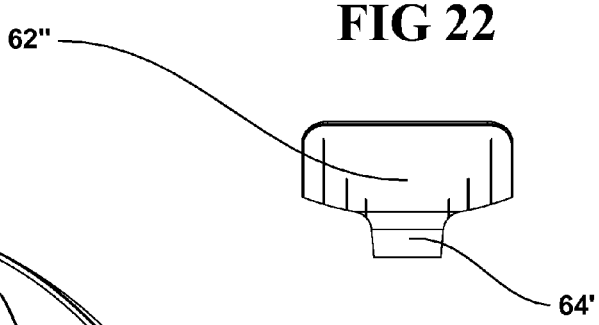
FIG. 23 is a bottom view of the rectangular spray deflector shield, according to an embodiment of the invention.

In one or more embodiments, referring again to FIGS. 17-24, the at least one insert adapter member (e.g., cored insert 100 with a plurality of arc-shaped cavities 102 disposed therein—FIGS. 17 and 20), which is configured to engage the tubular member 34 of the spray bottle or aerosol spray can, and is received within the insert aperture 69 of the collar portion, includes one or more annular projections 101 for engaging with one or more respective grooves 103 in the insert aperture 69 of the collar portion 64' (see e.g., FIGS. 23 and 24). In some embodiments, the at least one insert adapter member 100 comprises a plurality of insert adapter members that are capable of being interchangeably and removably engaged with the one or more respective grooves 103 in the insert aperture 69 of the collar portion 64', the plurality of insert adapter members being configured to accommodate tubular members of spray bottles or aerosol cans having varying diameters.

In FIG. 113, a plurality of nozzle adapters 164, 164', 164", and 164''' are illustrated. These nozzle adapters 164, 164', 164", and 164''' allow adaptation of a non-swivel, or swivel deflector, with or without the mini or cored insert to adapt to a variety of conventional aerosol or plastic bottle spray nozzles. For example, a round diameter to a square cavity, a round to round adaptation of different diameters. Truncated geometry of adapters would further allow any combination of; square, round, tapered, straight, pyramidal shape, or stepped geometry, to allow many combinations of fitment adapters to convert a; deflector member, deflector mounting member, mini, or cored interchangeable inserts, whether slip-on or clip on features are used.

Figure 103:
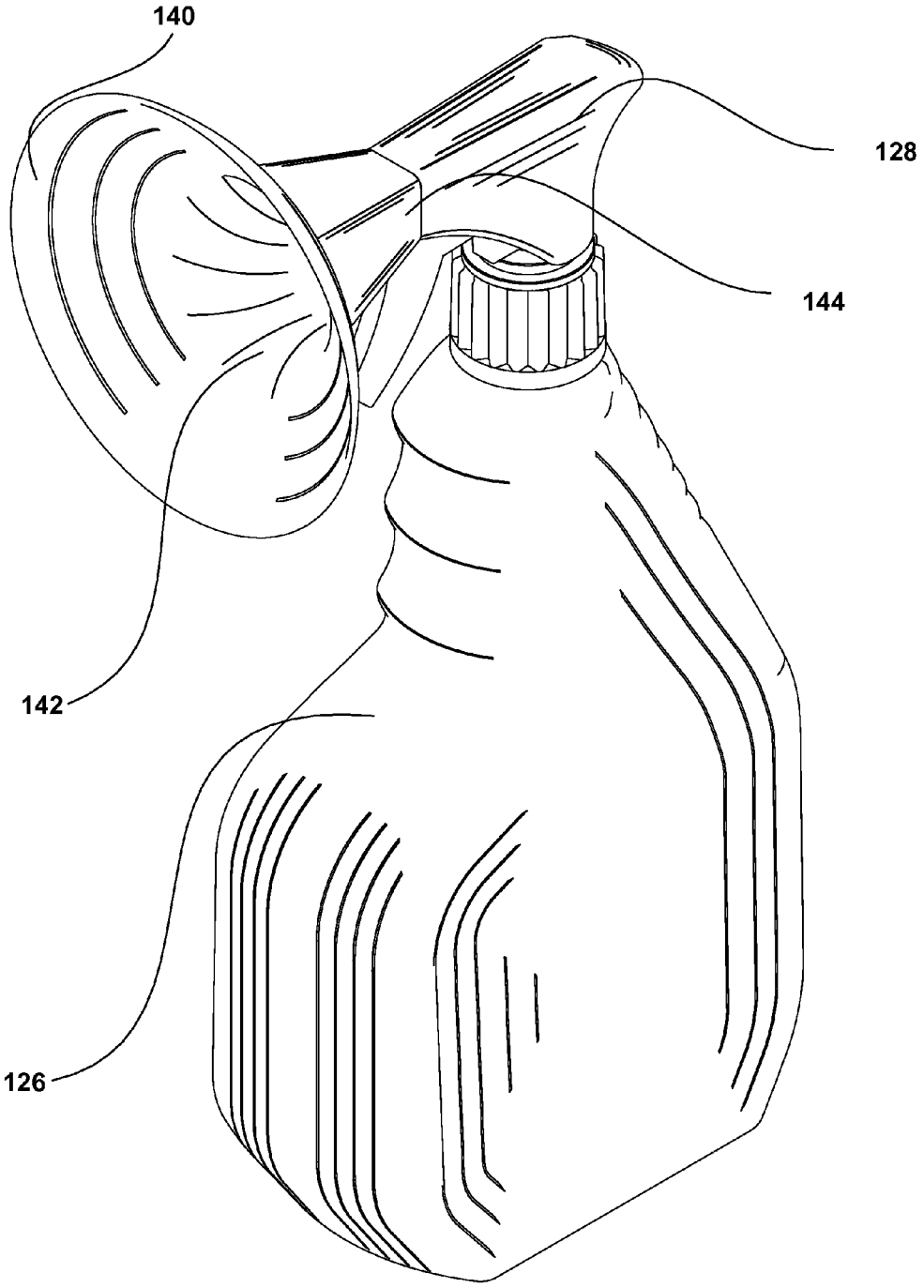
FIG. 103 is a perspective view of a flat-body spray bottle having a trumpet-style spray deflector shield installed thereon, wherein the trumpet-style spray deflector shield is press-fitted over an existing nozzle of the flat-body spray bottle, according to an embodiment of the invention.
Figure 104:
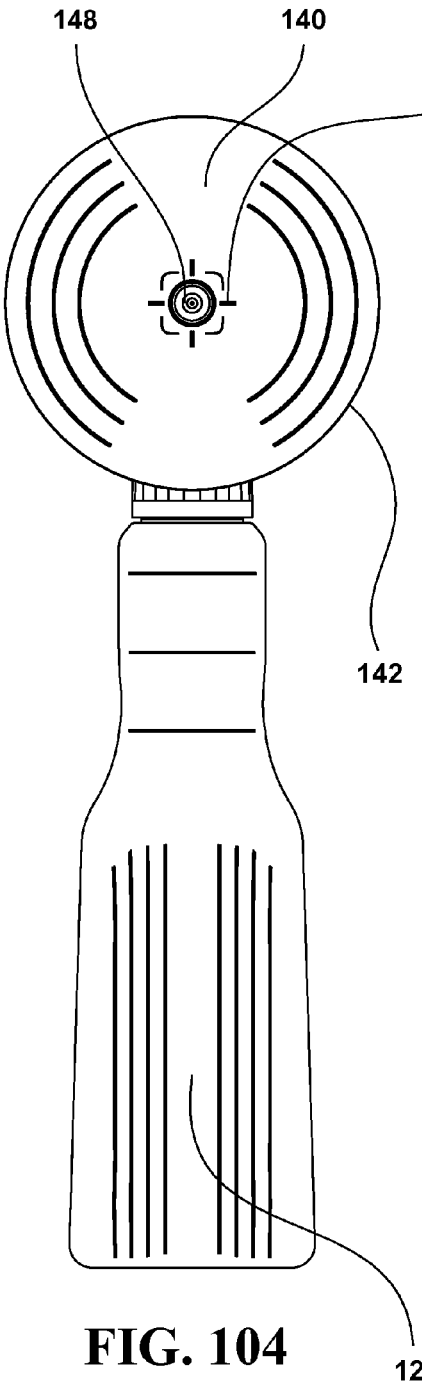
FIG. 104 is a front view of the flat-body spray bottle having the trumpet-style spray deflector shield installed thereon, wherein the trumpet-style spray deflector shield has a built-in retrofit nozzle which replaces the existing nozzle of the flat-body spray bottle, according to an embodiment of the invention.
Figure 105:
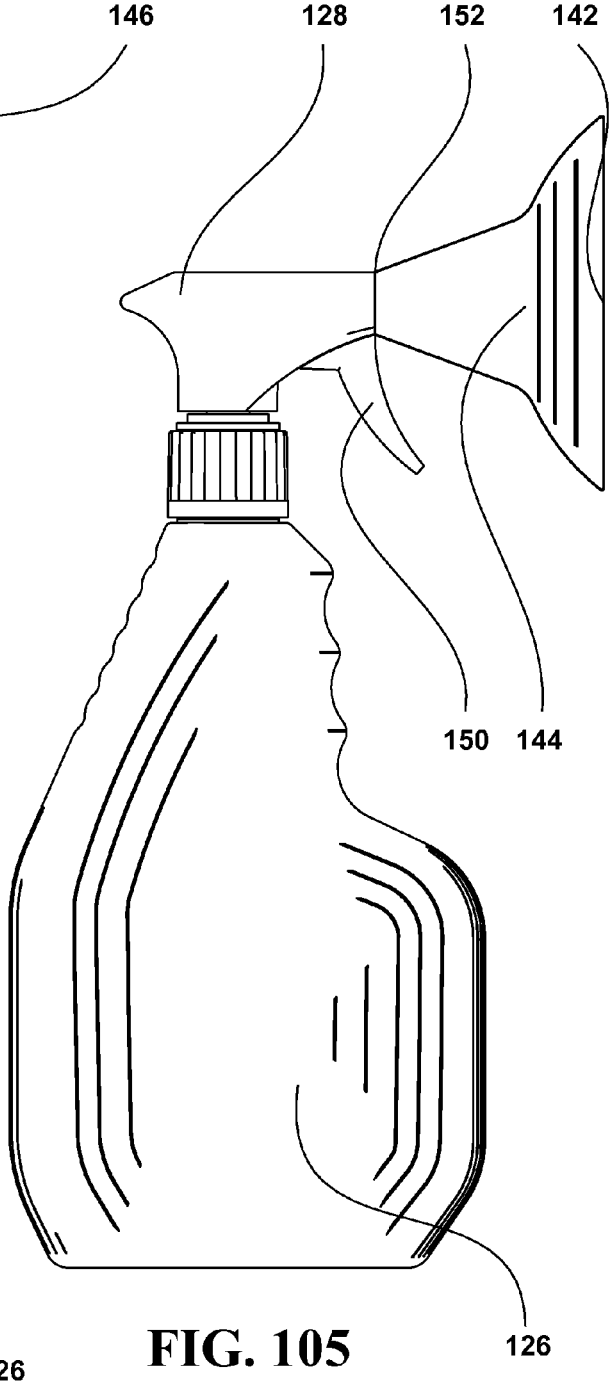
FIG. 105 is a left side view of the flat-body spray bottle having the trumpet-style spray deflector shield installed thereon, wherein the trumpet-style spray deflector shield has a built-in retrofit nozzle which replaces the existing nozzle of the flat-body spray bottle, according to an embodiment of the invention.
Figure 106:
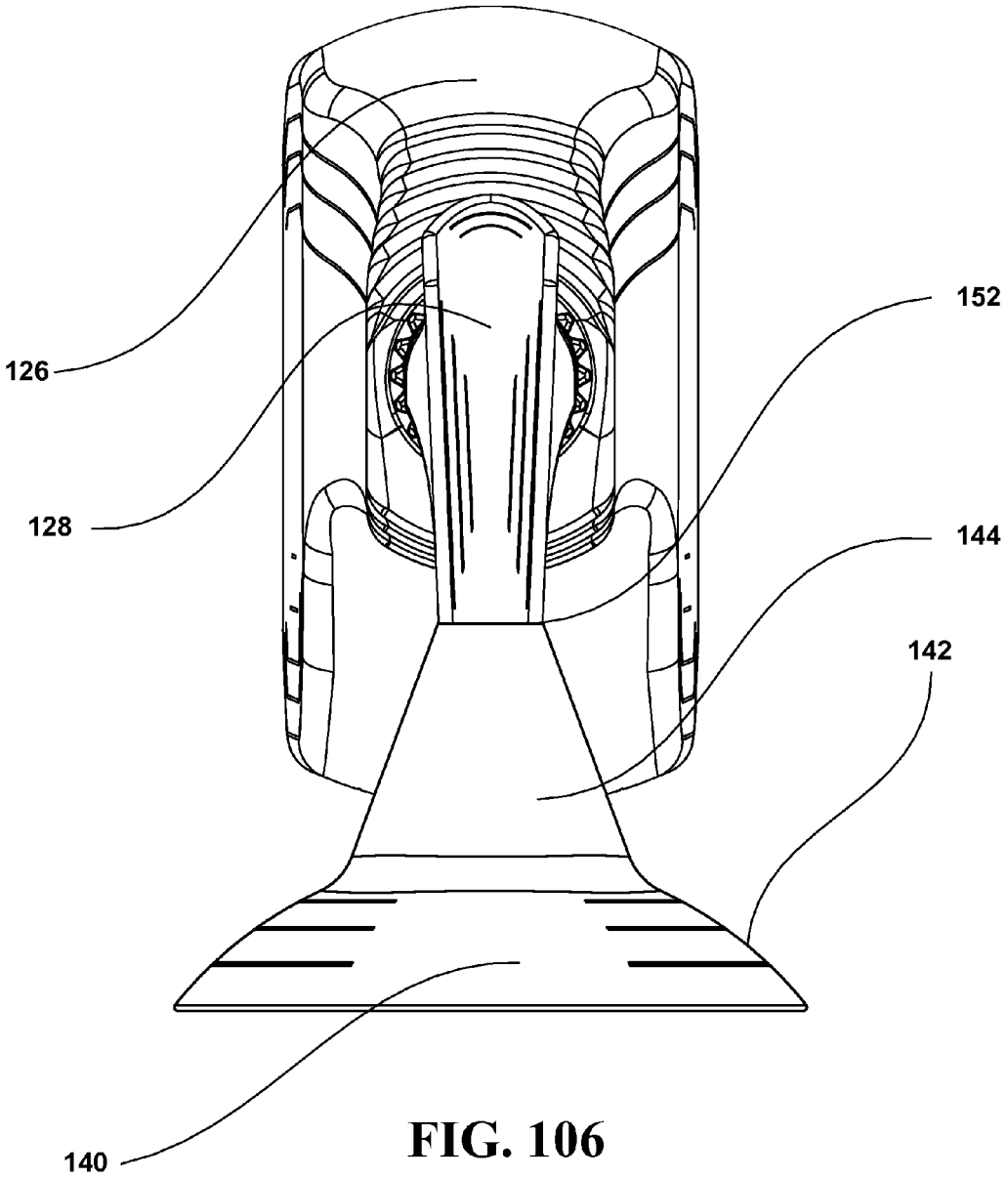
FIG. 106 is a top view of the flat-body spray bottle having the trumpet-style spray deflector shield installed thereon, wherein the trumpet-style spray deflector shield has a built-in retrofit nozzle which replaces the existing nozzle of the flat-body spray bottle, according to an embodiment of the invention.
Figure 107:
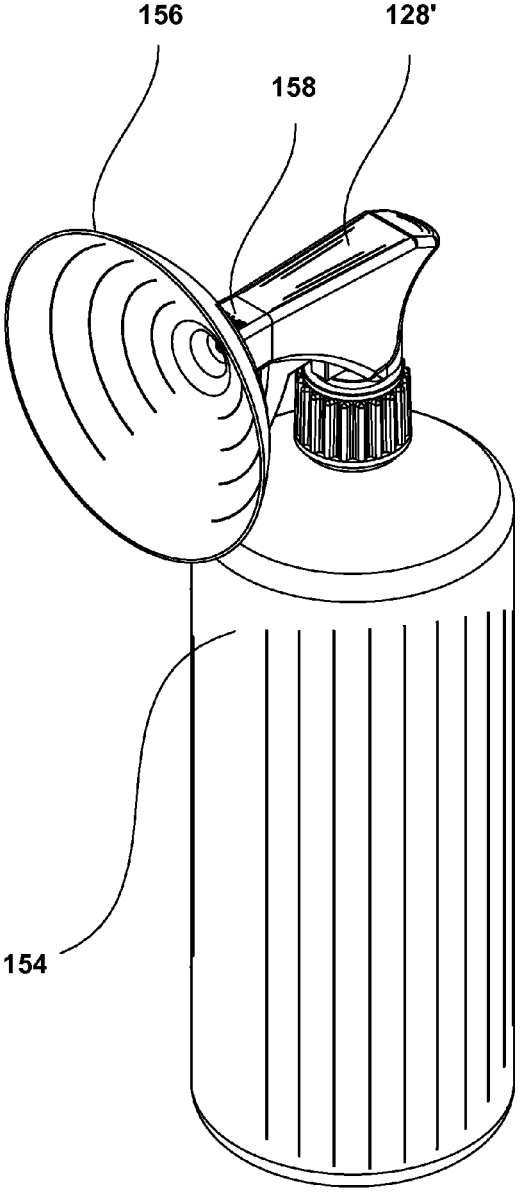
FIG. 107 is a perspective view of a cylindrical spray bottle having a non-swivel, circular deflector shield installed thereon, wherein the non-swivel, circular deflector shield is press-fitted over an existing nozzle of the cylindrical spray bottle, according to an embodiment of the invention.
Figure 108:
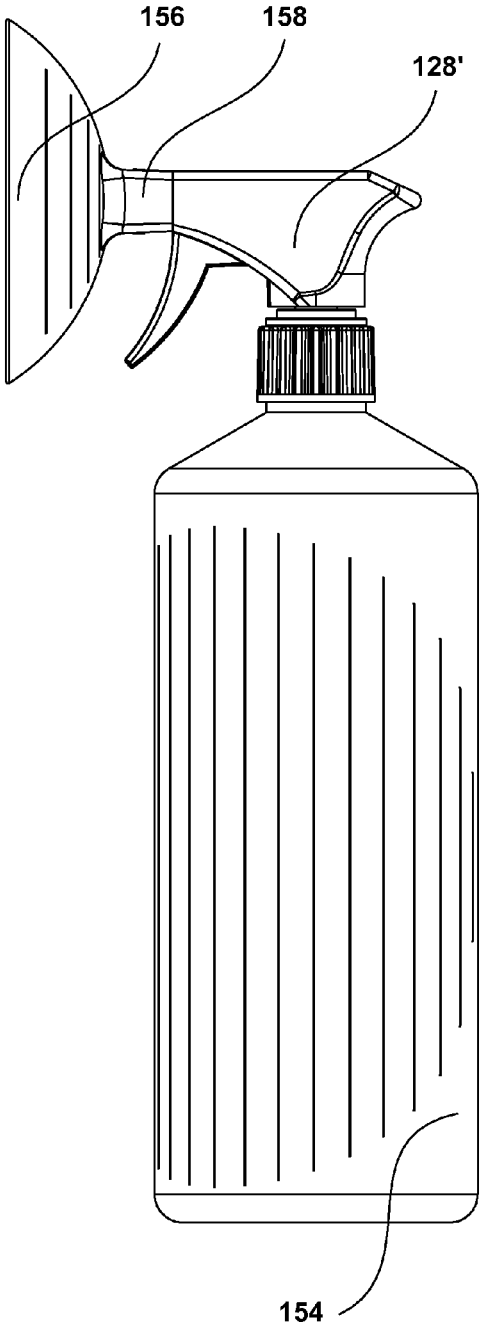
FIG. 108 is a right side view of the cylindrical spray bottle having the non-swivel, circular deflector shield installed thereon, wherein the non-swivel, circular deflector shield is press-fitted over the existing nozzle of the cylindrical spray bottle, according to an embodiment of the invention.

In another embodiment, referring to FIGS. 103-111, a portion of an aperture in a collar portion 144, 158 has a geometric configuration that corresponds to an external shape of a nozzle 148 on a spray bottle (e.g., flat-body spray bottle 126 or round spray bottle 124, 154), wherein the portion of the aperture of the collar portion 158 is configured to engage with the nozzle 148 on the spray bottle 126, 154. As shown in FIG. 103, a trumpet-style spray shield 140 is fitted over a conventional spray nozzle 148 of a spray assembly 128 provided on a spray bottle 126, additionally the trumpet style or any configured deflector member may include a one-piece "molded-in" nozzle (see FIGS. 104-106 and 161-162), whereby an existing nozzle is removed from a spray assembly (see FIGS. 163 and 164) by pulling off the existing nozzle as diagrammatically represented by arrow 161, and is replaced by one or more of different shaped deflectors with molded-in nozzle features. In FIG. 163, it can be seen that a small seam 152' exists between the existing nozzle 148 and the spray trigger assembly, which can be helpful in removing this existing nozzle 148. In FIG. 105, it can be seen that the trumpet-style spray shield 140 is fitted to the spray assembly 128 with spray trigger 150 such that only a very narrow seam 152 exists between the spray assembly 128 and the trumpet-style spray shield 140. The trumpet-style spray shield 140 generally comprises a circular concave deflection portion 142 and a flared collar portion 144 that extends from the conventional spray nozzle 148 to the deflection portion 142 (i.e., the collar portion 144 has a generally pyramidal shape, i.e., a pyramid with a truncated top). Also, to assist in the alignment of the trumpet-style spray shield 140 with the convention nozzle 148, the front face of the deflection portion 142 is provided with a plurality of indicia marks 146 disposed in a pattern thereon (e.g., four (4) indicia marks spaced 90 degrees apart).

Another embodiment of the slip-over type spray shield deflection device is illustrated in FIGS. 107-111. In this embodiment, a spray shield deflection device comprising a circular, non-swiveling type spray shield 156 and a collar or flange portion 158 is inserted over the conventional nozzle of a spray assembly 128'. The circular, non-swiveling type spray shield 156 has a circular peripheral edge 162. As diagrammatically indicated by the arrow 160 in FIG. 109, the collar or flange portion 158 of the spray shield deflection device slides over the conventional nozzle of the spray assembly 128', and remains in place thereon by means of slight friction fit engagement therewith. Also, as best illustrated in the detail view of FIG. 111, an upper surface of the collar or flange portion 158 is preferably provided with indicia inscribed thereon (e.g., "SPRAY" "STREAM", or "OFF") to facilitate the proper orientation of the spray shield deflection device on the conventional nozzle.

Figure 65:
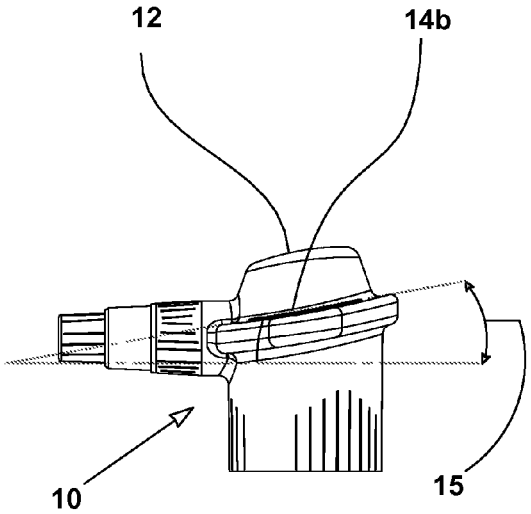
FIG. 65 is a right side view of a nozzle member, according to an embodiment of the invention.
Figure 66:
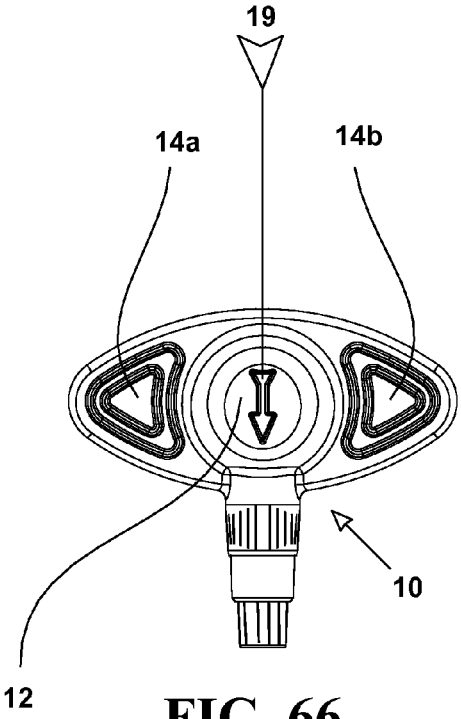
FIG. 66 is a top view of the nozzle member, according to an embodiment of the invention.

As described above, the spray system illustrated in FIGS. 1-7, comprises a nozzle member 10 in addition to the spray deflector member. Now, with particular reference to FIGS. 65-70, the details of the nozzle member 10 will be explained. In one or more embodiments, the nozzle member 10 comprises at least one finger pad 12, 14*a*, 14*b* for accommodating a finger of a user. Preferably, as shown in FIGS. 66, 67, 69, and 70, the at least one finger pad comprises a plurality of finger pads 12, 14*a*, 14*b*, two of the plurality of finger pads 14*a*, 14*b* being disposed on opposite sides of the nozzle member 10 and being downwardly sloped (see e.g., FIG. 65) in a general direction of a spray discharge stream so as to ergonomically accommodate fingers of a user. As illustrated in FIG. 65, each of the side finger pads 14*a*, 14*b* are disposed at an acute angle 15 relative to horizontal reference plate so as to generally slope downwardly towards the discharge outlet of the nozzle member 10. In FIG. 70, it can be seen that each side finger pad 14*a*, 14*b* is preferably provided with an inner projection loop 16 and an outer projection loop 18 on the top surface thereof for enhancing the engagement between a user's finger(s) and the top surface of the side finger pads 14*a*, 14*b*. The center finger pad 12 of the nozzle member 10, which is disposed between the two side finger pads 14*a*, 14*b*, is elevated above each of the two side finger pads 14*a*, 14*b* (see e.g., FIG. 67). Also, in order to clearly indicate the direction of flow emanating from the nozzle member 10, a nozzle flow arrow 19 is preferably imprinted on the center finger pad 12 (see FIGS. 66-67).

Figure 67:
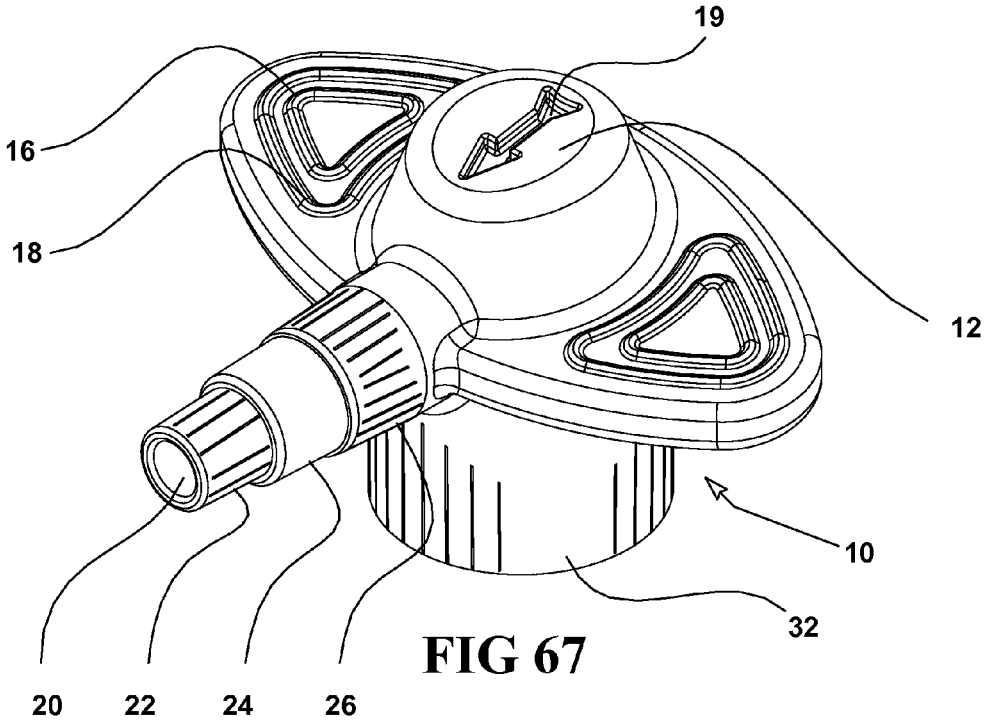
FIG. 67 is a perspective view of the nozzle member, according to an embodiment of the invention.
Figure 68:
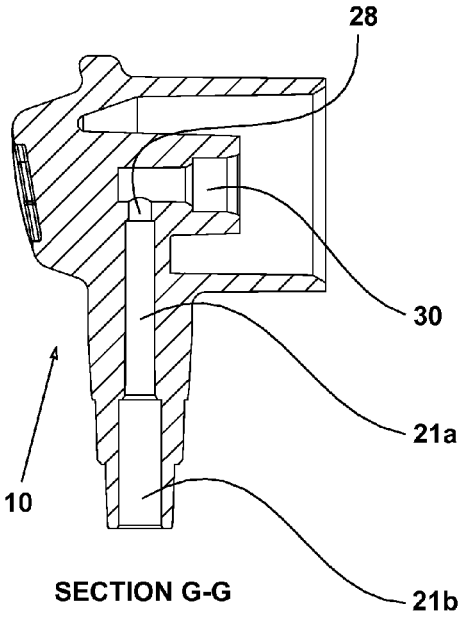
FIG. 68 is a sectional side view of the nozzle member, according to an embodiment of the invention, which is cut along the cutting-plane line G-G in FIG. 69.
Figure 69:
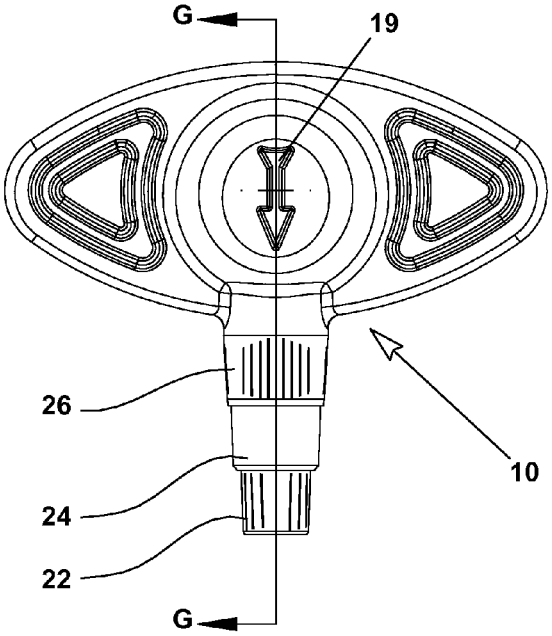
FIG. 69 is another top view of the nozzle member, according to an embodiment of the invention.
Figure 70:
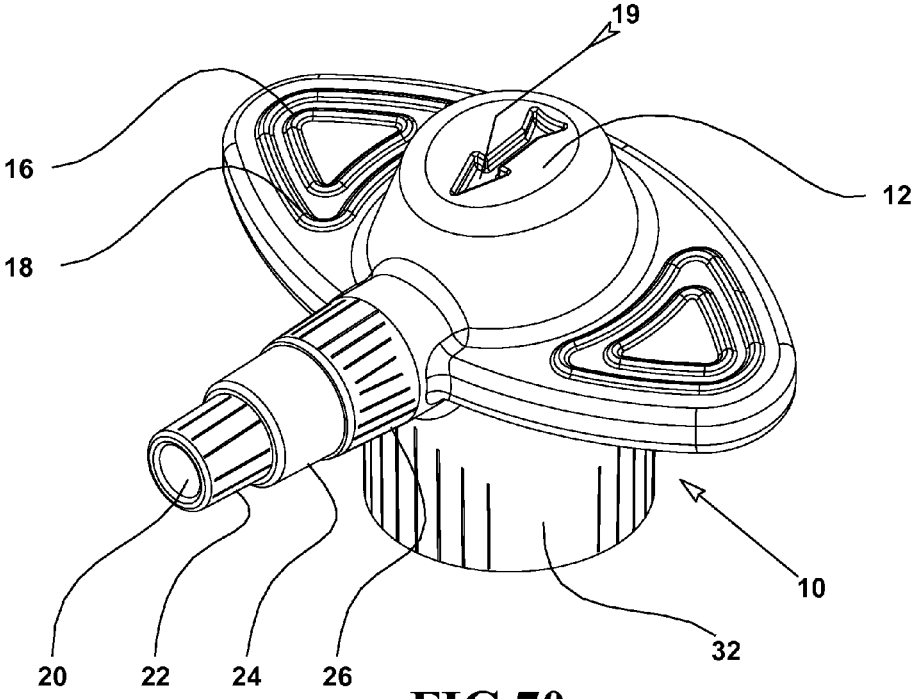
FIG. 70 is another perspective view of the nozzle member, according to an embodiment of the invention.
Figure 71:
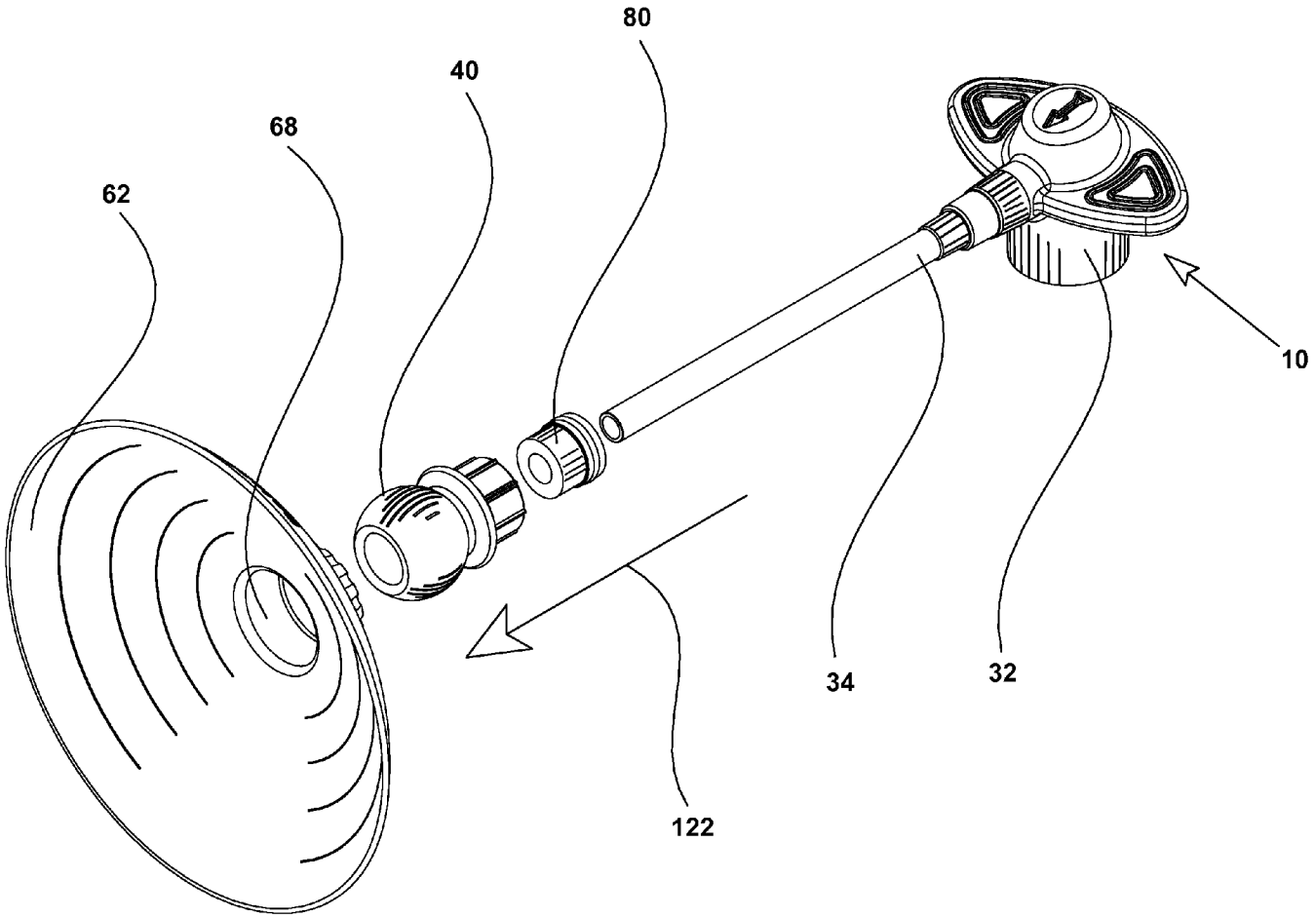
FIG. 71 is an exploded front-right perspective view of a circular spray deflector shield, a deflector mounting member with a ball-shaped male portion, an adapter cored-insert, and a generally straight tubular member inserted into a spray nozzle, according to an embodiment of the invention.
Figure 72:
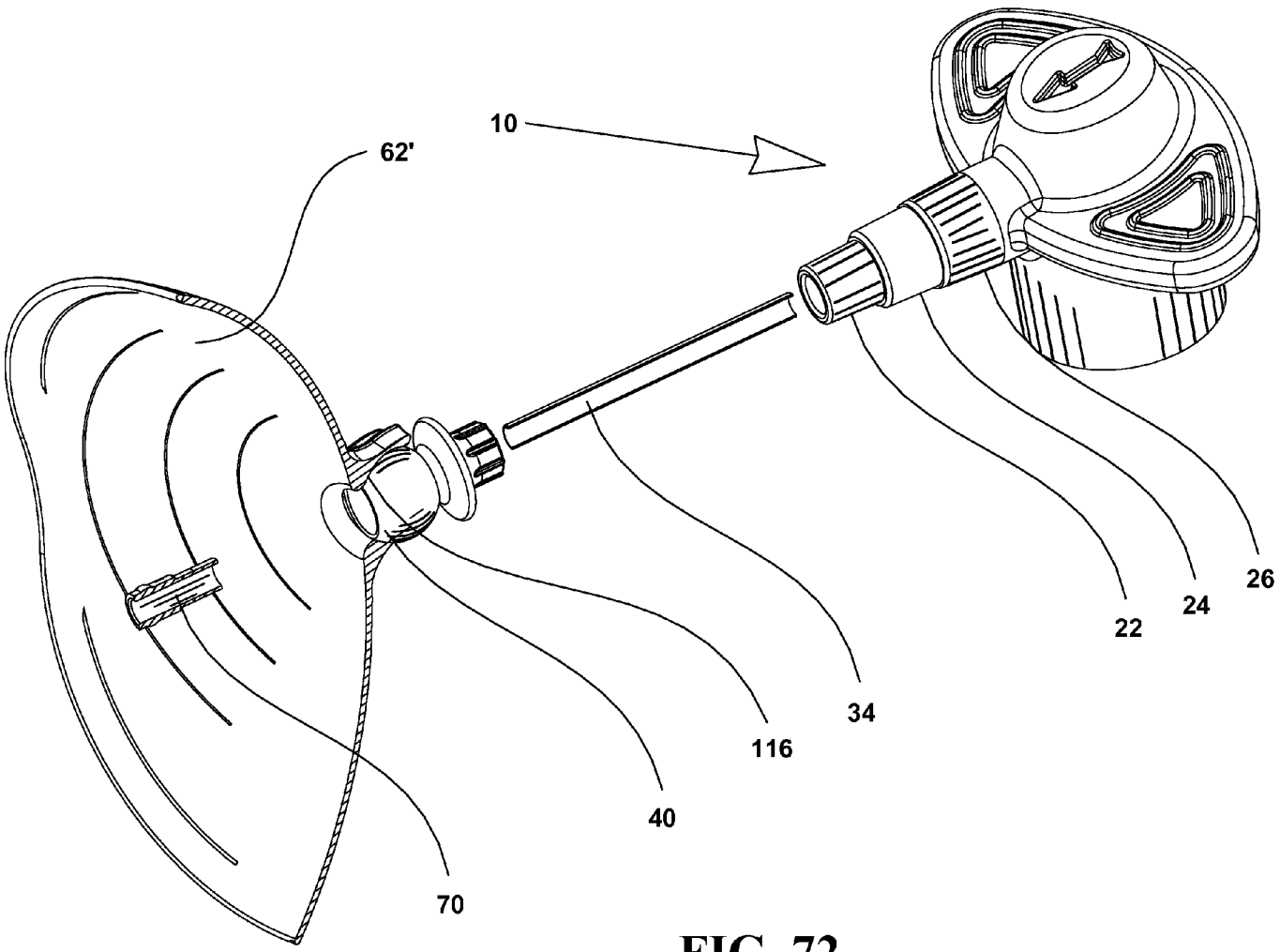
FIG. 72 is a partial cutaway front-right perspective view of an oval-shaped spray deflector shield, a deflector mounting member with a ball-shaped male portion, an adapter mini-insert, and a generally straight tubular member, and a spray nozzle according to an embodiment of the invention.

Next, with reference to FIGS. 67-70, the construction of the discharge outlet of the nozzle member 10 will described. As best illustrated in FIGS. 67, 69, and 70, the discharge outlet of the nozzle member 10 comprises a plurality of frustoconical sections 22, 24, 26 with varying outer diameters configured to accommodate tubular members (e.g., deflector inlet tubing 34) having varying inner diameters. The frustoconical sections 22, 24, 26 increase in size front-to-back, and circumscribe an outlet bore 20. For example, a deflector inlet tubing 34 would be slipped over one of the frustoconical sections 22, 24, 26 that best corresponds to its inner diameter. In order to accommodate smaller diameter deflector inlet tubing 34 as well, in one or embodiments, outlet bore 20 of the nozzle member 10 comprises a plurality of sections (e.g., small orifice bore 21*a*, large orifice bore 21*b*) with varying inner diameters configured to accommodate tubular members (e.g., deflector inlet tubing 34) having varying outer diameters. In this case, the deflector inlet tubing 34 would be received inside of one of the orifice bores 21*a*, 21*b*. For the purpose of abutting the end of the deflector tubing (and stopping the further movement thereof into the nozzle member 10), the small orifice bore 21*a* is provided with an abutment face 56", while the large orifice bore 21*b* is provided with an abutment face 56". Now, with particular reference to FIG. 68, the other internal fluid passageways of the nozzle member 10 will be described. As shown in this figure, an inlet bore 30 is disposed internally within the cylindrical base portion 32 of the nozzle member 10. The inlet end of the inlet bore 30 is preferably flared (bell-shaped) so as to facilitate the insertion of the tube stem of the aerosol spray can into the inlet bore 30. Also, in FIG. 68, it can be seen that the outlet inner passageway 28 fluidly couples the inlet bore 30 of the nozzle member 10 to the small orifice bore 21*a* of the nozzle member 10. As shown in FIG. 154, the frustoconical sections 22, 24, 26 and internal bores 21*a*, 21*b* of the nozzle member 10 can be used to accommodate outlet deflector tubing 176, 176', 176", 176'", 176"", and 176""" of various lengths and diameters.

In one or more other embodiments, a nozzle member is provided in the form of a retrofit replacement nozzle 130, 170 that is configured to replace a conventional nozzle of a spray bottle 154 (e.g., see FIGS. 102, 118-121 and 148-153). The nozzle member additionally may be configured to suit most any existing nozzle configurations, and, or have designated features of special applications to fit newly designed nozzle features. The retrofit replacement nozzle 170 is sized to correspond to at least some of the dimensions of the conventional (existing) nozzle on the spray bottle 154 so that the retrofit replacement nozzle is capable of easily replacing the conventional (existing) nozzle. In the illustrative embodiments of FIGS. 148-153, the retrofit replacement nozzle 170 includes a deflector mounting portion with a male portion (i.e., ball portion 182). Turning to FIG. 157, it can be seen that the male portion (i.e., ball portion 182) of the retrofit replacement nozzle 170 matingly engages with a female socket 198 provided in a collar portion 180, 194 of a spray deflector member (i.e., spray shield). Preferably, the collar portion 194 is integrally formed with a deflector portion 174 of the spray deflector member (i.e., spray shield). While the deflector portion 174 is generally circular in shape, it is to be understood that the deflector portion can be formed using other suitable shapes as well, such as oval (deflector portion 174'—see e.g., FIGS. 120-124 and 140), rectangular with a curved top and bottom (deflector portion 174"—see e.g., FIGS. 126, 127, and 140), rectangular with sidewalls (deflector portion 174'"—see e.g., FIG. 140), and rectangular without sidewalls (deflector portion 174""—see e.g., FIG. 140).

Additional features of various replacement nozzles are illustrated in FIGS. 148-153. In FIGS. 148-150, the ball portion 182 of the replacement nozzle 170" is provided with a wide mouth bore 212. Advantageously, the wide mouth bore 212 permits a wide spray pattern of a spray bottle to be unobstructed by the use of the replacement nozzle 170" thereon. The nozzle portion 108 of the replacement nozzle 170" is provided with molded portions 108' that substantially conform to the geometry of the spray assembly on the existing spray bottle, as well as a flange portion 202 that is designed to abut the existing spray assembly structure. Other replacement nozzles 170' and 170'" are shown in FIG. 115. The replacement nozzle 170" of FIGS. 148-150 further comprises a cylindrical portion 200 connecting the flange portion 202 on the nozzle portion 108 to the ball portion 182. Also, as shown in the side sectional view of FIG. 148, an orifice 210 fluidly connects the inlet bore of the nozzle 170" to the wide mouth outlet bore 212. Another design for a wide mouth bore 212' is illustrated in FIG. 157 for the slip-on type deflector mounting member 41. As shown in FIG. 144, when the nozzle 170" is slid into place (i.e., in the direction 208) on the spray assembly 128, the replacement nozzle 170" closely abuts the spray assembly 128 such that only a very narrow seam 152" exists between the spray nozzle trigger and the nozzle 170". The replacement nozzle design of FIGS. 151-153 is similar in some respects to the nozzle 170" of FIGS. 148-150. The primary difference between the two nozzle designs is that the replacement nozzle in FIGS. 151-153 has a cylindrical outlet boss 186 provided in the center of the outlet bore thereof. In FIG. 151, it can be seen that the cylindrical outlet boss 186 is internally provided with a smaller diameter inner bore 184' and a larger diameter outlet bore 184". The smaller diameter inner bore 184' is provided immediately downstream of an orifice 210, and the larger diameter outlet bore 184" is provided immediately downstream of the smaller diameter inner bore 184'. The inner bore 184', 184" are configured to receive a tubular member 34 in a friction fit engagement 188'. As shown in FIG. 119, the cylindrical outlet boss 186 of the replacement nozzle can be used to accommodate outlet deflector tubing (e.g., bendable outlet deflector tubing 178, 178', 178") having various lengths and diameters (e.g., by inserting the tubing inside the boss 186 or fitting the tubing over the boss 186). A similar cylindrical outlet boss 186 with outlet bore 184 is shown in FIG. 142. In FIG. 142, it can be seen that the cylindrical outlet boss 186 of the replacement nozzle is surrounded by a cylindrical bore cavity 186'. The ball portion 182 of the replacement nozzle in FIG. 142 engages the shield socket in a friction fit 188.

As shown in FIGS. 128-130, in some embodiments, the cylindrical outlet boss 186 of the replacement nozzle is configured to receive a slip-on type deflector member 190 with deflector portion 192 and collar portion 194, wherein a friction fit engagement 196 is formed between the collar 194 of the slip-on type deflector member 190 and the cylindrical boss 186 of the replacement nozzle. While the deflector portion 192 is generally circular in shape, it is to be understood that the deflector portion can be formed using other suitable shapes as well (as shown in FIG. 129), such as oval (e.g., deflector portion 192') and rectangular (e.g., deflector portion 192"). Additionally any suitable shape that has a concaved surface structure, whether it be square, round, oval, triangular, rectangular, octagonal, pentagonal, could be used for the deflector member.

Additional embodiments of replacement nozzle are illustrated in FIGS. 138-141 and 161-162. Initially, referring to FIG. 138, it can be seen that a replacement nozzle portion 108 is provided with a cylindrical boss that receives a detachable shaft or tubular portion 106 therein. As shown in FIG. 141, the replacement nozzle portion 108 closely abuts the spray assembly 128 such that only a very narrow seam 152' exists between the spray nozzle trigger and the retrofit nozzle 108 with the cylindrical boss. The shaft portion 106 allows an adapter insert 166, or a larger cored insert to be attached thereto. The adapter insert 166 is removably attached interior within a deflector mounting member 40, which accommodates a spray deflector member with deflector portion 174 to be coupled thereto. Other adapter inserts 166', 166" are illustrated in FIG. 113. In FIGS. 161-162, a one-piece trumpet-style deflector shield and replacement nozzle is shown. The one-piece trumpet-style deflector shield and replacement nozzle is configured to replace a conventional (existing) nozzle on a spray bottle.

In one or more additional embodiments, the retrofit replacement nozzle is in the form of a one-piece nozzle and deflector mounting member 104 (refer to FIGS. 37-48). As shown in these figures, the one-piece nozzle and deflector mounting member 104 generally comprises a nozzle portion 108, a shaft portion 106, and a deflector mounting portion (i.e., ball portion 110). The nozzle portion 108 of the one-piece nozzle and deflector mounting member 104 is configured to be fluidly coupled to the fluid discharge passageway of a spray bottle or aerosol spray can (i.e., the inlet bore 114 of the nozzle portion 108 receives the tube stem of the spray bottle or aerosol spray can). As best shown in the sectional views of FIGS. 40, 42, and 44, the shaft portion 106 of the one-piece nozzle and deflector mounting member 104 has a fluid passageway disposed therethrough, and both structurally and fluidly connects the nozzle portion 108 to the deflector mounting portion (i.e., ball portion 110). As illustrated in the sectional views of FIGS. 40 and 42, the deflector mounting portion includes a male portion (i.e., ball portion 110) for matingly engaging with a female socket 68 provided in the collar portion 64 of the spray deflector member so as to form friction fit ball joint 116 therewith. In order to structurally enhance the connection between the shaft portion 106 and the nozzle portion 108, a pair of shaft gusset plates 112 are provided on opposed sides of the shaft portion 106 at its connection to the nozzle portion 108 (refer to FIG. 39).

It is readily apparent that the aforedescribed spray shield devices and spray systems including the same offer numerous advantages. First, the spray shield devices are capable of deflecting spray that is reflected from a target so as to prevent accidental bodily harm to a user thereof. Moreover, the spray shield devices in various embodiments described above are capable of being easily adjusted, or interchangeable by a user thereof so that spray surfaces having various orientations can be easily accommodated. Furthermore, the various embodiments of the spray system explained above, which include a nozzle member and the spray shield device, can be easily retrofitted on existing spray bottle and aerosol cans.

The following is a list of reference characters that are utilized in the drawings of this application together with the components that they are used to represent:

10 Spray Nozzle with Multiple Finger Pads
12 Center Finger Pad of Nozzle
**14*a*** First Side Finger Pad of Nozzle
**14*b*** Second Side Finger Pad of Nozzle
15 Angle of Side Finger Pad
16 Inner Projection Loop of Side Finger Pad
18 Outer Projection Loop of Side Finger Pad
19 Nozzle Flow Arrow
20 Outlet Bore of Nozzle
**21*a*** Small Orifice Bore of Spray Nozzle
**21*b*** Large Orifice Bore of Spray Nozzle
22 First Frustoconical Section of Nozzle Outlet
24 Second Frustoconical Section of Nozzle Outlet
26 Third Frustoconical Section of Nozzle Outlet
28 Outlet Inner Passageway of Nozzle
30 Inlet Bore of Nozzle
32 Cylindrical Base of Nozzle
34 Deflector Inlet Tubing
34' Deflector Inlet Tubing (Smaller Diameter)
34" Deflector Inlet Tubing (Smaller Diameter)
34'" Deflector Inlet Tubing (Smaller Diameter)
34"" Deflector Inlet Tubing (Smaller Diameter)
34'"" Deflector Inlet Tubing (Smaller Diameter)

35 Deflector Tubing (First Length)
35' Deflector Tubing (First Length)
35" Deflector Tubing (First Length)
35''' Deflector Tubing (First Length)
35'''' Deflector Tubing (First Length)
36 Deflector Inlet Tubing Elbow
38 Deflector Outlet Tubing
39 Elbow of Deflector Outlet Tubing
40 Deflector Mounting Member
40' Deflector Mounting Member (First Variation)
40" Deflector Mounting Member (Second Variation)
40''' Deflector Mounting Member (Third Variation)
40'''' Deflector Mounting Member (Fourth Variation)
40''''' Deflector Mounting Member (Fifth Variation)
41 Deflector Slip-on Mounting Member
42 Ball Portion of Deflector Mounting Member
43 Insert Engagement Groove of Deflector Mounting Member Cavity
44 Finger Grip Portion of Deflector Mounting Member
46 Collar of Deflector Mounting Member
48 Outlet Bore of Deflector Mounting Member
50 Finger Grip Projections of Deflector Mounting Member
52 Insert Engagement Groove of Deflector Mounting Member
54 Inner Passageway of Deflector Mounting Member
56 Insert Abutment of Deflector Mounting Member
56' Abutment Face of Deflector Mounting Member
56" Abutment Face of Small Orifice Bore of Spray Nozzle
56''' Abutment Face of Large Orifice Bore of Spray Nozzle
56'''' Mini-Insert Abutment Face
58 Inlet Bore of Deflector Mounting Member
58' Inlet Bore of Deflector Mounting Member for Receiving Cored Insert
59 Insertion Arrow for Insertion of Ball in Socket
60 Spray Deflector Member
60' Spray Deflector Member (Non-Swivel Type)
61 Insert of Non-Swivel Type Spray Deflector Member
61*a* Insert of a "Swivel" Type Spray Deflector Member
62 Deflector Portion of Spray Deflector Member (Round Shield)
62' Deflector Portion of Spray Deflector Member (Oval Shield)
62" Deflector Portion of Spray Deflector Member (Non-Swiveling Rectangular
Shield)
62''' Deflector Portion of Spray Deflector Member (Rectangular Shield with Sidewalls)
62'''' Deflector Portion of Spray Deflector Member (Rectangular Shield with no Sidewalls)
63 Finger Grip Portion of Insert (Non-Swivel Type Spray Deflector Member)
64 Collar Portion of Spray Deflector Member
64' Collar Portion of Non-Swivel Type Spray Deflector Member
65 Shield Side Wall
66 Finger Grip Projections of Spray Deflector Member
67 Direction of Rotation of Shield
68 Socket of Spray Deflector Member
69 Insert Aperture in Non-Swivel Type Spray Deflector Member
70 Mini-Insert Adapter for Deflector Mounting Member
71 Direction of Insertion for Mini-Insert
72 Fluid Passageway of Mini-Insert Adapter
74 Annular Projection of Mini-Insert Adapter
76 Outlet Section of Mini-Insert Adapter
77 Collar Portion of Mini-Insert Adapter
78 Inlet Section of Mini-Insert Adapter
80 Cored-Insert Adapter for Deflector Mounting Member
81 Direction of Insertion for Cored-Insert
82 Fluid Passageway of Cored-Insert Adapter
84 Annular Projection of Cored-Insert Adapter
86 Collar Portion of Cored-Insert Adapter
88 Arc-Shaped Cavity of Cored-Insert Adapter
90 Aerosol Spray Can
92 Blow-Back Spray
94 Wooden Beam
96 Curved Passageway in Wooden Beam
98 Engine
100 Cored Insert for Non-Swiveling Deflector Shield
101 Annular Projection of Insert
102 Arc-Shaped Cavity of Cored-Insert for Non-Swiveling Deflector Shield
103 Engagement Groove of Annular Projection
104 One-Piece Nozzle and Deflector Mounting Member
106 Shaft Portion of One-Piece Nozzle and Deflector Mounting Member
108 Nozzle Portion of One-Piece Nozzle and Deflector Mounting Member
108' Nozzle Replacement Molded
110 Ball Portion of One-Piece Nozzle and Deflector Mounting Member
112 Shaft Gusset Plate of One-Piece Nozzle and Deflector Mounting Member
114 Inlet Bore of One-Piece Nozzle and Deflector Mounting Member
116 Friction Fit Ball Joint
117 Friction Fit Inner Diameter of Insert (small or cored)
118 Cavities in Collar of Non-Swivel Type Spray Deflector Member
120 Sliding Movement of Tube Relative to Shield Collar Aperture
122 Assembly Direction of Components
124 Cylindrical Plastic Spray Bottle
126 Flat Body Plastic Spray Bottle
128 Spray Assembly of Plastic Spray Bottle (First Variation)
128' Spray Assembly of Plastic Spray Bottle (Second Variation)
130 Retrofit Spray Nozzle with Ball Portion
140 Trumpet-Style Spray Shield Assembly
142 Deflector Portion of Trumpet-Style Spray Shield Assembly
144 Collar Portion of Trumpet-Style Spray Shield Assembly
146 Indicia Marks on Front of Trumpet-Style Spray Shield Assembly
148 Spray Nozzle of Trumpet-Style Spray Shield Assembly
150 Conventional Spray Nozzle Trigger on Plastic Spray Bottle
152 Seam between Conventional Spray Nozzle and Trumpet-Style Spray Shield Assembly
152' Seam between Spray Nozzle Trigger and Retrofit Nozzle with slip-on Boss
152" Seam between Replacement Nozzle/Deflector Mounting Member (Third Variation)
152" Seam between Conventional Spray Nozzle and Spray Trigger Assembly
154 Round Plastic Spray Bottle
156 Round, Non-Swiveling Type Spray Shield
158 Spray Shield Collar/Flange
160 Direction of Insertion/Removal of Spray Shield
161 Direction of Conventional Nozzle Removal from Spray Trigger Assembly

162 Peripheral Edge of Spray Shield
164 Nozzle Adapter (First Variation)
164' Nozzle Adapter (Second Variation)
164" Nozzle Adapter (Third Variation)
164'" Nozzle Adapter (Fourth Variation)
166 Insert for Plastic Spray Bottle (First Variation)
166' Insert for Plastic Spray Bottle (Second Variation)
166" Insert for Plastic Spray Bottle (Third Variation)
168 Deflector Mounting Member—Plastic Spray Bottle (First Variation)
168' Deflector Mounting Member—Plastic Spray Bottle (Second Variation)
168" Deflector Mounting Member—Plastic Spray Bottle (Third Variation)
170 Replacement Nozzle/Deflector Mounting Member (First Variation)
170' Replacement Nozzle/Deflector Mounting Member (Second Variation)
170" Replacement Nozzle/Deflector Mounting Member (Third Variation)
170'" Replacement Nozzle/Deflector Mounting Member (Fourth Variation)
172 Direction of Rotation of Shield
174 Deflector Portion of Rotatable Deflector Shield (Round Shield)
174' Deflector Portion of Rotatable Deflector Shield (Oval Shield)
174" Deflector Portion of Rotatable Deflector Shield (Rectangular Shield)
174'" Deflector Portion of Rotatable Deflector Shield (Rectangular Shield) with Sidewalls
174"" Deflector Portion of Rotatable Deflector Shield (Rectangular Shield) without Sidewalls
176 Outlet Deflector Tubing (First Variation)—Straight
176' Outlet Deflector Tubing (Second Variation)—Straight
176" Outlet Deflector Tubing (Third Variation)—Straight
176'" Outlet Deflector Tubing (Fourth Variation)—Straight
176"" Outlet Deflector Tubing (Fifth Variation)—Straight
176'"" Outlet Deflector Tubing (Sixth Variation)—Straight
178 Outlet Deflector Tubing (First Variation)—Bendable
178' Outlet Deflector Tubing (Second Variation)—Bendable
178" Outlet Deflector Tubing (Third Variation)—Bendable
180 Collar Portion of Spray Deflector Member
182 Ball Portion of Replacement Nozzle/Deflector Mounting Member
184 Outlet Bore of Replacement Nozzle/Deflector Mounting Member
184' Minor Inner Bore of Deflector Mounting Member
184" Major Inner Bore of Deflector Mounting Member
186 Cylindrical Outlet Boss of Replacement Nozzle/Deflector Mounting Member
186' Cylindrical Bore Cavity of Nozzle Deflector Mounting Member
188 Friction Fit between Ball Portion and Shield Socket
188' Friction Fit between Inner Bore and Tubular Part
190 Slip-on Type Spray Deflector Member
192 Deflector Portion of Slip-on Type Spray Deflector Member (Round Shield)
192' Deflector Portion of Slip-on Type Spray Deflector Member (Oval Shield)
192" Deflector Portion of Slip-on Type Spray Deflector Member (Rectangular Shield)
194 Collar Portion of Spray Deflector Member
194' Collar Portion of Spray Slip-on Deflector Member
196 Friction Fit between Slip-on Type Spray Deflector Member and Boss
196' Friction Fit between Slip-on Type Spray Deflector Member and Tube
198 Socket of Spray Deflector Member
200 Cylindrical Portion of Replacement Nozzle/Deflector Mounting Member
202 Flange Portion of Replacement Nozzle/Deflector Mounting Member
204 Circumferential Rotation of Spray Deflector Member
206 Engagement between Socket and Ball Portion
208 Direction of Insertion of Nozzle
210 Orifice of Replacement Nozzle Deflector Mounting Member
212 Wide Mouth Bore of Replacement Nozzle/Deflector Mounting Member
212' Wide Mouth Bore of Deflector Slip-on Mounting Member
214 Nozzle Orifice of the Spray Nozzle Although the invention has been shown and described with respect to a certain embodiment or embodiments, it is apparent that this invention can be embodied in many different forms and that many other modifications and variations are possible without departing from the spirit and scope of this invention.

Moreover, while exemplary embodiments have been described herein, one of ordinary skill in the art will readily appreciate that the exemplary embodiments set forth above are merely illustrative in nature and should not be construed as to limit the claims in any manner. Rather, the scope of the invention is defined only by the appended claims and their equivalents, and not, by the preceding description.

The invention claimed is:

1. A spray shield device configured to deflect spray that is reflected from a target, said spray shield device comprising:

spray tubing configured to convey a fluid dispensed from a spray bottle or an aerosol can;

a deflector mounting member configured to engage said spray tubing, said deflector mounting member including an inner passageway extending linearly along a length of said deflector mounting member, a section of said spray tubing configured to be received within said inner passageway of said deflector mounting member, said deflector mounting member further including a male portion circumscribing said inner passageway, said male portion of said deflector mounting member having a generally spherical or ball shape; and a spray deflector member including a concave deflector portion and a collar portion, said concave deflector portion comprising a front surface and a rear surface disposed opposite to said front surface, said collar portion comprising a female socket for matingly engaging with said male portion of said deflector mounting member, a discharge port downstream of said female socket, and an outer wall circumscribing said female portion, said rear surface of said concave deflector portion extending radially outward from said outer wall of said collar portion, said front surface of said concave deflector portion extending radially outward from said discharge port, said front surface of said concave deflector portion configured to generally face a target to which a spray is being applied, a downstream portion of said spray tubing extending beyond said front surface of said spray deflector member so that said spray deflector member does not interfere with a required application of said fluid being dispensed, and said female socket of said spray deflector member having a concave curvature that substantially corresponds to an outer curvature of said male portion of said deflector mounting member such that said male portion is configured to engage with said female socket and form a ball-and-socket joint therewith.

2. The spray shield device according to claim 1, wherein said ball-and-socket joint comprises a friction fit engagement between said male portion and said female socket such that a selected position of said spray deflector member relative to said deflector mounting member is capable of being maintained.

3. The spray shield device according to claim 1, wherein said outer wall of said collar portion of said spray deflector member further comprises a ribbed finger grip portion for facilitating an adjustment of an angular position of said spray deflector member relative to said deflector mounting member.

4. The spray shield device according to claim 1, wherein said deflector mounting member further includes a ribbed finger grip portion for facilitating the grasping thereof by a user.

5. The spray shield device according to claim 1, wherein said deflector mounting member further comprises at least one insert adapter member with a central passageway disposed lengthwise through said at least one insert adapter member, said central passageway configured to engage an outer wall of said spray tubing of said spray bottle or an outer wall of said spray tubing of said aerosol can, said at least one insert adapter member further configured to be received within said inner passageway of said deflector mounting member, said at least one insert adapter member including one or more annular projections for engaging with one or more respective grooves in a bounding wall of said inner passageway of said deflector mounting member.

6. The spray shield device according to claim 5, wherein said at least one insert adapter member comprises a plurality of insert adapter members that are capable of being interchangeably and removably engaged with said one or more respective grooves in said bounding wall of said inner passageway of said deflector mounting member, said plurality of insert adapter members configured to accommodate spray tubing of spray bottles or spray tubing of aerosol cans having varying diameters.

7. A spray shield device configured to deflect spray that is reflected from a target, said spray shield device comprising:

spray tubing configured to convey a fluid dispensed from a spray bottle or an aerosol can;

a deflector mounting member configured to engage said spray tubing, said deflector mounting member including an inner passageway extending linearly along a length of said deflector mounting member, a section of said spray tubing configured to be received within said inner passageway of said deflector mounting member, said deflector mounting member further including a male portion circumscribing said inner passageway, said deflector mounting member additionally comprising at least one insert adapter member with a central passageway disposed lengthwise through said at least one insert adapter member, said central passageway configured to engage an outer wall of said spray tubing of said spray bottle or an outer wall of said spray tubing of said aerosol can, said at least one insert adapter member further configured to be received within said inner passageway of said deflector mounting member, said at least one insert adapter member including one or more annular projections for engaging with one or more respective grooves in a bounding wall of said inner passageway of said deflector mounting member; and a spray deflector member including a concave deflector portion and a collar portion, said concave deflector portion comprising a front surface and a rear surface disposed opposite to said front surface, said collar portion comprising a female socket for matingly engaging with said male portion of said deflector mounting member, a discharge port downstream of said female socket, and an outer wall circumscribing said female portion, said rear surface of said concave deflector portion extending radially outward from said outer wall of said collar portion, said front surface of said concave deflector portion extending radially outward from said discharge port, and said front surface of said concave deflector portion configured to generally face a target to which a spray is being applied.

8. The spray shield device according to claim 7, wherein said at least one insert adapter member comprises a plurality of insert adapter members that are capable of being interchangeably and removably engaged with said one or more respective grooves in said bounding wall of said inner passageway of said deflector mounting member, said plurality of insert adapter members configured to accommodate spray tubing of spray bottles or spray tubing of aerosol cans having varying diameters.

9. The spray shield device according to claim 7, wherein said male portion of said deflector mounting member has a generally spherical or ball shape, and wherein said female socket of said spray deflector member has a concave curvature that substantially corresponds to an outer curvature of said male portion of said deflector mounting member such that said male portion is configured to engage with said female socket and form a ball-and-socket joint therewith.

10. The spray shield device according to claim 9, wherein said ball-and-socket joint comprises a friction fit engagement between said male portion and said female socket such that a selected position of said spray deflector member relative to said deflector mounting member is capable of being maintained.

11. The spray shield device according to claim 7, wherein a downstream portion of said spray tubing extends beyond said front surface of said spray deflector member so that said spray deflector member does not interfere with a required application of said fluid being dispensed.

* * * * *